US011166572B2

(12) United States Patent
Agnoli et al.

(10) Patent No.: US 11,166,572 B2
(45) Date of Patent: Nov. 9, 2021

(54) MODULAR WALL SYSTEM FOR DISPLAYING A PRODUCT

(71) Applicant: Apple Inc., Cupertino, CA (US)

(72) Inventors: Vasco Agnoli, Stinson Beach, CA (US); James Andrus, San Francisco, CA (US); Sam Brown, Sunnyvale, CA (US); James Casey Feeney, Los Gatos, CA (US); Christopher M. Green, Woodside, CA (US); Kully Kraig Mandon, San Francisco, CA (US); Christopher Daniel Peak, Oakland, CA (US); Jonathan P. Siegel, San Francisco, CA (US); Stefan Behling, London (GB); Kevin Fenton Smeds, San Francisco, CA (US); Andrew Charles Deffenbaugh, San Francisco, CA (US); Gregory James Ranes, Redwood City, CA (US); Charles A. Schwalbach, Menlo Park, CA (US); Sheng Yang, Mountain View, CA (US); Graham O'Brien, Toronto (CA)

(73) Assignee: Apple Inc., Cupertino, CA (US)

( * ) Notice: Subject to any disclaimer, the term of this patent is extended or adjusted under 35 U.S.C. 154(b) by 203 days.

(21) Appl. No.: 15/907,998

(22) Filed: Feb. 28, 2018

(65) Prior Publication Data

US 2018/0184817 A1 Jul. 5, 2018

Related U.S. Application Data

(63) Continuation of application No. 15/215,215, filed on Jul. 20, 2016, now Pat. No. 9,936,826.

(Continued)

(51) Int. Cl.
*A47F 10/00* (2006.01)
*A47F 3/00* (2006.01)

(Continued)

(52) U.S. Cl.
CPC ..... *A47F 10/00* (2013.01); *A47F 3/004* (2013.01); *A47F 3/005* (2013.01); *A47F 3/063* (2013.01);

(Continued)

(58) Field of Classification Search
CPC ..... A47F 10/00; A47F 3/005; A47F 11/10; A47F 3/004; A47F 7/0078; A47F 3/14;

(Continued)

(56) References Cited

U.S. PATENT DOCUMENTS 463,932 A 11/1891 Allison
637,361 A 11/1899 Suters (Continued)

OTHER PUBLICATIONS

Communication pursuant to Article 94(3) EPC, dated Feb. 5, 2019, issued in corresponding European Application No. 16 754 605.0, 4 pages.

*Primary Examiner* — Brent W Herring
(74) *Attorney, Agent, or Firm* — Sterne, Kessler, Goldstein & Fox P.L.L.C.

(57) ABSTRACT

A system for displaying a product is disclosed. The system includes a wall having a recess therein and a display structure that defines the recess. The display structure extends through a front surface of the wall and includes a frame having a top panel, a bottom panel, and two side panels. The top and bottom panels are longer than the side panels. The system further includes a plurality of modular display units disposed within the display structure. Each modular display unit extends from the bottom panel to the top panel. At least a first one of the modular display units (Continued)

includes a frame open to a front exterior of the display structure and at least a second one of the modular display units is not open to the front exterior of the display structure. The system further includes a plurality of display elements disposed within the plurality of display units.

18 Claims, 56 Drawing Sheets

Related U.S. Application Data

(60) Provisional application No. 62/327,674, filed on Apr. 26, 2016, provisional application No. 62/208,432, filed on Aug. 21, 2015.

(51) Int. Cl.

| | |
|---|---|
| ***A47F 5/10*** | (2006.01) |
| ***A47F 11/02*** | (2006.01) |
| ***A47F 3/06*** | (2006.01) |
| ***A47F 3/14*** | (2006.01) |
| ***A47F 7/00*** | (2006.01) |
| ***A47F 11/10*** | (2006.01) |
| ***E04B 2/58*** | (2006.01) |
| *A47B 81/00* | (2006.01) |
| *E04F 19/08* | (2006.01) |

(52) U.S. Cl.
CPC ..... *A47F 3/14* (2013.01); *A47F 5/10* (2013.01); *A47F 7/0078* (2013.01); *A47F 11/02* (2013.01); *A47F 11/10* (2013.01); *E04B 2/58* (2013.01); *A47B 81/002* (2013.01); *E04F 19/08* (2013.01)

(58) Field of Classification Search
CPC .. A47F 3/063; A47F 5/10; A47F 11/02; E04B 2/58; E04F 19/08; A47B 81/002
See application file for complete search history.

(56) References Cited

U.S. PATENT DOCUMENTS 1,035,015 A * 8/1912 Johnson ..... A47F 3/005 232/19
1,751,107 A * 3/1930 Smith ..... A47B 67/02 312/227
2,915,195 A 12/1959 Crosby
3,360,136 A 12/1967 Ain
3,620,404 A * 11/1971 Grasso ..... E04F 19/08 174/503
3,997,220 A * 12/1976 Mayer ..... A47F 3/00 312/242
4,103,782 A 8/1978 Mayer
4,128,286 A * 12/1978 Windisch ..... A47F 5/105 211/86.01
4,202,586 A 5/1980 Oplinger
4,221,442 A * 9/1980 Harangozo ..... A24F 19/0092 312/242
4,236,353 A 12/1980 Sorenson
4,681,380 A * 7/1987 Carlin ..... A47B 81/002 312/242
4,736,996 A * 4/1988 Zeichner ..... A47B 61/04 312/118
5,191,747 A * 3/1993 Tengquist ..... A47F 10/02 108/42
5,203,255 A 4/1993 Wells et al.
5,267,786 A 12/1993 Aisley
5,291,396 A 3/1994 Calcerano et al.
5,465,852 A 11/1995 Koks et al.
5,645,330 A * 7/1997 Artwohl ..... A47F 3/0426 312/116
5,658,068 A 8/1997 Fritts
5,707,904 A 1/1998 Gray et al.
5,813,735 A * 9/1998 Wu ..... A47B 46/00 312/199
5,860,714 A * 1/1999 Skord, Jr. ..... G07F 9/02 312/124
6,027,189 A 2/2000 Gunderson et al.
6,367,223 B1 * 4/2002 Richardson ..... A47F 3/0434 312/116
6,480,243 B2 * 11/2002 Yamamoto ..... G06F 1/1601 312/242
6,530,490 B1 * 3/2003 Kosann ..... A47F 5/0018 211/189
6,547,084 B2 4/2003 Bauman et al.
6,606,833 B2 * 8/2003 Richardson ..... A47F 3/0434 312/116
7,175,034 B2 2/2007 Nook et al.
7,478,892 B2 1/2009 Punzel et al.
7,641,253 B2 1/2010 Steiger et al.
7,789,472 B2 * 9/2010 Richardson ..... A47F 3/004 312/265.3
8,109,581 B1 2/2012 Lazenby
8,419,140 B2 4/2013 Ward
8,955,261 B2 2/2015 Kobe et al.
9,235,967 B1 1/2016 Magee et al.
9,273,473 B2 3/2016 Millson et al.
9,468,314 B2 * 10/2016 Goodwin ..... A47F 5/0838
9,572,460 B2 * 2/2017 Petocchi ..... A47K 10/3612
2002/0078654 A1 * 6/2002 Richardson ..... A47F 3/0434 52/656.9
2003/0038099 A1 * 2/2003 Bauman ..... A47F 3/004 211/71.01
2004/0060884 A1 4/2004 Nook et al.
2005/0102918 A1 * 5/2005 Richardson ..... A47F 3/004 52/79.1
2006/0255699 A1 * 11/2006 Punzel ..... A47B 81/005 312/217
2008/0093319 A1 * 4/2008 Stover ..... A47B 97/001 211/85.26
2008/0218040 A1 * 9/2008 Punzel ..... A47B 47/02 312/128
2010/0102685 A1 4/2010 Ward
2011/0036855 A1 * 2/2011 Petocchi ..... A47K 10/3612 221/1
2011/0266337 A1 * 11/2011 Reynolds ..... G06Q 30/02 235/375
2011/0283632 A1 * 11/2011 Sutton ..... A47B 46/005 52/36.1
2012/0080985 A1 4/2012 Alarcon et al.
2013/0093298 A1 4/2013 Ehmke et al.
2013/0192153 A1 8/2013 Kobe et al.
2013/0321715 A1 12/2013 Millson et al.
2014/0326745 A1 11/2014 Young et al.
2015/0033994 A1 * 2/2015 Popwell ..... E05G 1/10 109/43
2015/0167333 A1 6/2015 Kobe et al.
2015/0335177 A1 * 11/2015 Goodwin ..... A47F 5/0838 211/41.1
2016/0125375 A1 * 5/2016 Magee ..... G07F 19/201 705/43
2016/0173809 A1 6/2016 Millson et al.

* cited by examiner

MODULAR WALL SYSTEM FOR DISPLAYING A PRODUCT

CROSS-REFERENCE

This application is a continuation of U.S. patent application Ser. No. 15/215,215, filed Jul. 20, 2016, which claims priority to U.S. Provisional Application No. 62/208,432, filed Aug. 21, 2015, and U.S. Provisional Application No. 62/327,674, filed Apr. 26, 2016. Each of these applications is incorporated herein in its entirety by reference thereto.

FIELD

The described embodiments relate generally to modular wall systems.

BACKGROUND

Display systems may be utilized in a retail environment to display a product.

SUMMARY

The present disclosure details systems, apparatuses, and methods related to modular wall systems for displaying products. A wall system for displaying products may include a wall having a recess therein, a display structure defining the recess, a plurality of modular display units disposed within the display structure, and a plurality of display elements disposed within the plurality of display units.

In some embodiments, the display structure extends through a front surface of the wall and includes a frame having a top panel, a bottom panel, and two side panels. In some embodiments, the top and bottom panels are longer than the side panels. In some embodiments, each modular display unit extends from the bottom panel to the top panel. At least a first one of the modular display units has a frame open to a front exterior of the display structure and at least a second one of the modular display units is not open to the front exterior of the display structure.

In some embodiments, the plurality of modular display units are removable and replaceable within the display structure such that their order therein can be rearranged. In some embodiments, at least the first one of the modular display units is movable within the display structure. In some embodiments, at least the first one of the modular display units is slidable within the display structure. In some embodiments, at least the second one of the modular display units is movable within the display structure. In some embodiments, at least the second one of the modular display units is slidable within the display structure.

One or more embodiments have tracks disposed on inner surfaces of the top and bottom panels and a rolling system disposed on an outer surface of a top and a bottom of each modular display unit. The rolling system interfaces with the tracks to allow the display units to slide along the top and bottom panels.

In some embodiments, the modular display units are mounted to a rear panel of the display structure. In some embodiments, the modular display units are mounted to a rear panel of the display structure by cleats.

In some embodiments, the modular display units are arranged side-by-side. In some embodiments, each of the modular display units is not disposed above or below another modular display unit.

In some embodiments, a maximum height of the display structure is at least fifty percent of a maximum height of the wall. A maximum length of the display structure may be at least fifty percent of a maximum length of the wall. A maximum height of the display structure may be at least seventy-five percent of a maximum height of the wall. A maximum length of the display structure may be at least seventy-five percent of a maximum length of the wall. In some embodiments, the display structure has a constant height along its length. In some embodiments, the display structure has a constant length along its height. In some embodiments, the display structure has a constant depth along its height and length.

In one or more embodiments, the frame of the display structure protrudes from the wall. The frame of the display structure may protrude from the wall by at least one inch. The frame of the display structure may protrude from the wall by at least two inches (e.g., three to four inches).

In one or more embodiments, a height of the display structure is at least four feet. A height of the display structure may be six feet. In one or more embodiments, a length of the display structure is at least fifty feet. A length of the display structure may be seventy-five feet. In one or more embodiments, a depth of the display structure is at least 1 foot. A depth of the display structure may be 10 inches to 25 inches (e.g., two feet).

In some embodiments, a length of at least one of the display units is at least five feet and a length of at least one of the display units is at least ten feet. In some embodiments, a length of at least one of the display units is at least fifteen feet and a length of at least one of the display units is at least twenty feet.

In some embodiments, at least the first one of the modular display units comprises a back wall having a hole, and the frame includes a top wall, a bottom wall, and two side walls. In some embodiments, at least the second one of the modular display units comprises a glass front. In some embodiments, at least one of the plurality of modular display units comprises a graphic light box that comprises a fabric graphic panel and a light source disposed behind the fabric graphic panel. In some embodiments, at least one of the plurality of modular display units comprises a planter module disposed therein, wherein the planter module comprises at least one living plant.

In one or more embodiments, the frame of the display structure comprises a rear panel that defines a plurality of openings therethrough. Some embodiments may further comprise a data box disposed within each of the plurality of openings that provides power and data to the display elements.

In some embodiments, the display elements comprise shelves. In some embodiments, the display elements comprise hooks. In some embodiments, the display elements comprise display stands. In some embodiments, the display elements comprise products for sale. At least one of the display elements may be integral with one of the modular display units. In some embodiments, the display elements comprise a fabric graphic panel or a video display screen. In some embodiments, the display elements comprise an advertisement.

In some embodiments, a retail environment includes a side wall. The retail environment may include a display structure built into and extending along the side wall. The display structure may have a frame and a cavity open to a front side of the wall with the frame defining the outer periphery of the cavity. In some embodiments, the cavity is recessed relative to the frame. The cavity may have a total cavity length N with the total cavity length N being configured in increments of n. In some embodiments, the retail environment includes at least two modular display units configured for placement within the cavity of the display structure. The modular display units may have a unit length that is configured in increments of n. According to some embodiments, the total length of all the modular display units is equal to the total cavity length N. In some embodiments, at least two of the modular display units have different display characteristics.

In some embodiments, there are two side walls. In some embodiments, the at least two modular display units comprises nine modular display units. In some embodiments, n is five feet. In some embodiments, N is at least fifty feet. In some embodiments, N is at least seventy-five feet. In some embodiments, N is one hundred feet.

In some embodiments, a wall system for displaying products may include a wall having a recess therein, a display structure defining the recess, and a plurality of trays. In some embodiments, the display structure extends through a front surface of the wall and comprises a frame having a top panel, a bottom panel, and two side panels. In some embodiments, the top and bottom panels are longer than the side panels. In some embodiments, the plurality of trays are disposed on the bottom panel. In some embodiments, the plurality of trays are movable along the bottom panel.

In some embodiments, the plurality of trays are each configured to receive a modular display unit. In some embodiments, the system includes a track disposed on the bottom panel and a wheel disposed on each of the plurality of trays. In some embodiments, the wheel interfaces with the track. In some embodiments, the plurality of trays are movable along the bottom panel by the wheel rolling along the track. In some embodiments, the system includes a track disposed on the top panel, a plurality of modular display units disposed on the plurality of trays, and a wheel disposed on a top of each of the plurality of modular display units. In some embodiments, the plurality of modular display units are movable along the display structure by moving with the plurality of trays and by the wheel rolling along the track. In some embodiments, there are more trays than modular display units.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
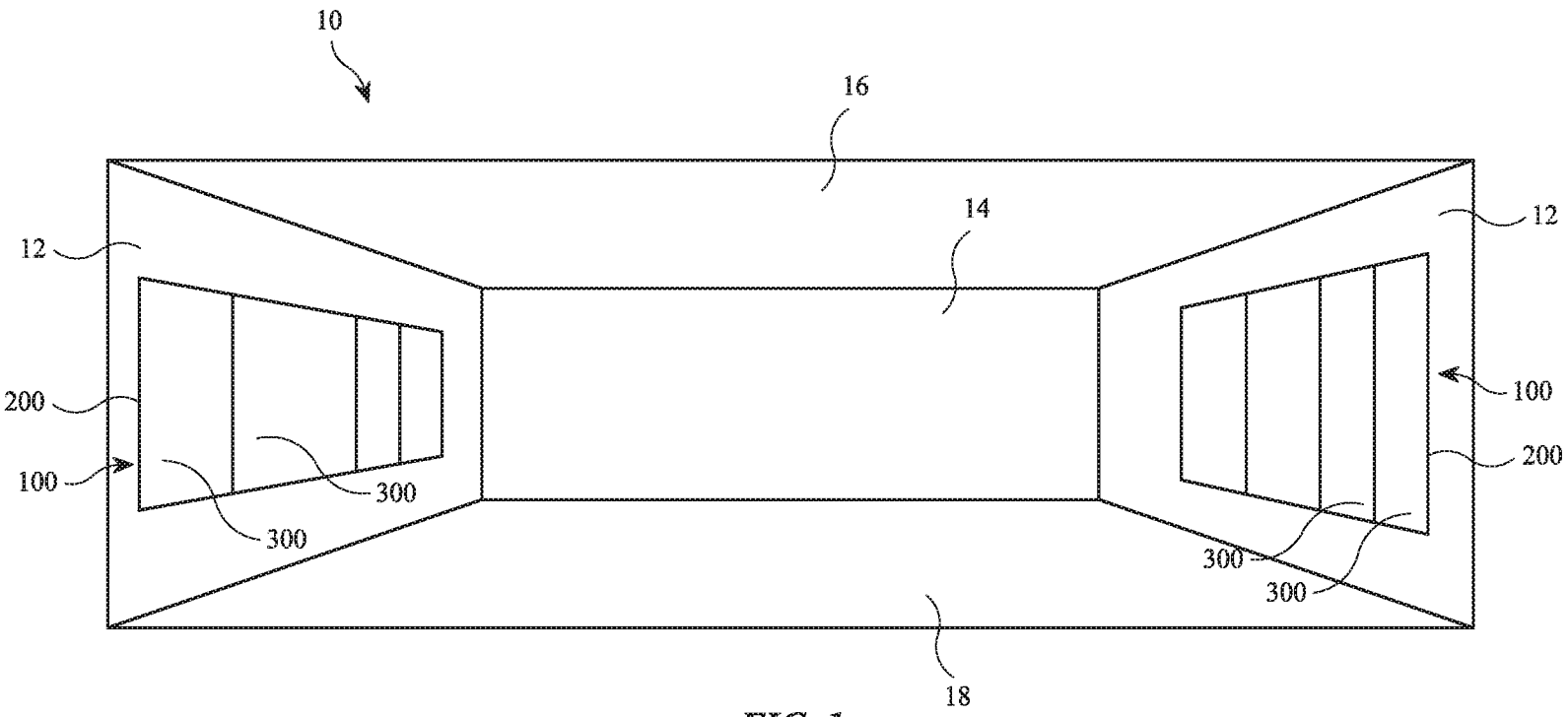
FIG. 1 shows a retail environment according to some embodiments.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

Retail stores, in addition to selling products, may provide a setting that promotes and reinforces the brands of the store and the products being sold. Such a setting may include general store layout and design, look-and-feel of the store, advertising material, and product display. As the offered products or the store itself may change, it is desirable to provide a modular and flexible merchandising and marketing platform to facilitate this change.

The following disclosure relates to a modular wall system for displaying products. Modular wall systems according to embodiments of the present invention may be installed in any kind of retail store. For example, modular wall systems may be configured for, but not limited to, installation in an electronics store. Moreover, modular wall systems are not limited to retail stores and may also be installed in museums, libraries, universities, and other locations. Such modular wall systems enable a display that is modular, reconfigurable, and flexible.

In some embodiments, a modular wall system includes a wall having a recess and a display structure that defines the recess. With this configuration, a plurality of modular display units may be disposed within the display structure. Each modular display unit is a self-contained, discrete element that is specifically designed to properly interface with the display structure.

The modular wall system facilitates change in the quantity, size, and arrangement of the modular display units in the display structure. In addition, different types of modular display units may be disposed in the display structure. One or more of the modular display units are movable within the display structure. For example, some of the modular display units may slide along the display structure. Thus, the modular wall system provides flexibility to accommodate various design needs for displaying products and other material.

In some embodiments, a plurality of display elements are disposed within and form part of the modular display units. One or more of the display elements may be integral with a modular display unit. Other display elements may not be integral. This multi-layered aspect of the modular wall system provides increased flexibility in the reconfigurability and design of the display. The display elements may include, but are not limited to, shelves, product stands, display cases, racks, drawers (including dividers), hooks, display stands or mounts, baskets, lights, seats or display screens (e.g., video screens), plants, or décor. In some embodiments, the modules may be used to provide a particular environment or informational display or to display or showcase products for sale or marketing material. In some embodiments, both the display structure and the modular display units include holes or openings through which power or data may be supplied to the display elements.

These and other embodiments are discussed below with reference to the figures. However, those skilled in the art will readily appreciate that the detailed description given herein with respect to these figures is for explanatory purposes only and should not be construed as limiting.

FIG. 1 is a front view showing a retail environment 10, such as a store or a room, including a modular wall system 100 according to some embodiments. While the discussion here relates to retail environment 10, other environments, locations, and institutions may also include modular wall system 100. Such locations and institutions may include universities, libraries, museums, and so on.

In some embodiments, retail environment 10 includes two side walls 12, a back wall 14, a ceiling 16, and a floor 18. Side walls 12 may include a left side wall and a right side wall. One side wall 12 may be opposite to another side wall 12. In some embodiments, only one side wall 12 comprises modular wall system 100. In other embodiments, both side walls 12 comprise modular wall systems 100, as shown in FIG. 1. Other walls may alternatively or additionally comprise modular wall system 100. For example, back wall 14 may comprise modular wall system 100.

Figure 2:
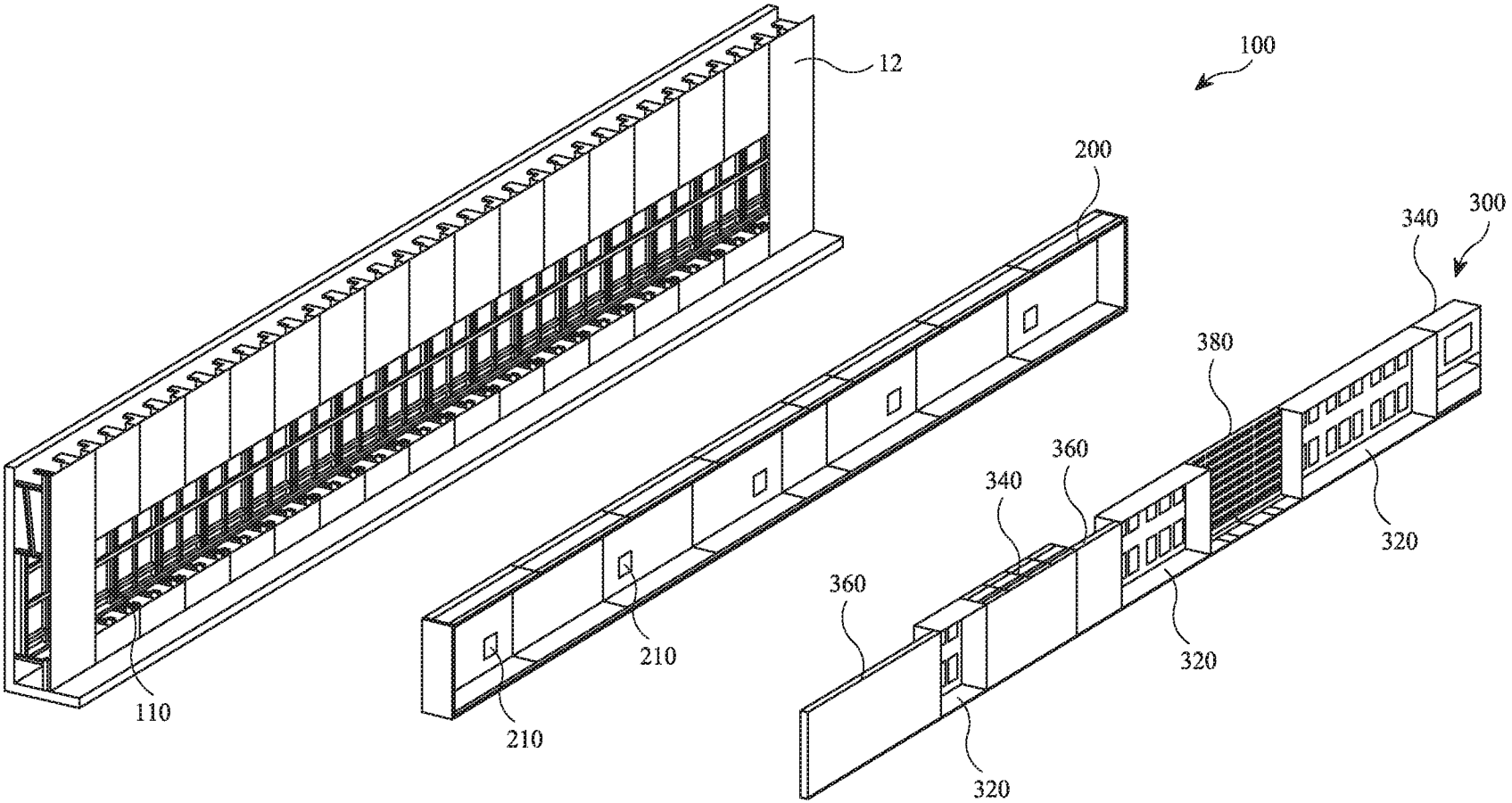
FIG. 2 is an exploded view of a modular wall system according to some embodiments.
Figure 3:
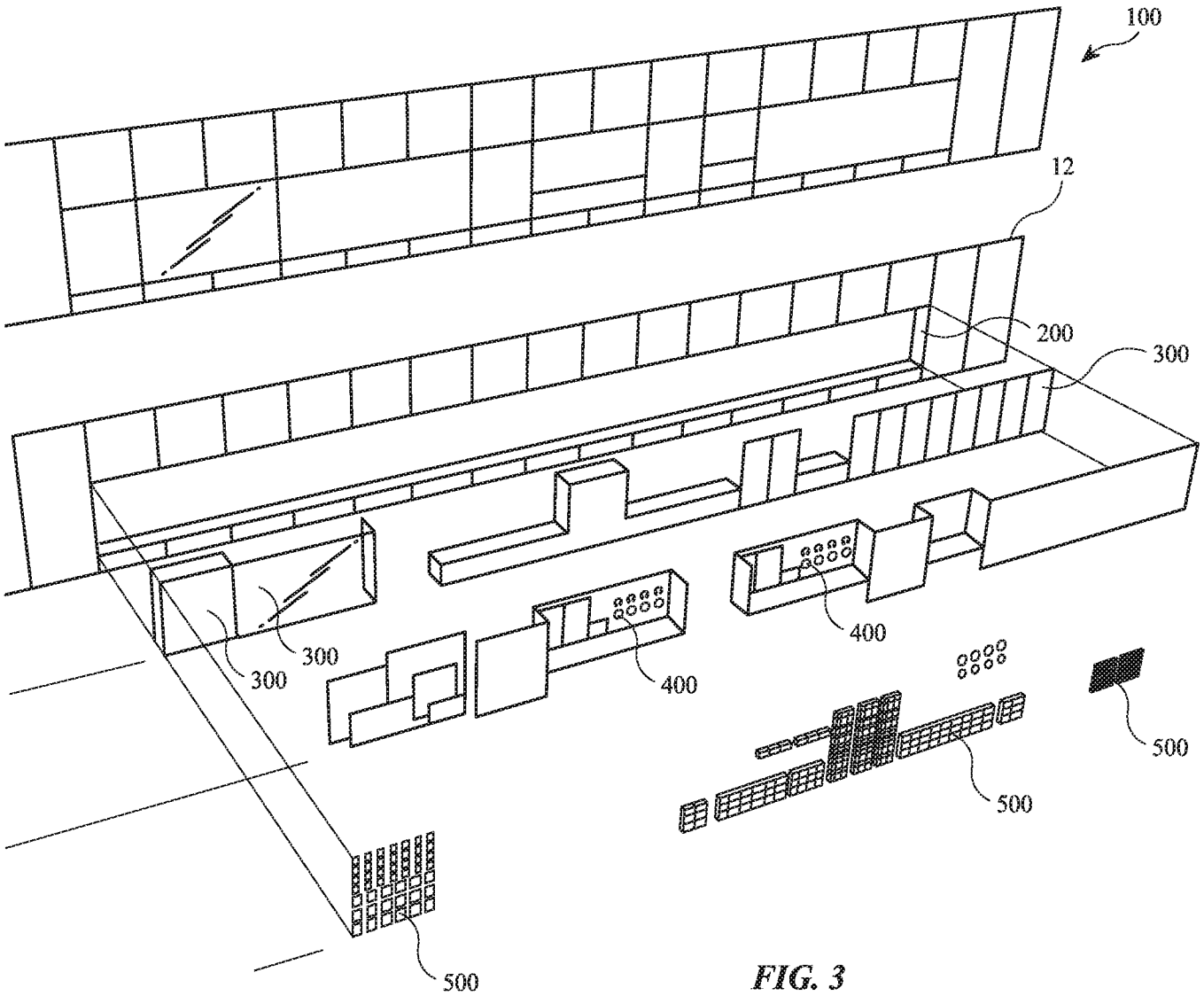
FIG. 3 is an exploded view of a modular wall system according to some embodiments.

Modular wall system 100, as shown in FIGS. 1-3, may include side wall 12, a display structure 200, and a plurality of modular display units 300. Modular display units 300 are configured to include one or more display elements 400, such as those depicted in FIGS. 39-45, and may showcase products 500.

Side wall 12, according to some embodiments, provides structural support for modular wall system 100. While side wall 12 is specifically discussed, other walls may similarly implement modular wall system 100. In some embodiments, side wall 12 is built specifically for modular wall system 100. In other embodiments, an existing wall is modified to create side wall 12 that interfaces with modular wall system 100. In addition to providing structural support, side wall 12 may also provide electrical infrastructure that interfaces with modular wall system 100 to deliver power and/or data required for display elements 400.

In some embodiments, side wall 12 may include a recess 110 that is shaped to receive display structure 200. In some embodiments, recess 110 is rectangular, as in FIG. 2. In other embodiments, recess 110 may be square, circular, oval, or some other shape. Side wall 12 may include multiple recesses 110. In addition, retail environment 10 may include multiple modular wall systems 100 and thus have more than one wall 12 with recess 110, as in FIG. 1.

Figure 4:
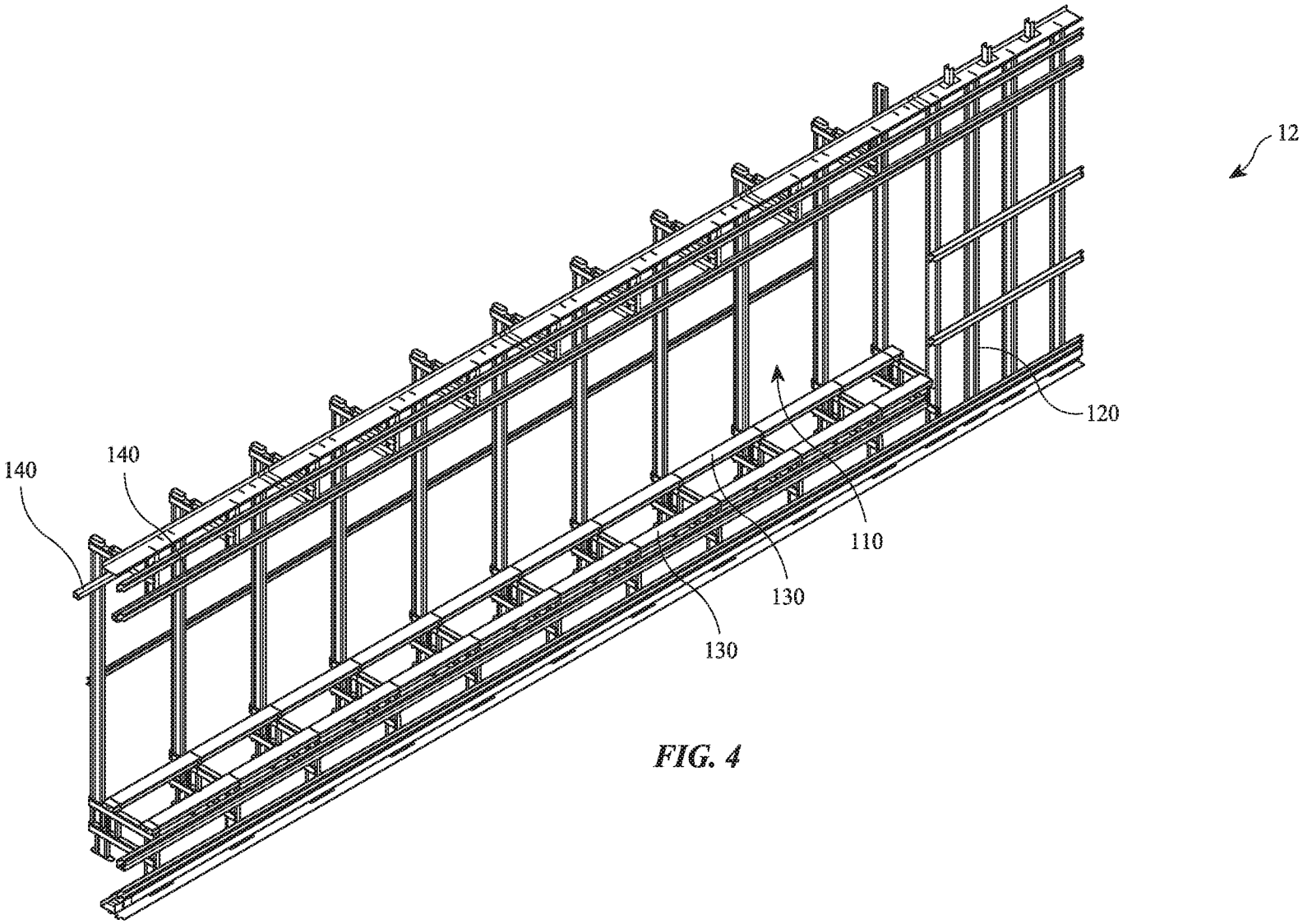
FIG. 4 is a perspective view of a side wall according to some embodiments.

An example of side wall 12 that is built specifically for modular wall system 100 is shown, for example, in FIG. 4. In some embodiments, side wall 12 provides structural support through beams 120 that are positioned to define recess 110. In some embodiments, one or more support rails 130 are disposed at the bottom of recess 110. For example, two support rails 130 may be disposed at the bottom of recess 110. In some embodiments, support rails 130 provide a mounting surface for a portion of display structure 200. In some embodiments, one or more unistrut rails 140 are disposed at the top of recess 110. For example, two unistrut rails 140 may be disposed at the top of recess 110. In some embodiments, unistrut rails 140 provide a mounting surface for a portion of display structure 200.

According to some embodiments, recess 110 has a height of at least four feet. In some embodiments, recess 110 has a height of six feet. The maximum height of recess 110 may be at least fifty percent of the maximum height of side wall 12. In some embodiments, the maximum height of recess 110 may be at least seventy-five percent of a maximum height of side wall 12.

According to some embodiments, recess 110 has a length of at least fifty feet. In some embodiments, recess 110 has a length of at least seventy-five feet. In some embodiments, recess 110 has a length of one hundred feet. The maximum length of recess 110 may be at least fifty percent of a maximum length of side wall 12. In some embodiments, the maximum length of recess 110 may be at least seventy-five percent of the maximum length of side wall 12.

According to some embodiments, recess 110 has a depth of at least one foot. In some embodiments, recess 110 has a depth of 10 inches to 25 inches (e.g., two feet). In some embodiments, recess 110 may have a depth of less than one foot (e.g., 10 inches). In some embodiments, recess 110 may have a depth of greater than one foot (e.g., 25 inches). Recess 110 may have a constant height along its length, a constant length along its height, and/or a constant depth along its height and length.

Figure 5:
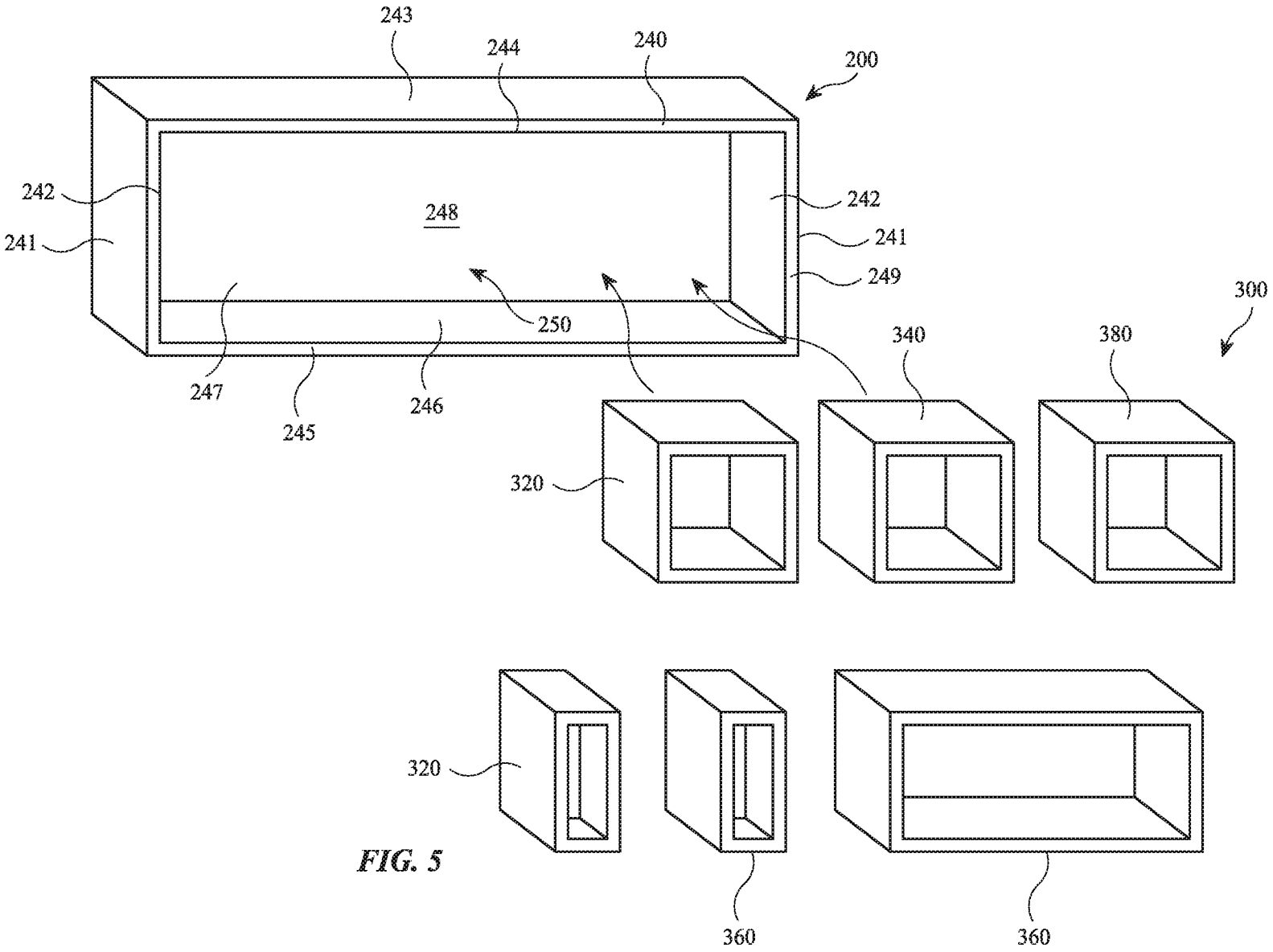
FIG. 5 shows a display structure and modular display units according to some embodiments.

Elements of modular wall system 100, such as, for example, display structure 200 and/or modular display units 300 are generally shaped to be disposed within recess 110 of side wall 12. In some embodiments, display structure 200 may be built into side wall 12. According to some embodiments, display structure 200 includes a frame 240 surrounding a display space 250, as shown in FIG. 5, for example.

Frame 240, according to some embodiments, includes two side panels 241 having inner surfaces 242, a top panel 243 having an inner surface 244, and a bottom panel 245 having an inner surface 246. In some embodiments, at least one of the panels (e.g., all of side panels 241, top panel 243, and bottom panel 245) of frame 240 is less than one-half inch thick. In some embodiments, at least one of the panels (e.g., side panels 241 and top panel 243) of frame 240 is less than one-quarter inch thick. In some embodiments, side panels 241 and top panel 243 are thinner than bottom panel 245. In some embodiments, frame 240 includes a rear panel 247 having an inner surface 248. In some embodiments, rear panel 247 is at least one-half inch thick. In some embodiments, rear panel 247 is at least three-quarters inch thick. In some embodiments, at least one of the panels (e.g., all of side panels 241, top panel 243, and bottom panel 245) of frame 240 is at least one inch thick. In some embodiments, at least one of the panels (e.g., all of side panels 241, top panel 243, and bottom panel 245) of frame 240 is two inches thick. In some embodiments, all of side panels 241, top panel 243, and bottom panel 245 are the same thickness. In some embodiments, at least one of the panels (e.g., all of side panels 241, top panel 243, and bottom panel 245) of frame 240 is made of wood (e.g., oak or maple, solid or veneer).

Figure 6:
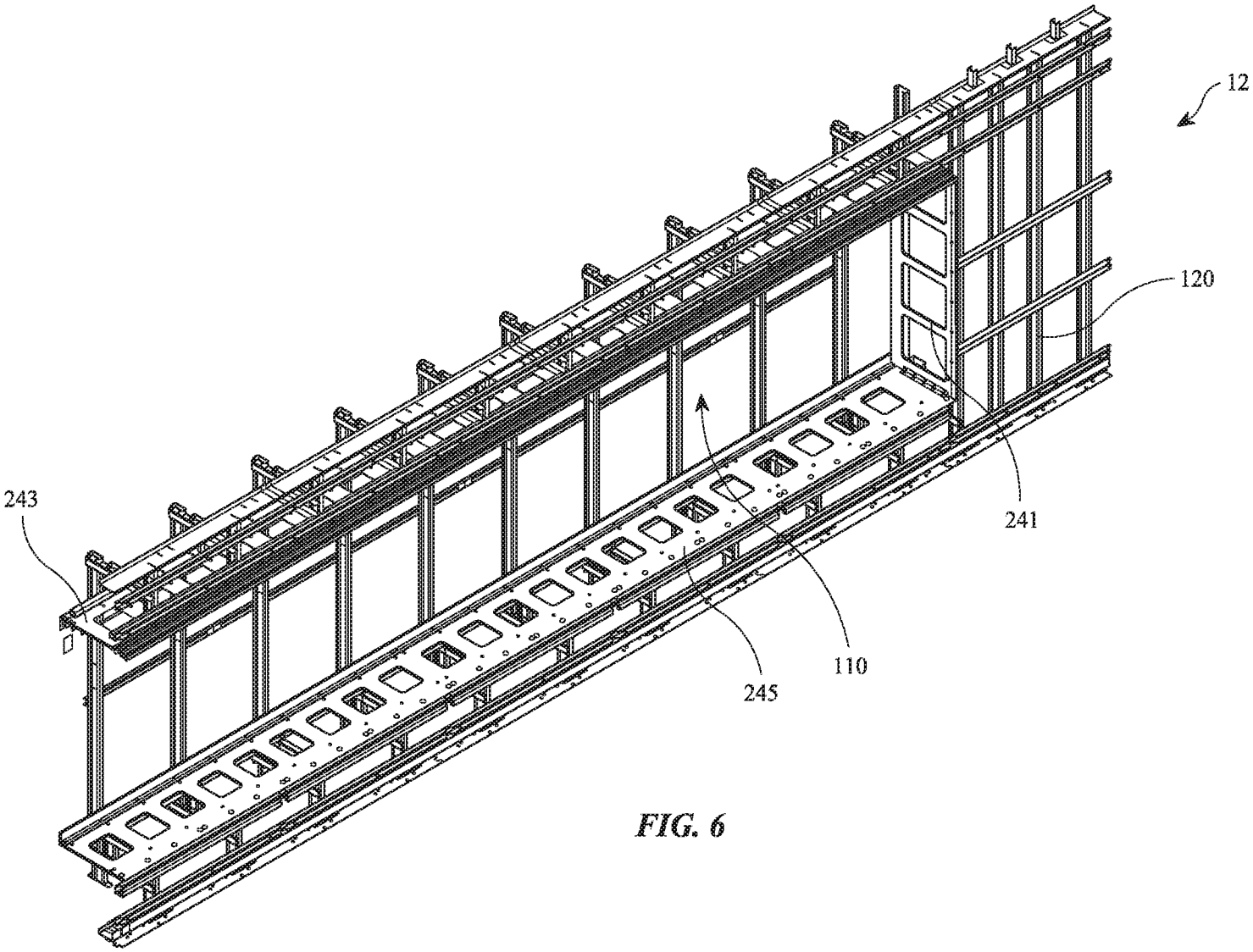
FIG. 6 is a perspective view of a side wall according to some embodiments.
Figure 7:
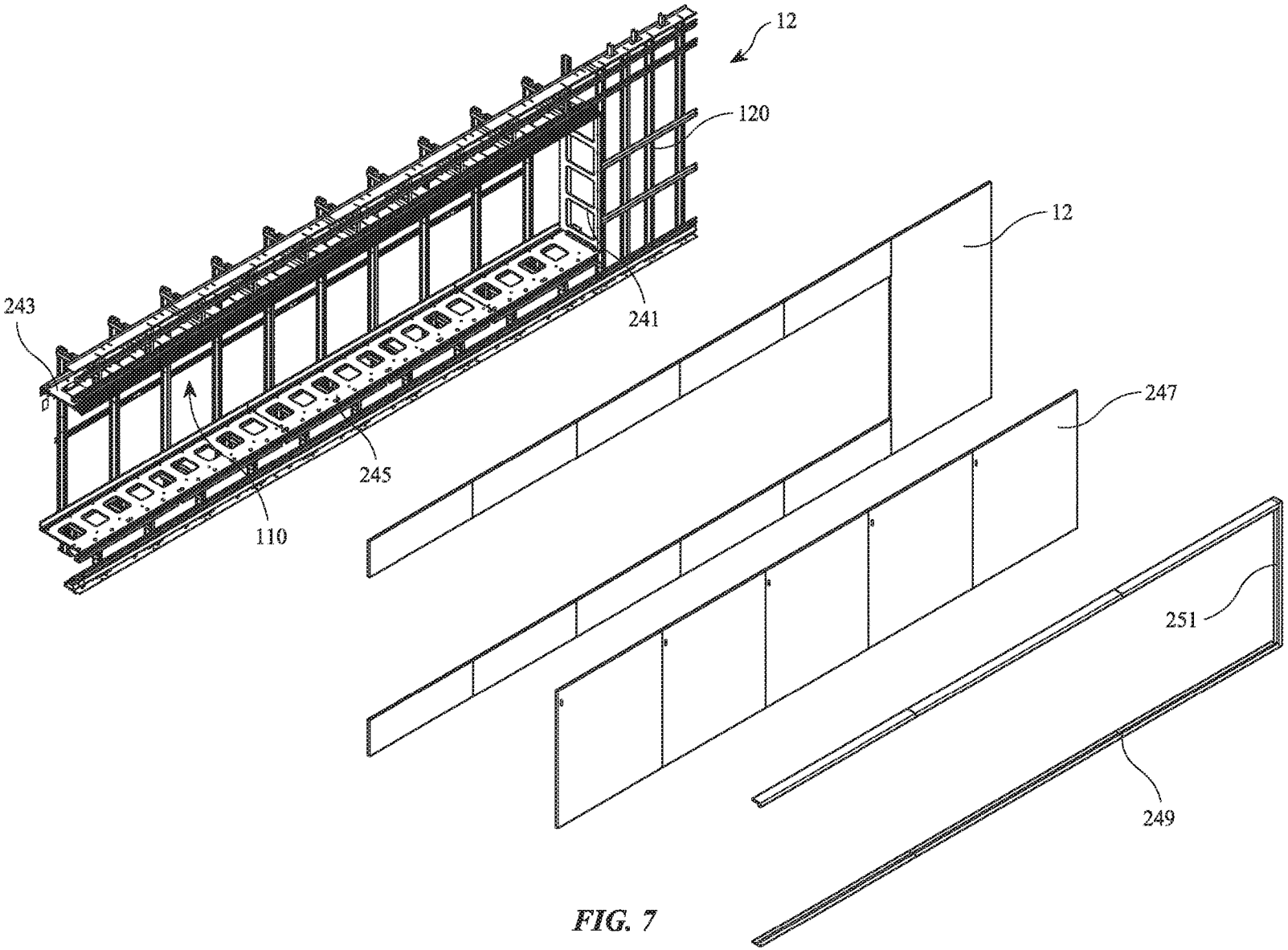
FIG. 7 is an exploded view of a side wall according to some embodiments.

In some embodiments, at least one of the panels (e.g., all of side panels 241, top panel 243, and bottom panel 245) of frame 240 is made of metal (e.g., steel or aluminum), as shown, for example, in FIGS. 6 and 7. In some embodiments, at least one of the panels (e.g., all of side panels 241, top panel 243, bottom panel 245, and rear panel 247) of frame 240 is unitary. In some embodiments, at least one of the panels (e.g., all of side panels 241, top panel 243, bottom panel 245, and rear panel 247) of frame 240 is made of multiple pieces, as in FIGS. 6 and 7. In some embodiments, top panel 243, bottom panel 245, and rear panel 247 of frame 240 is made of multiple pieces and side panel 243 is unitary. In some embodiments, each of the multiple pieces of at least one of the panels may be at least five feet in length. In some embodiments, each of the multiple pieces may be at least ten feet in length. In some embodiments, at least one of the panels (e.g., rear panel 247) is made of an engineered wood product, such as, for example, medium density fiberboard or plywood.

In some embodiments, frame 240 includes a front surface 249. In some embodiments, front surface 249 comprises a trimming or nosing 251, as shown, for example, in FIG. 7, that frames recess 110. In some embodiments, trimming or nosing 251 (and front surface 249) is made of a different material than side panels 241, top panel 243, or bottom panel 245. For example, side panels 241, top panel 243, and bottom panel 245 may be made of metal while trimming or nosing 251 may be made of wood (e.g., oak or maple). Thus, in some embodiments, trimming or nosing 251 gives the appearance that display structure 200 is made of wood. In some embodiments, trimming or nosing 251 is a portion of side panels 241, top panel 243, and bottom panel 245.

According to some embodiments, frame 240 protrudes from side wall 12 (e.g., the portion of frame 240 forming trimming or nosing 251 protrudes from side wall 12). In some embodiments, frame 240 protrudes from side wall 12 by at least one inch. For example, frame 240 may protrude from side wall 12 by two, three, or four inches. Similarly, the front portions of modular display units 300 may also protrude from side wall 12 in some embodiments. For example, the front portion of modular display units 300 may be aligned with frame 240.

Figure 8:
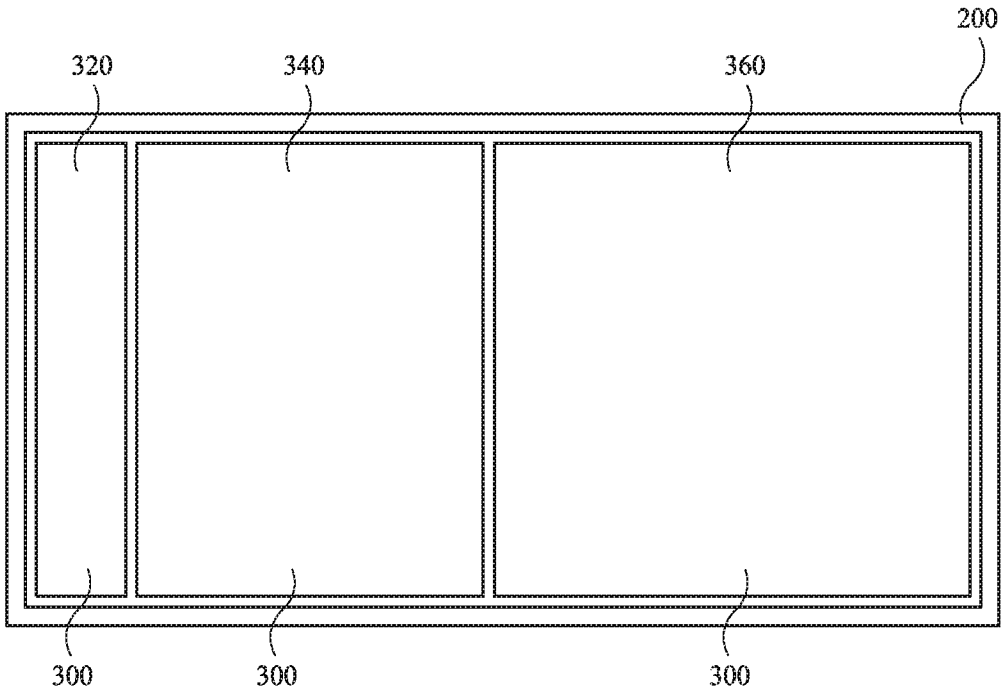
FIG. 8 shows a placement of modular display units into a display structure according to some embodiments.

Display space 250, according to some embodiments, is the space defined by frame 240. Display space 250 may be a cavity open to a front side of the wall. Frame 240 may or may not include rear panel 247 having inner surface 248. In some embodiments, display structure 200 is configured to receive modular display units 300 into display space 250, as in FIGS. 5 and 8. Modular display units 300 are configured according to a specification to fit into display space 250 of display structure 200. For example, modular display units 300 may extend vertically between inner surface 246 of bottom panel 245 and inner surface 244 of top panel 243, and modular display units 300 disposed side-by-side may together extend horizontally from inner surface 242 of one side panel 241 to the opposite inner surface 242 of the opposite side panel 241. Discrete modular display units 300 are reconfigurable within display structure 200 (i.e., their positions relative to each other may be changed).

Figure 9:
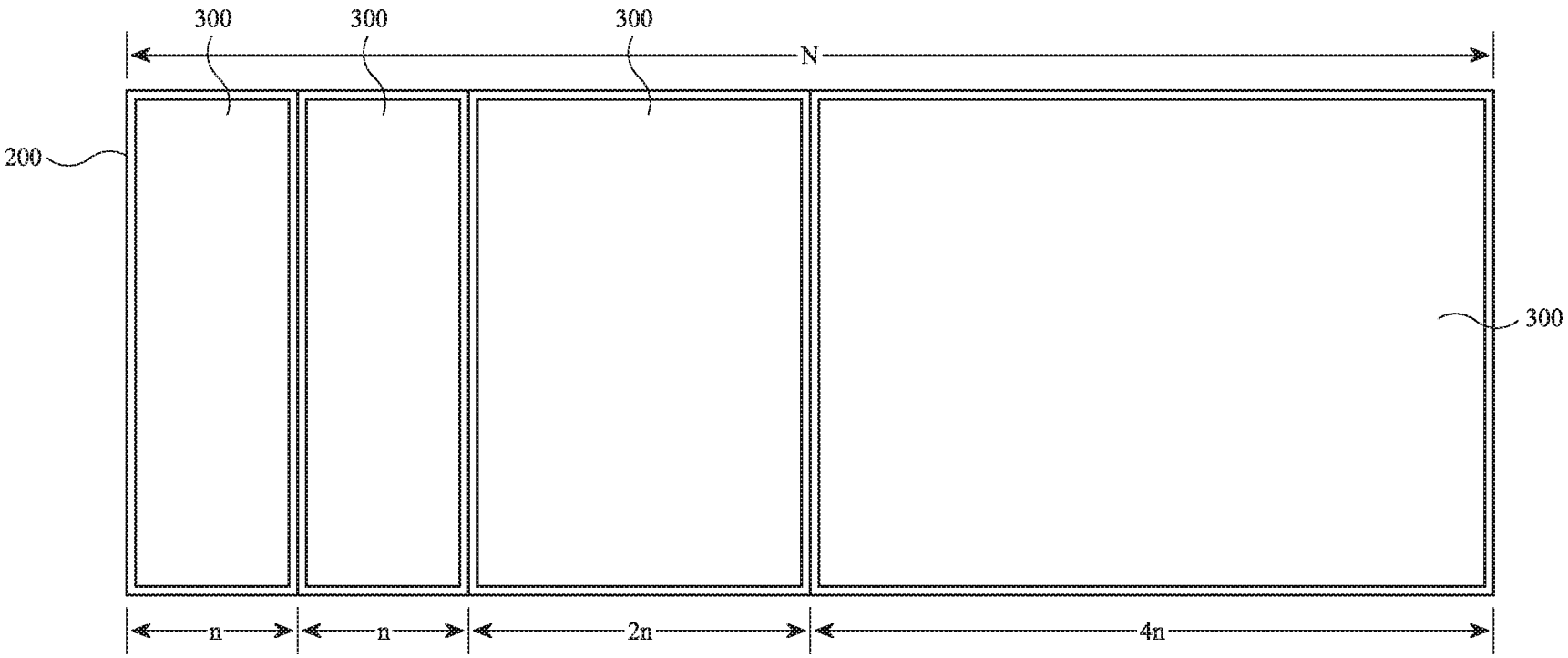
FIG. 9 shows a configuration of a modular wall system according to some embodiments.
Figure 10:
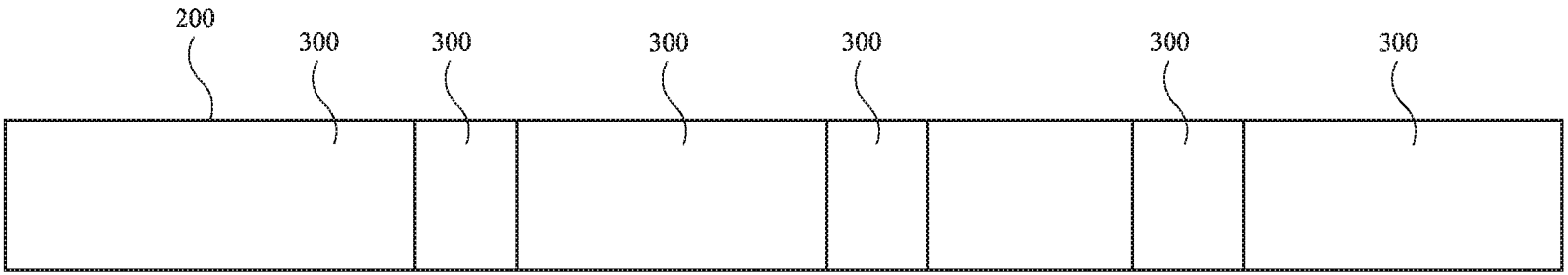
FIG. 10 shows a configuration of a modular wall system according to some embodiments.
Figure 11:
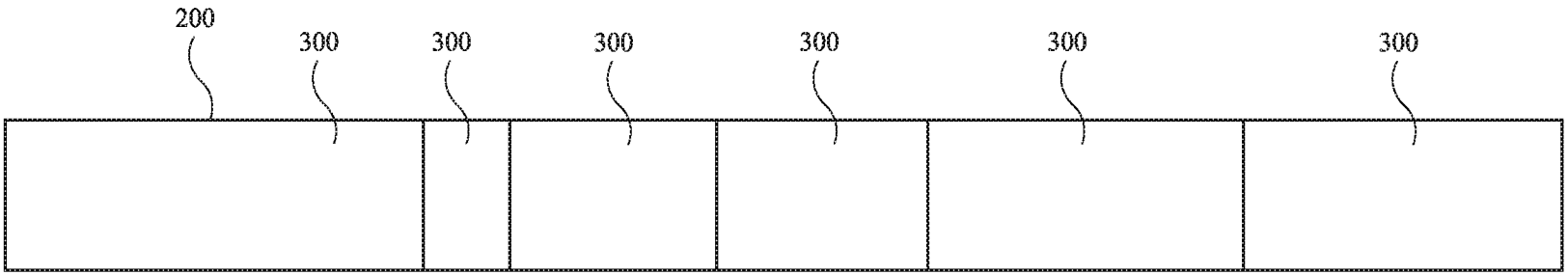
FIG. 11 shows a configuration of a modular wall system according to some embodiments.
Figure 12:
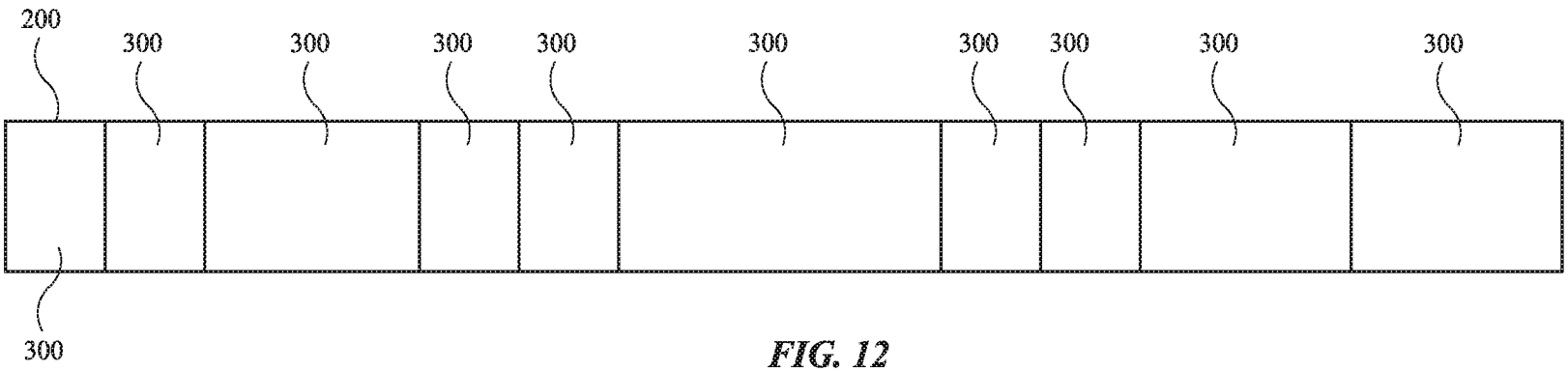
FIG. 12 shows a configuration of a modular wall system according to some embodiments.
Figure 13:
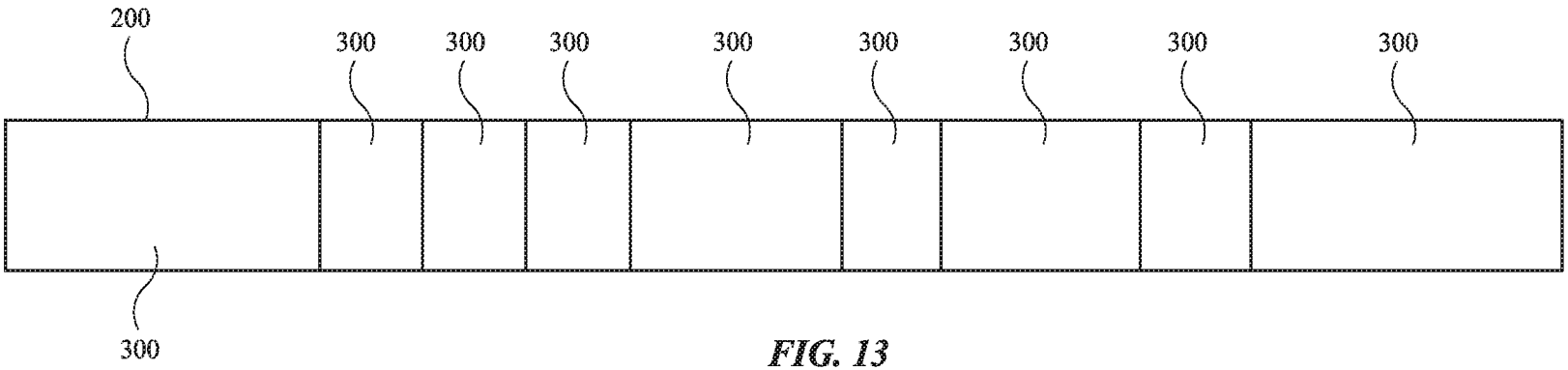
FIG. 13 shows a configuration of a modular wall system according to some embodiments.

As shown in FIG. 9, display space 250, in some embodiments, has a total length N. The total length N may be configured in increments of n. According to some embodiments, N is at least fifty feet. In some embodiments, N is at least seventy-five feet. For example, N may be one hundred feet. Modular display units 300, in some embodiments have unit lengths that are configured in increments of n. For example, one of individual modular display units 300 may have a unit length of n, 2n, 3n, or 4n. According to some embodiments, n is five feet. Thus, one of individual modular display units 300 may have a unit length of five feet, ten feet, fifteen feet, or twenty feet.

With this configuration, multiple arrangements are possible, as shown, for example in FIGS. 10-13. Because display units 300 are modular and discrete, modular wall system 100 can be reconfigured, as is discussed in more detail below.

In some embodiments, display structure 200 is substantially the same shape and size as the opening forming recess 110, so it fits within recess 110 without a gap between display structure 200 and the opening. According to some embodiments, display structure 200 is rectangular in cross-section. In other embodiments, display structure 200 may be square, circular, or oval in cross-section. According to some embodiments, modular wall system 100 comprises multiple display structures 200. For example, there may be a display structure 200 for a recess 110 on each side wall 12. As another example, there may be a display structure 200 for each recess 110 on a single side wall 12.

According to some embodiments, display structure 200 has a height of at least four feet. In some embodiments, display structure 200 has a height of six feet. The maximum height of display structure 200 may be at least fifty percent of the maximum height of side wall 12. In some embodiments, the maximum height of display structure 200 may be at least seventy-five percent of a maximum height of side wall 12. In some embodiments, the distance between floor 18 of retail environment 10 and the bottom of display structure 200 is at least one foot. For example, this distance may be one and a half feet. According to some embodiments, the distance between floor 18 of retail environment 10 and the top of display structure 200 is at least six feet. For example, this distance may be six and a half feet.

According to some embodiments, display structure 200 has a length of at least fifty feet. In some embodiments, display structure 200 has a length of at least seventy-five feet. In some embodiments, display structure 200 has a length of one hundred feet. The maximum length of display structure 200 may be at least fifty percent of a maximum length of side wall 12. In some embodiments, the maximum length of display structure 200 may be at least seventy-five percent of the maximum length of side wall 12.

Figure 14:
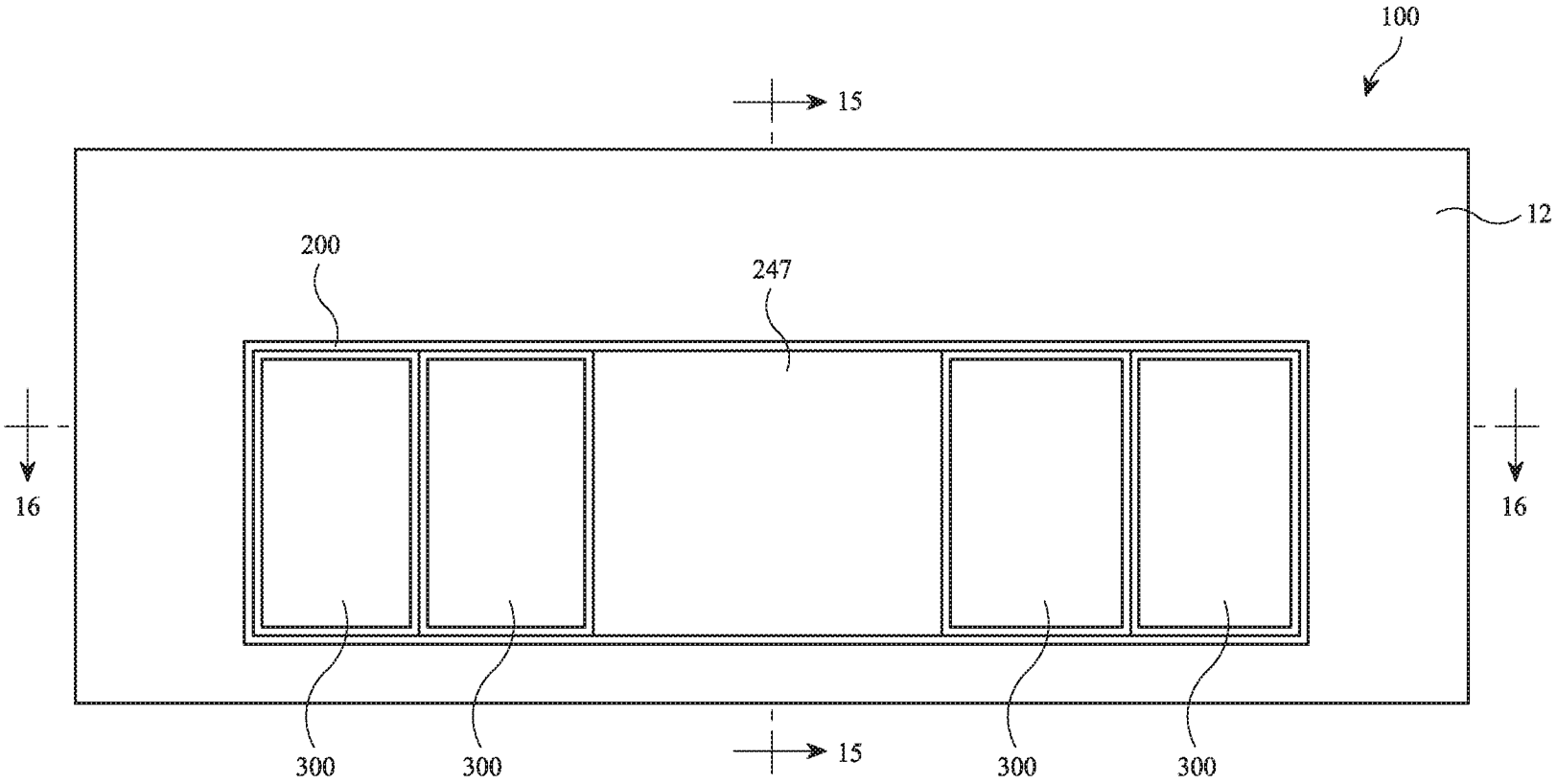
FIG. 14 is a front view of a side wall according to some embodiments.
Figure 15:
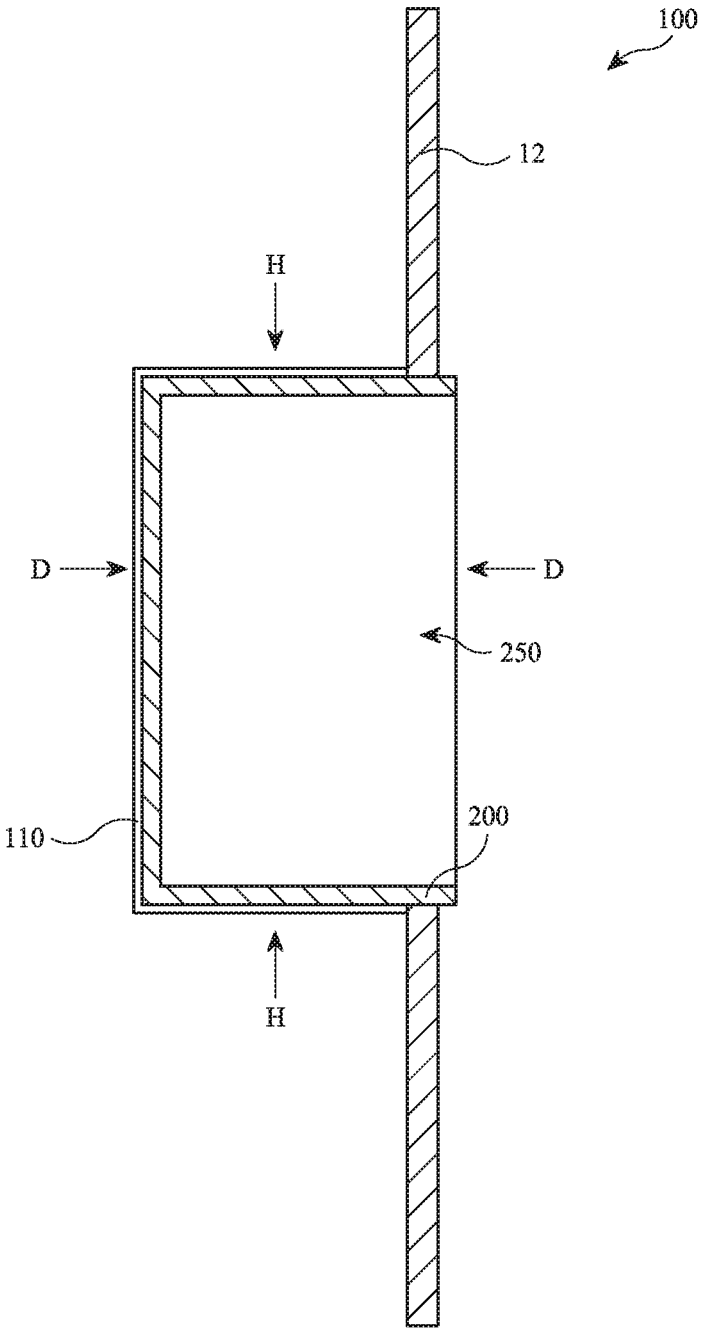
FIG. 15 is a side cross-section view of the side wall of FIG. 14 along line 15-15 according to some embodiments.
Figure 16:
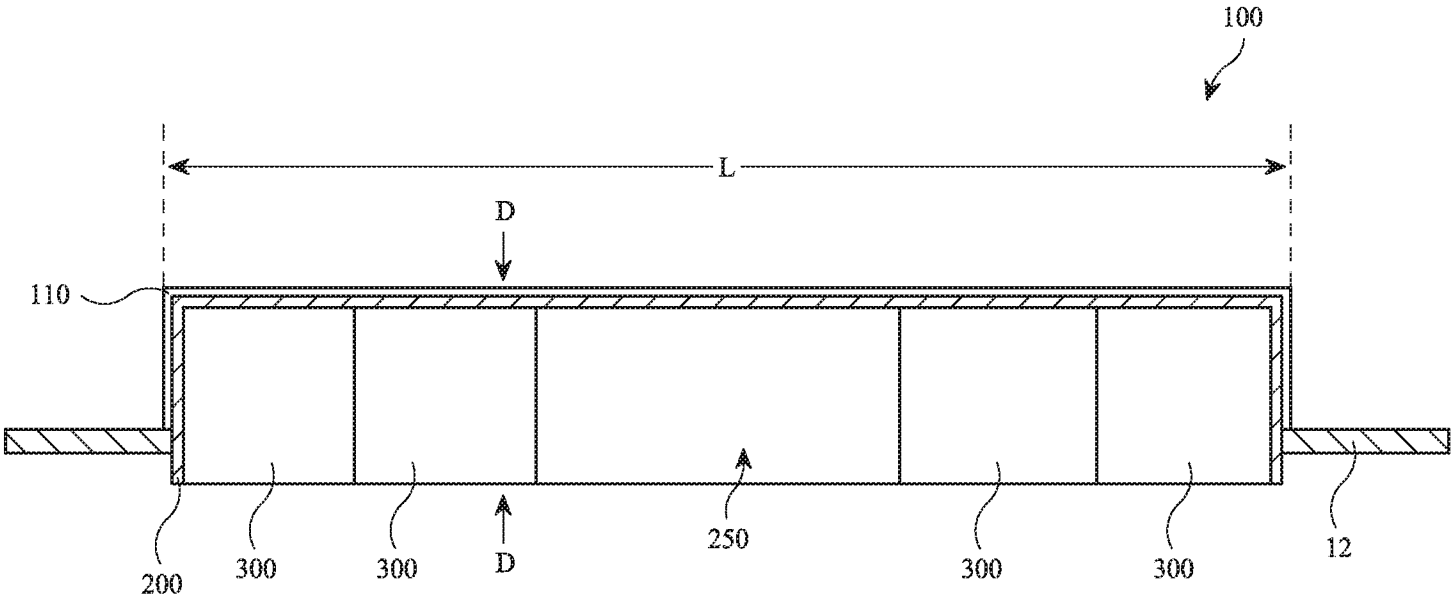
FIG. 16 is a top cross-section view of the side wall of FIG. 14 along line 16-16 according to some embodiments.

According to some embodiments, display structure 200 has a depth of at least one foot. In some embodiments, display structure 200 has a depth of two feet. Display structure 200 may have a constant height along its length, a constant length along its height, and/or a constant depth along its height and length. FIGS. 14-16 show display structure 200 built into side wall 12 according to some embodiments.

Figure 17:
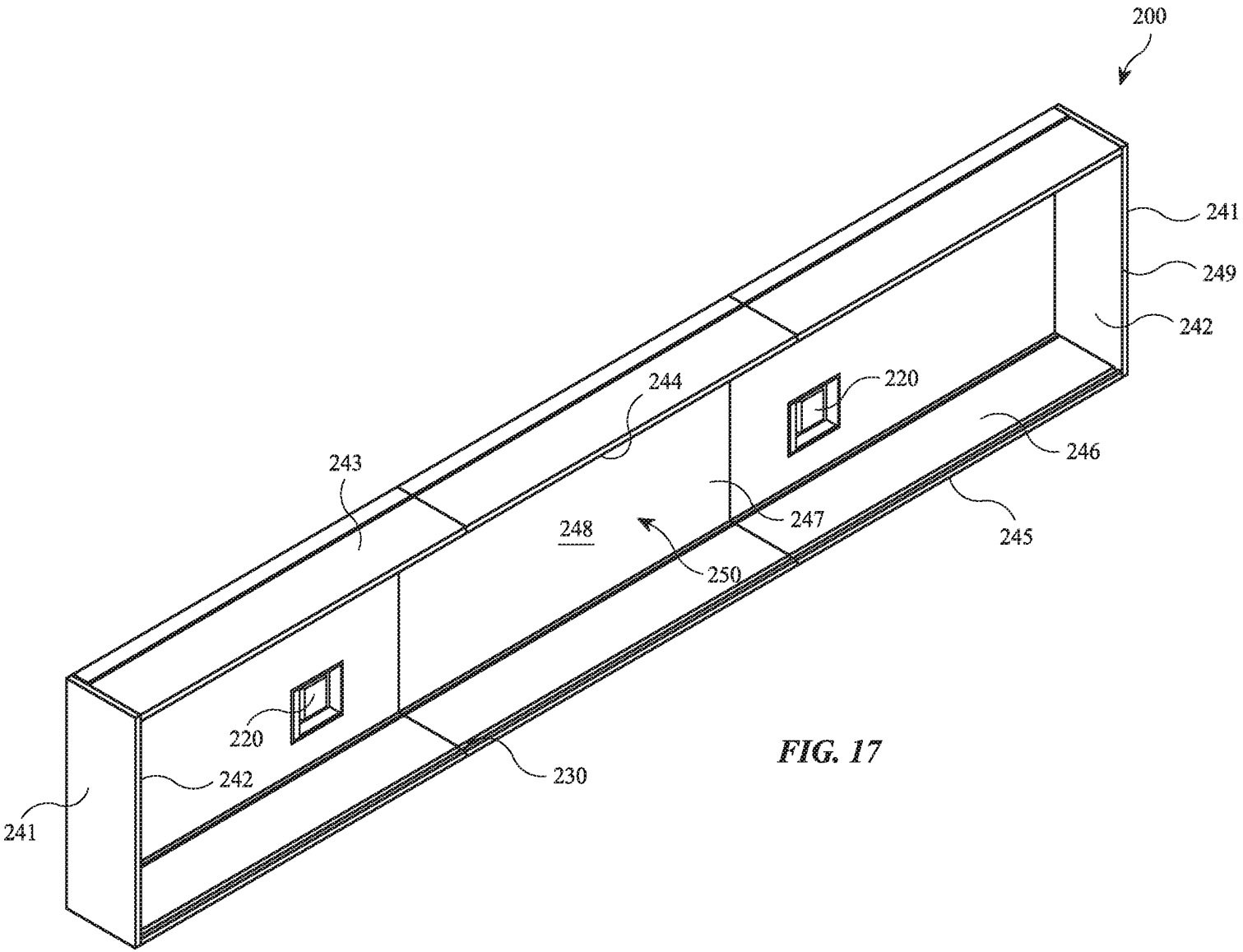
FIG. 17 shows a display structure according to some embodiments.

In some embodiments, rear panel 247 of display structure 200 defines one or more openings 210 therethrough, as shown in FIG. 2. According to some embodiments, rear panel 247 defines at least two openings 210. In some embodiments, rear panel 247 defines six openings 210. Openings 210 decrease the overall weight of display structure 200, and provide access therethrough for cabling, pipes, tubing and other utilities that may provide service to elements of modular wall system 100 (e.g., electricity, data, water, air, fire suppressant). For example, according to some embodiments, as shown in FIG. 17, data boxes 220 may be disposed within each opening 210 to provide data and/or power to display elements 400. In some embodiments, openings 210 in rear panel 247 and/or data boxes 220 are located at least every twenty-five feet along the length of rear panel 247. In some embodiments, openings 210 in rear panel 247 and/or data boxes 220 may be located every fifteen feet along the length of rear panel 247. According to some embodiments, openings 210 are located midway between top panel 243 and bottom panel 245.

Figure 18:
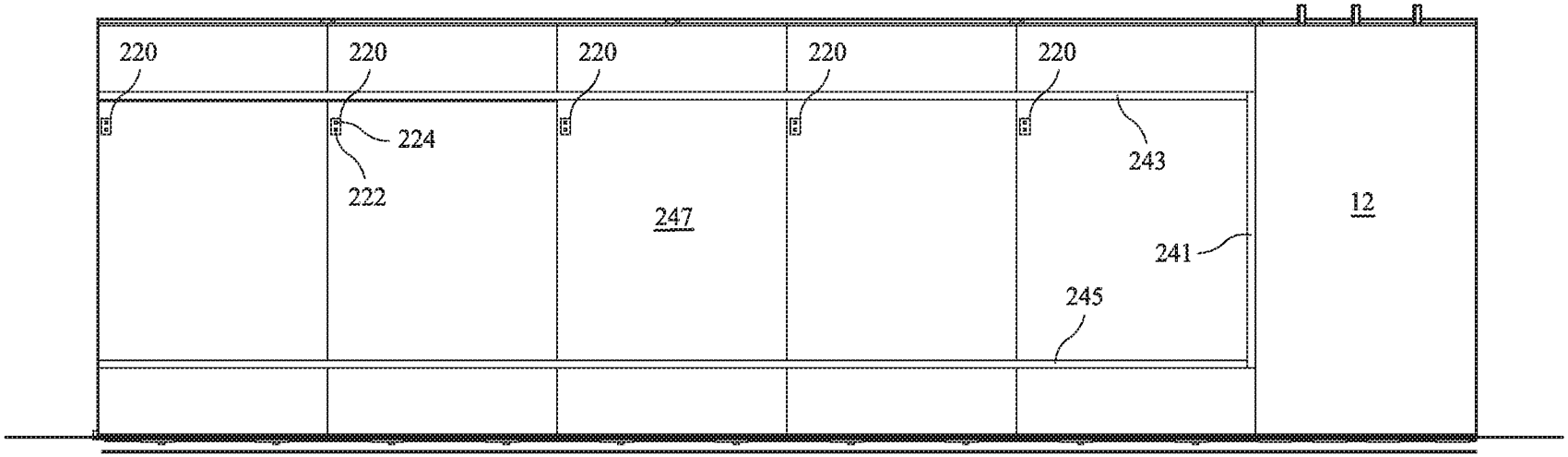
FIG. 18 is a front view of a side wall according to some embodiments.

In some embodiments, data boxes 220 are integrated into rear panel 247 as a wall panel, as shown, for example in FIG. 18. In some embodiments, data boxes 220 are located in an upper portion of rear panel 247. In some embodiments, data boxes 220 may be located every five feet along the length of rear panel 247 so they can be accessible to any modular display unit 300 mounted along display structure 200. In some embodiments, rear panel 247 is made of multiple pieces or panels, as in FIG. 18, and each panel comprises a data box 220. In some embodiments, data boxes 220 include a lighting port (e.g., lighting control port 222). In some embodiments, data boxes 220 include a data port (e.g., network control port 224). In some embodiments, data boxes 220 include a power port. In some embodiments, data boxes 220 include both a lighting port and a data port. In some embodiments, each data box 220 provides power, data, and/or controls for a single modular display unit 300.

In some embodiments, display structure 200 includes a track 230 disposed in inner surface 244 of top panel 243 and a track 230 in inner surface 246 of bottom panel 245. In some embodiments, tracks 230 interface with a portion of modular display units 300 to allow modular display units 300 to move within display structure 200. For example, modular display units 300 may slide or roll along the length of display structure 200, guided by tracks 230.

Figure 19:
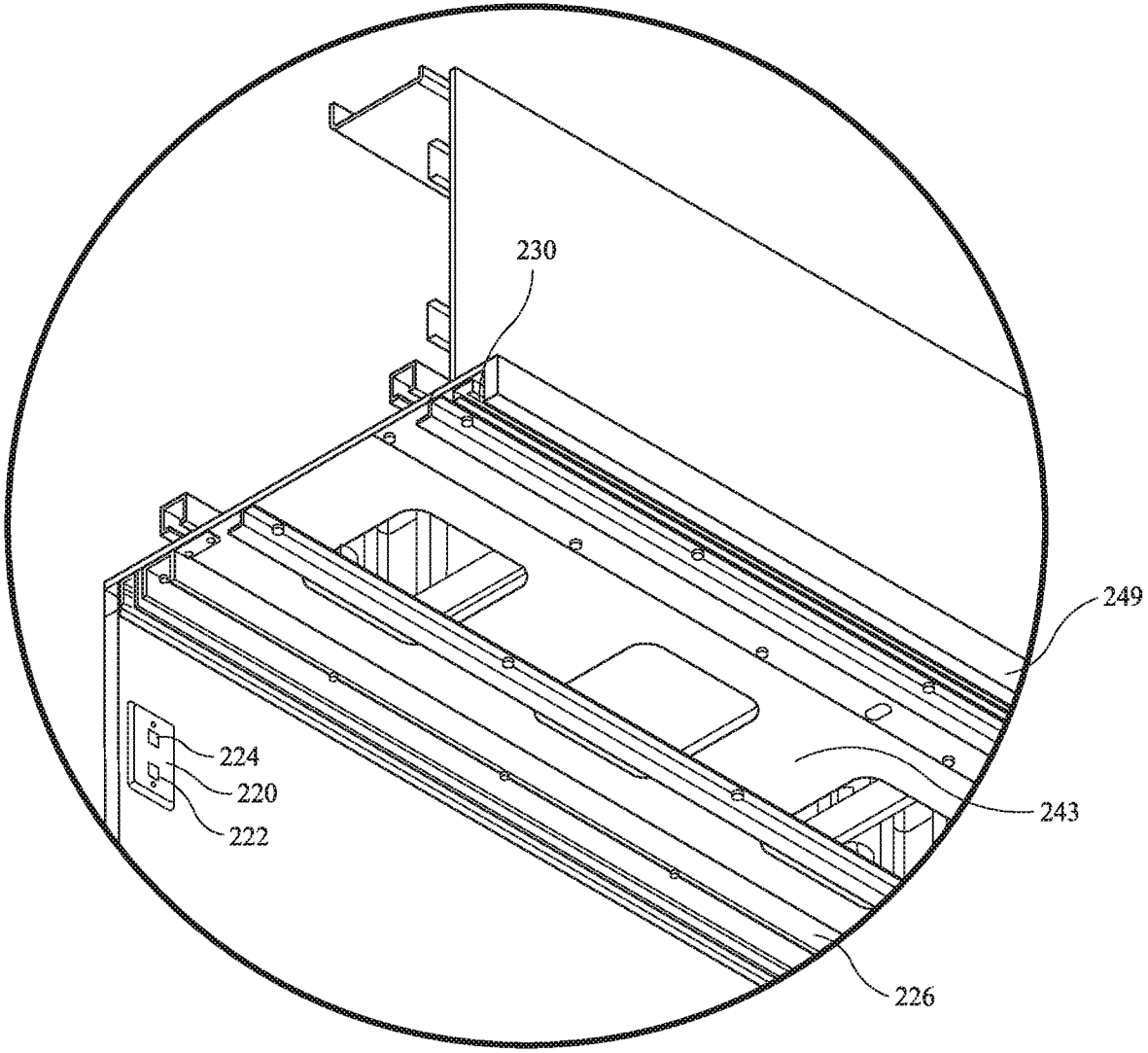
FIG. 19 is a close-up view of a top portion of a display structure in a side wall according to some embodiments.

FIG. 19 shows a close-up view of top panel 243. In some embodiments in side wall 12, as shown in FIG. 19, for example, top panel 243 may include a track 230 at a front portion thereof to help facilitate movement of modular display units 300 within display structure 200, as explained in more detail below. In some embodiments, track 230 may be disposed in a central portion or rear portion of top panel 243. According to some embodiments, top panel 243 may include a channel 226 at a rear portion thereof. In some embodiments, channel 226 may be a conduit for cables. For example, channel 226 may act as a power bus.

Figure 20:
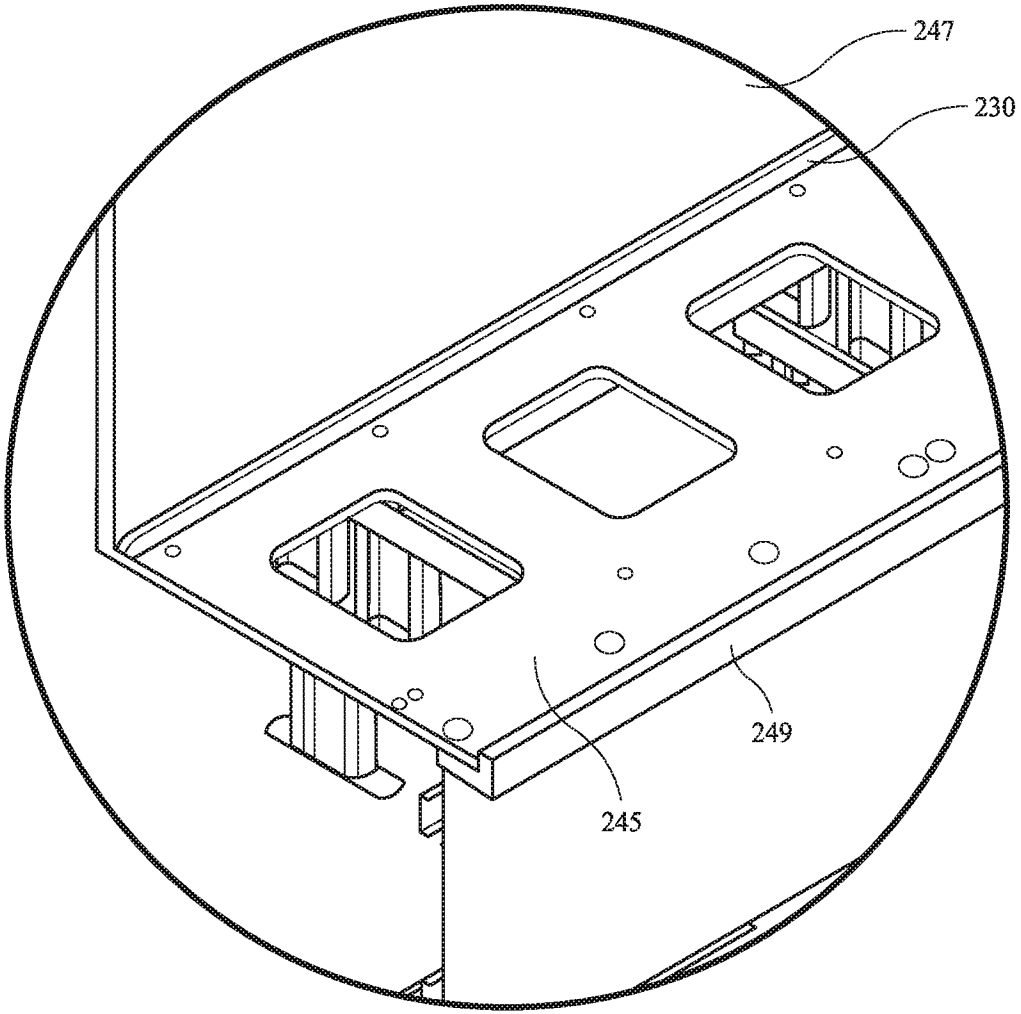
FIG. 20 is a close-up view of a bottom portion of a display structure in a side wall according to some embodiments.

FIG. 20 shows a close-up view of bottom panel 245 in side wall 12. In some embodiments, as shown in FIG. 20, for example, bottom panel 245 may include a track 230 at a rear portion thereof to help facilitate movement of modular display units 300 within display structure 200, as explained in more detail below. In some embodiments, track 230 may be disposed in a central or front portion of bottom panel 245. In some embodiments, multiple tracks 230 may be disposed in one or both of the top panel 243 and bottom panel 245.

In some embodiments, modular display units 300 are disposed within display structure 200 in display space 250. Modular display units 300, according to some embodiments, extend from bottom panel 245 to top panel 243. Because modular display units 300 are discrete units configured to be disposed within display structure 200, modular display units 300 are independent from display structure 200 and are independent of other modular display units 300. In some embodiments, modular display units 300 are mounted to rear panel 247 of display structure 200 by cleats. In some embodiments, modular display units 300 are mounted to rear panel 247 of display structure 200 by screws or other fasteners.

Figure 21:
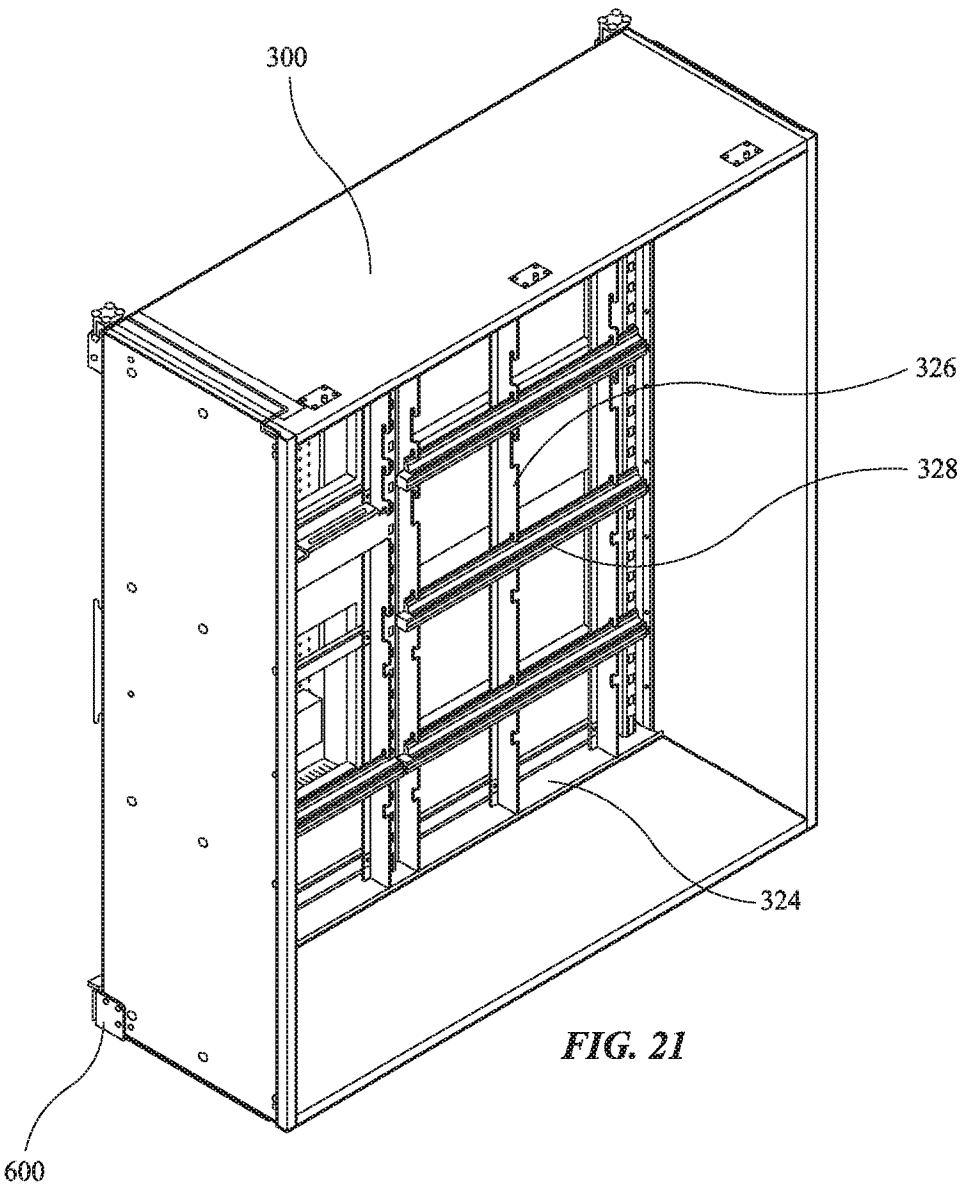
FIG. 21 shows a modular display unit according to some embodiments.
Figure 22:
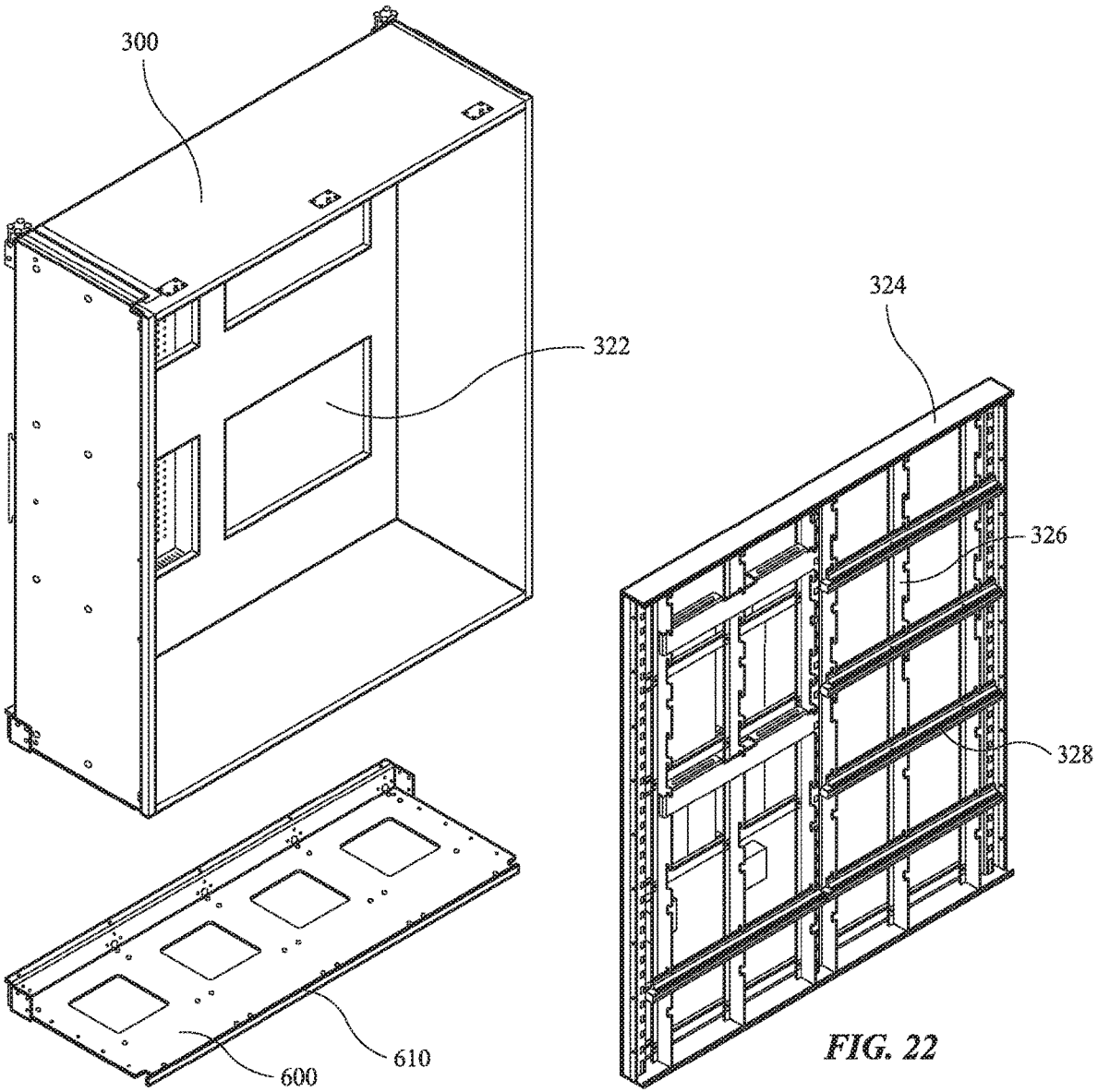
FIG. 22 is an exploded view of the modular display unit of FIG. 21 according to some embodiments.
Figure 23:
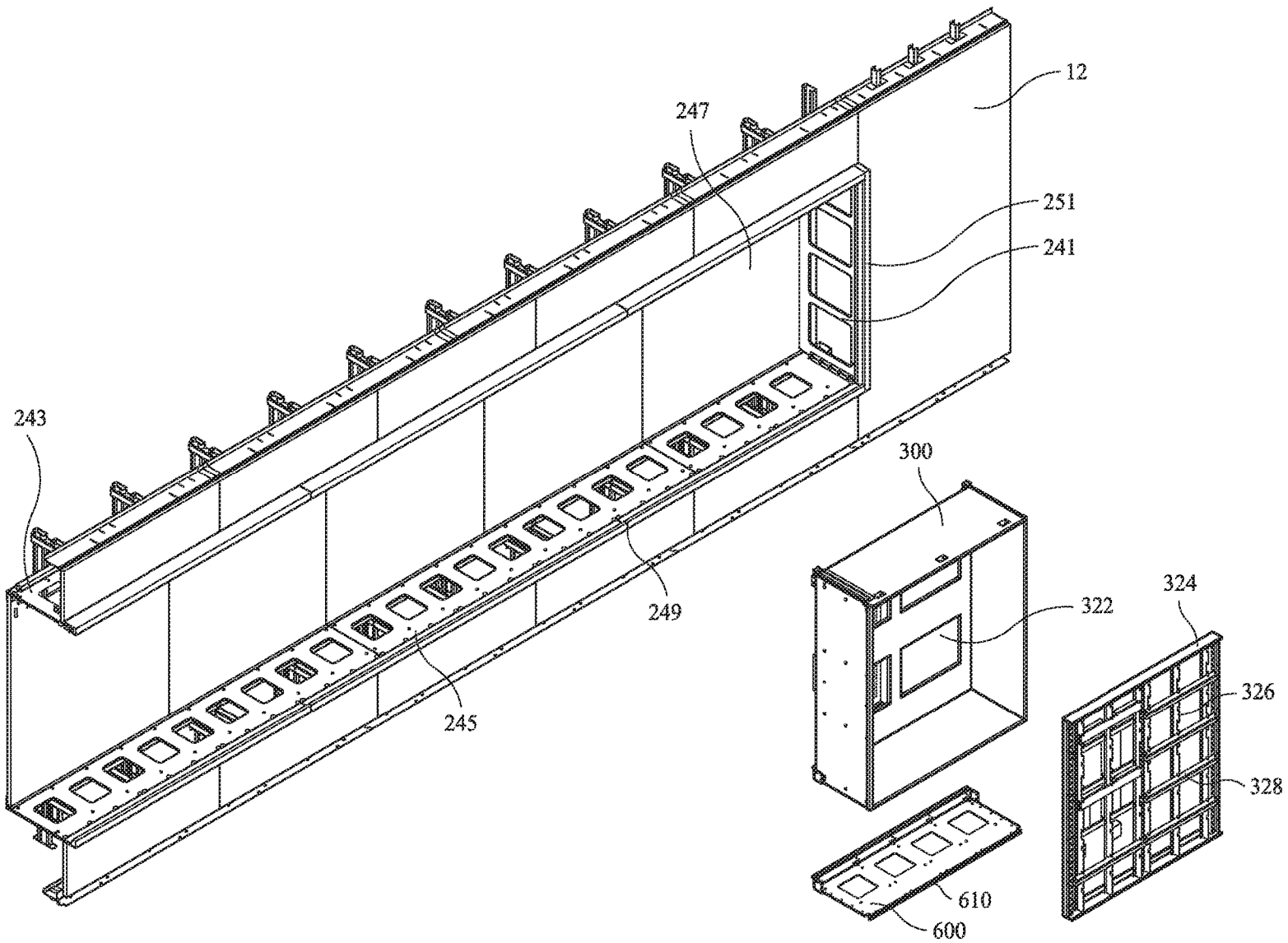
FIG. 23 is an exploded view of the modular display unit of FIG. 21 relative to a side wall according to some embodiments.
Figure 24:
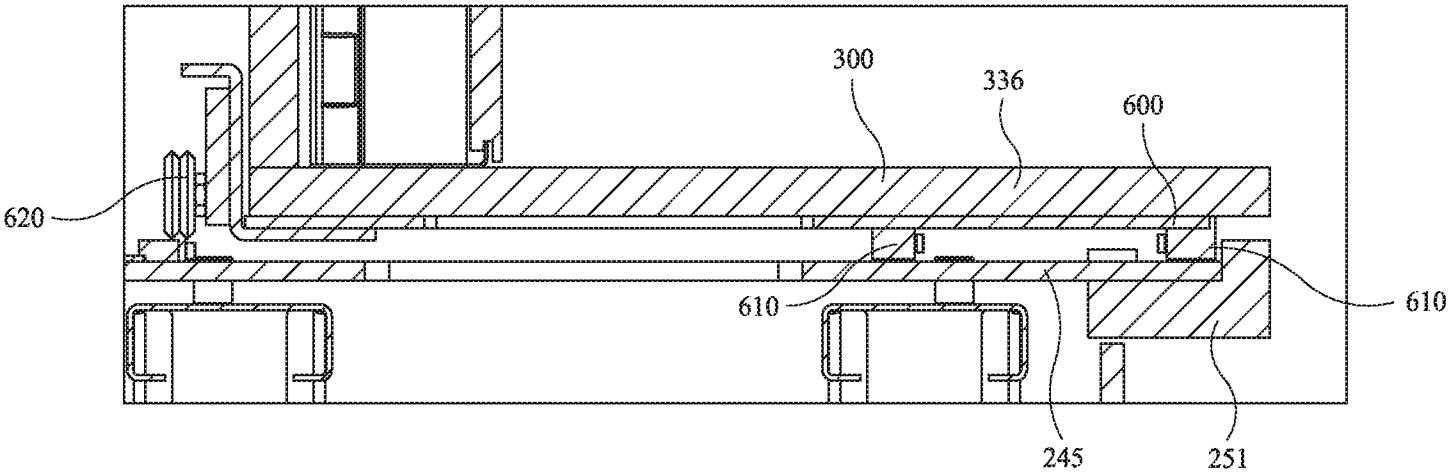
FIG. 24 is a close-up side cross-section view of a modular display unit in a display structure according to some embodiments.

In some embodiments, modular display units 300 are not mounted to rear panel 247. In some embodiments, as shown in FIGS. 21-24, for example, modular display units 300 are mounted on a tray 600 that interfaces with bottom panel 245. FIG. 21 shows a modular display unit 300 on tray 600. FIG. 22 shows an exploded view of modular display unit 300 on tray 600. FIG. 23 shows an exploded view of modular display unit 300 relative to side wall 12. FIG. 24 shows a close-up cross-section view of modular display unit 300 on tray 600, which is disposed on bottom panel 245. In some embodiments, modular display unit 300 rests on top of tray 600. In some embodiments, modular display unit 300 is securely attached to tray 600 with a fastener, such as a screw or bolt. In some embodiments, modular display unit 300 may attach to tray 600 in alternative ways, such as a sliding interlock that includes a projection on a top surface of tray 600 that is configured to slide into a groove on the bottom of modular display unit 300.

In some embodiments, tray 600 interfaces with bottom panel 245 such that tray 600 may slide or roll along the length of bottom panel 245. In some embodiments, tray 600 includes a roller bar 610. In some embodiments, roller bar 610 comprises a bar with a series of bearings or wheels disposed thereon that roll along track 230. Roller bar 610, in some embodiments, helps keep tray 600 positioned appropriately within display structure 200 on bottom panel 245 by abutting against trimming or nosing 251 and/or track 230. In some embodiments, roller bar 610 allows for modular display units 300 to move easily along the length of display structure 200 by its bearings or wheels rolling along track 230. In some embodiments, tray 600 includes a wheel 620 that interacts with track 230 on bottom panel 245. In some embodiments, tray 600 includes multiple wheels 620. In some embodiments, wheel 620 allows for modular display units 300 to move easily along the length of display structure 200 by rolling along track 230. In some embodiments, multiple trays 600 are disposed on bottom panel 245. In some embodiments, one or more trays 600 may be used to support and/or move each modular display unit 300.

In some embodiments, at least one of the modular display units 300 includes a roller system 350, as in FIGS. 26-29. According to some embodiments, modular display units include roller system 350 disposed on outer surface 333 of top wall 334 and on outer surface 335 of bottom wall 336. Roller system 350 interfaces with tracks 230 disposed in inner surface 244 of top panel 243 and in inner surface 246 of bottom panel 245 of display structure 200. In some embodiments, roller system 350 includes wheels that allow modular display units 300 to move (e.g., roll side-to-side) within display structure 200. Other mechanisms that facilitate sliding of modular display units 300 within display structure 200 may also be used. Some embodiments of modular display units 300 are fixed.

Figure 25:
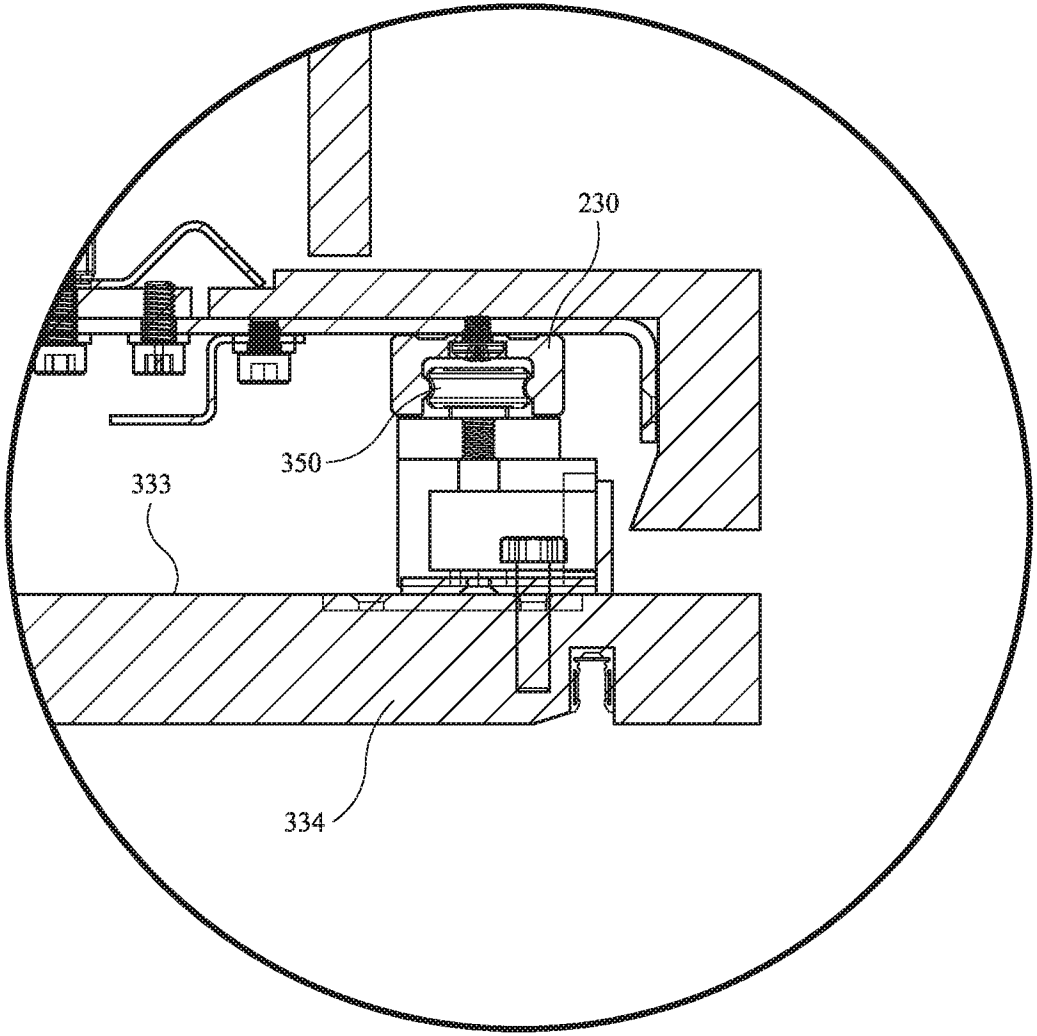
FIG. 25 is a close-up side cross-section view of a modular display unit in a display structure according to some embodiments.
Figure 26:
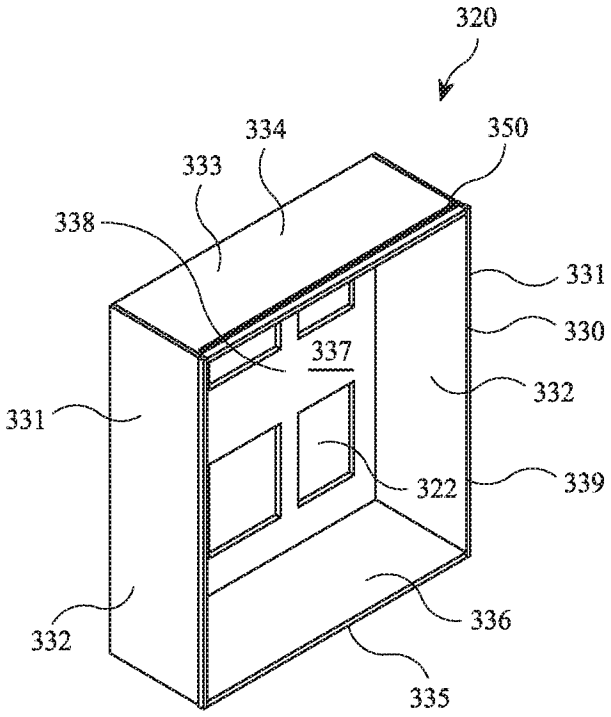
FIG. 26 shows a modular display unit according to some embodiments.
Figure 27:
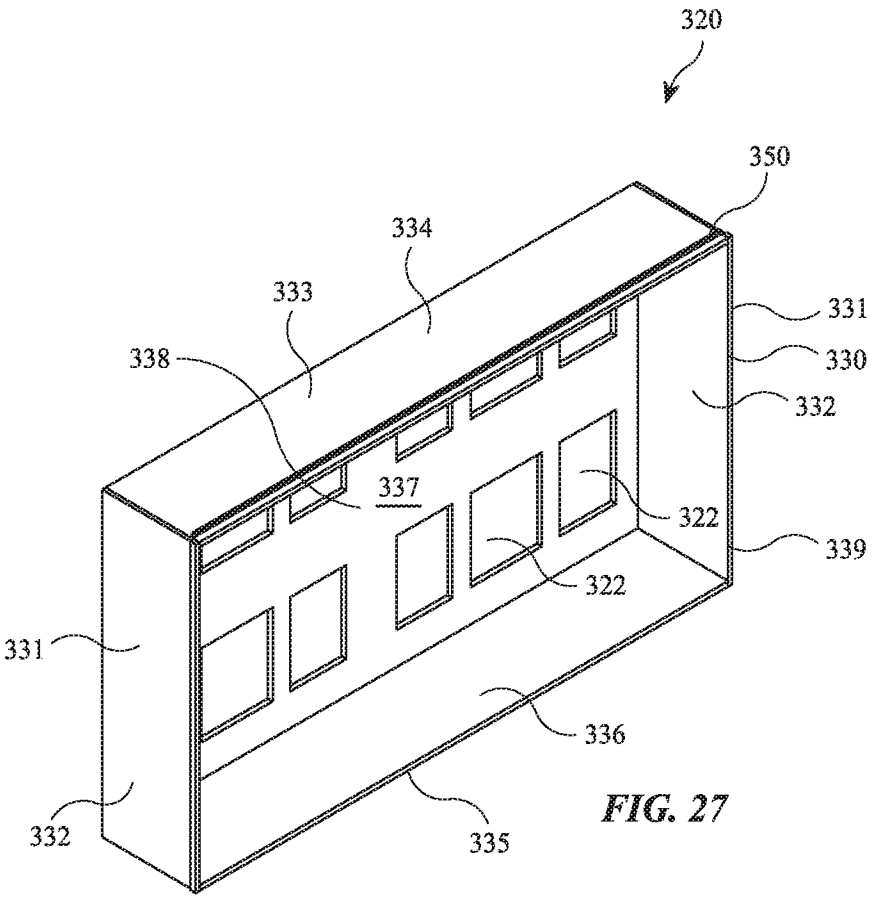
FIG. 27 shows a modular display unit according to some embodiments.
Figure 28:
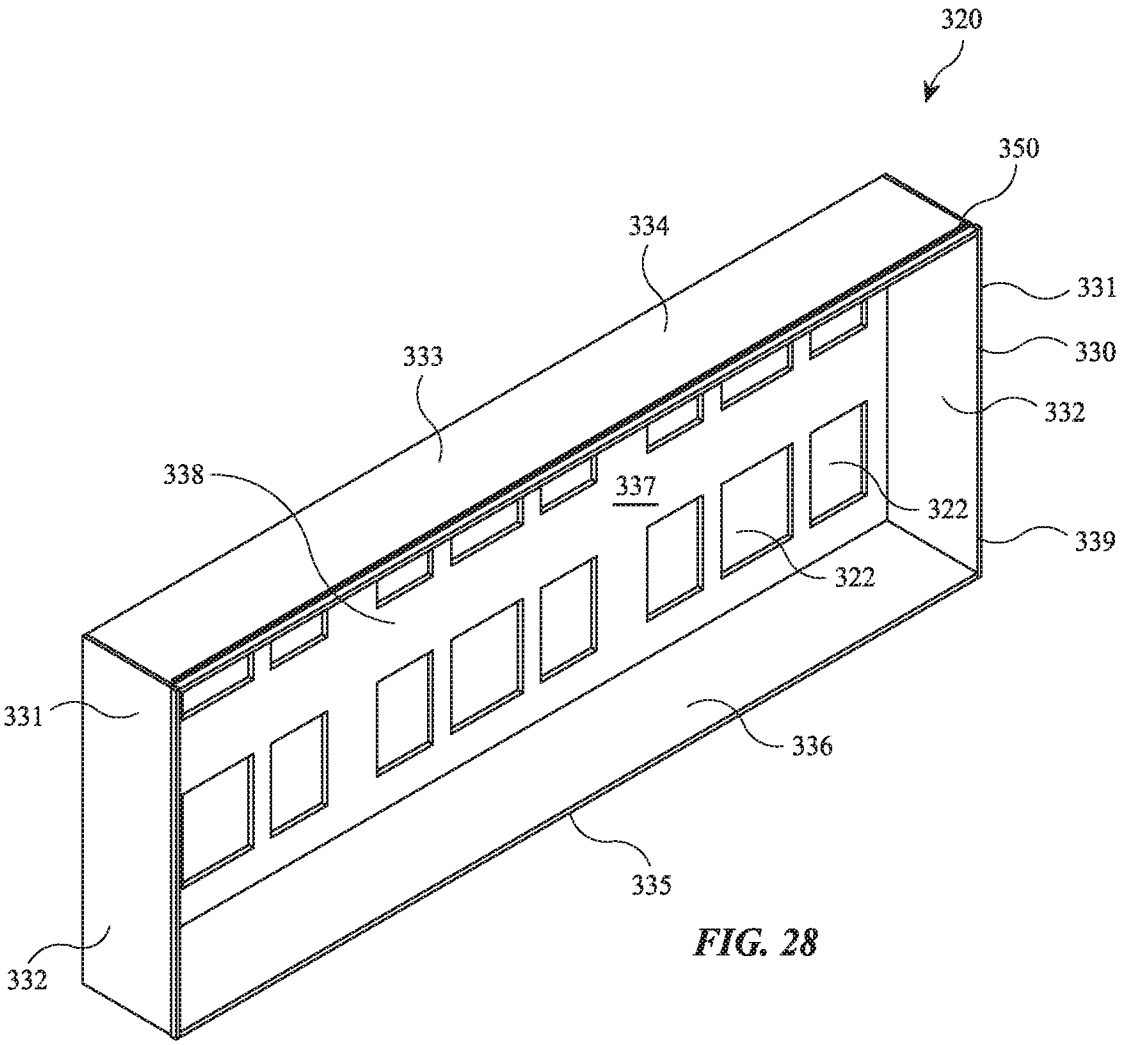
FIG. 28 shows a modular display unit according to some embodiments.
Figure 29:
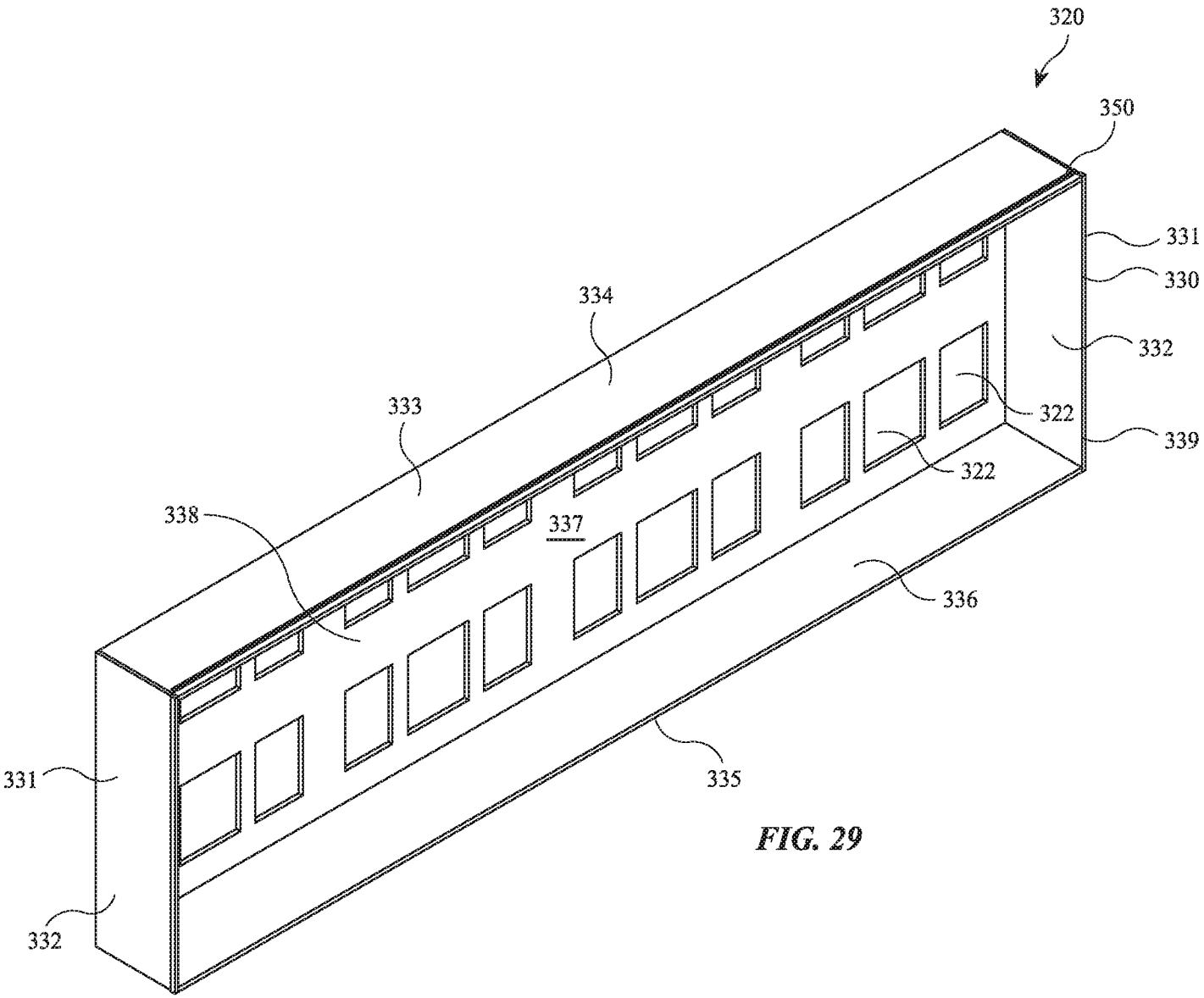
FIG. 29 shows a modular display unit according to some embodiments.

In some embodiments, modular display units 300 include roller system 350 only on outer surface 333 of top wall 334 and not on outer surface 335 of bottom wall 336. Instead of roller system 350 on bottom wall 336, bottom wall 336 may rest on tray 600, as shown in FIG. 24. In some embodiments, roller system 350 includes a horizontal wheel disposed with grooves that interface with tracks 230, as shown in FIG. 25, which is a close-up cross-section view of roller system 350 interfacing with tracks 230.

According to some embodiments, a plurality of modular display units 300 may be configured within display structure 200. Some embodiments include at least two modular display units 300. Other embodiments include at least five modular display units 300. Other embodiments include at least seven modular display units 300. Some embodiments include nine modular display units 300. In some embodiments, modular display units 300 are arranged side-by-side. According to some embodiments, each modular display unit 300 is not disposed above or below another modular display unit 300, so they form a linear row of modular display units 300 within display structure 200.

Modular display units 300 may be of a variety of sizes within the same display structure 200 of modular wall system 100. As noted above, modular display units 300 have a unit length configured in increments of n. For example, a modular display unit 300 may be five feet, ten feet, fifteen feet, or twenty feet in length, as shown in FIGS. 26-29. Display structure 200 may include one or more modular display units 300 with a length of five feet, one or more modular display units 300 with a length of ten feet, one or more modular display units 300 with a length of fifteen feet, and one or more modular display units 300 with a length of twenty feet. Other lengths may also be utilized in modular wall system 100.

There are also various types of modular display units 300 suitable for modular wall system 100, including open-face display units 320, closed-face display units 340 (e.g., glass-faced vitrines), graphic light box units 360, and living wall units 380.

Display units 300, as shown, for example, in FIGS. 26-29, may contain, for example, display elements 400 that showcase products for sale 500 (FIGS. 39-45). Open-face display units 320 are open to a front exterior of display structure 200, allowing customers in retail environment 10 to access a product if there is interest. In some embodiments, display units (including open-face display units 320, closed-face display units 340, graphic light box units 360, and living wall units 380) include lighting to highlight various products or other elements therein. The lighting may be integrated into each display unit 300.

In some embodiments, open-face display units 320 include a frame 330. Frame 330 includes two side walls 332 having outer surfaces 331, a top wall 334 having an outer surface 333, and a bottom wall 336 having an outer surface 335. According to some embodiments, frame 330 further includes a rear wall 338 having an inner surface 337. Rear wall 338 may include one or more openings 322. Openings 322 facilitate providing power and data to display elements 400 within open-face display units 320. In addition, openings 322 reduce the weight of open-face display units 320 and the overall weight of modular wall system 100. A front surface 339 of frame 330 may be aligned with front surface 249 of frame 240, and both may protrude outward from a front surface of wall 12.

Figure 30:
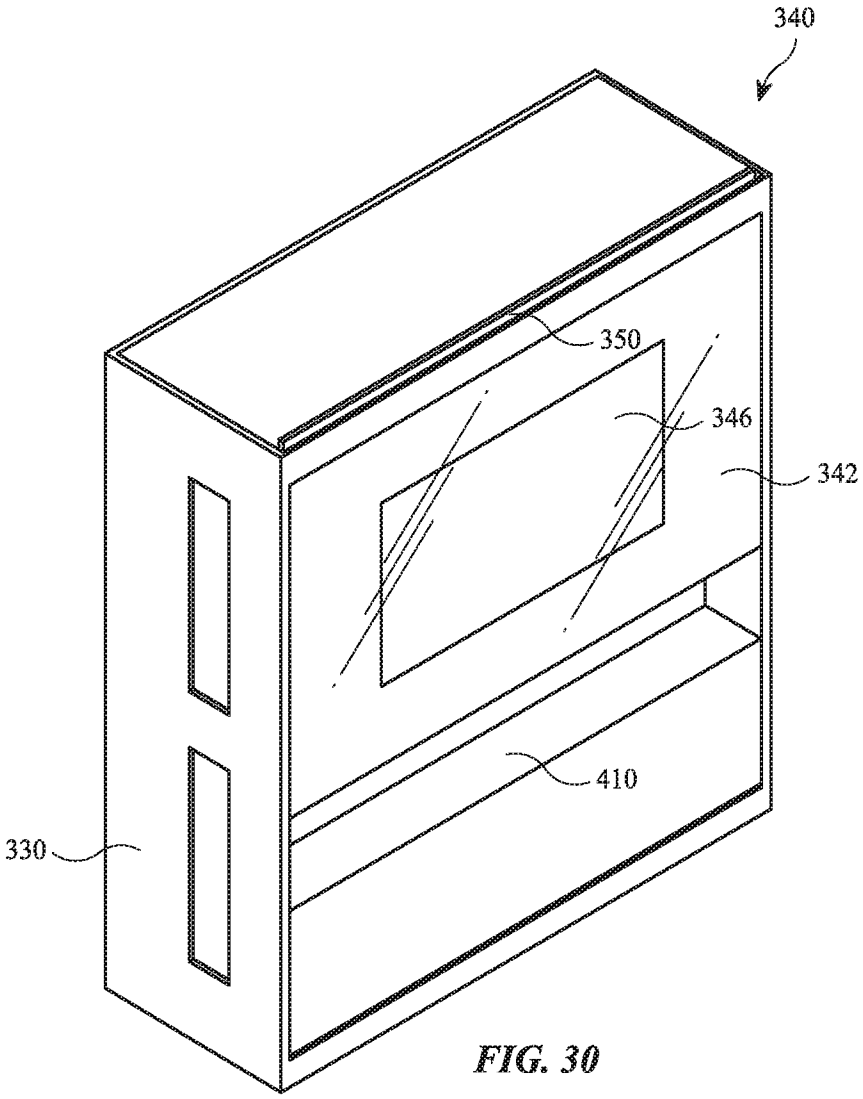
FIG. 30 shows a modular display unit according to some embodiments.
Figure 31:
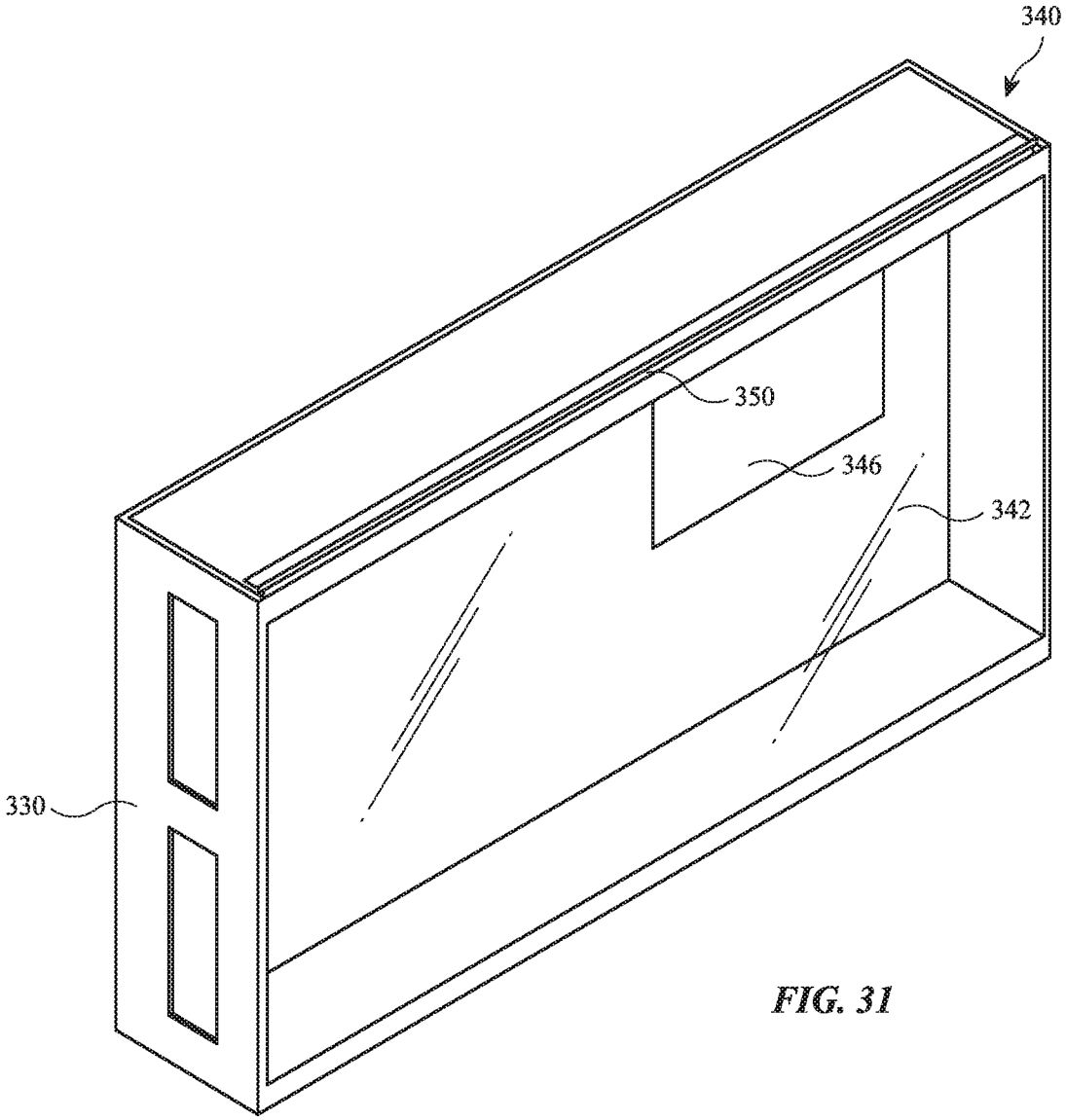
FIG. 31 shows a modular display unit according to some embodiments.

Display units 300, as shown, for example, in FIGS. 30-31, may contain, for example, display elements 400 that present marketing material. For example, closed-face display units 340 may provide an interactive experience in which a customer learns more details about how a certain product is made. According to some embodiments, the product itself and raw materials or other elements used to make the product may be located on one or more shelves 410 enclosed within closed-face display unit 340. According to some embodiments, a video describing a process for how the product is made is shown on one or more display screens 346 (e.g., video screens) enclosed within closed-face display unit 340. Closed-face display units 340 may also be used to display other information, such as, for example, information about a company selling the products.

In some embodiments, closed-face display units 340 have similar features as open-face display units 320. For example, closed-face display units 340 may include frame 330 and/or openings 322. According to some embodiments, closed-face display units 340 are not open to a front exterior of display structure 200. For example, in some embodiments, closed-face display units 340 have a transparent front cover 342. In some embodiments, transparent front cover 342 is glass. In some embodiments, transparent front cover 342 is plastic. According to some embodiments, transparent front cover 342 is configured to open to provide access for a retailer. For example, transparent front cover 342 may swing open. In other embodiments, transparent front cover 342 may slide open. Transparent front cover 342 may open manually or automatically. In some embodiments, the unlocking or opening of transparent front cover 342 may be controlled by an application, for example, running on a smartphone or other electronic device.

Figure 32:
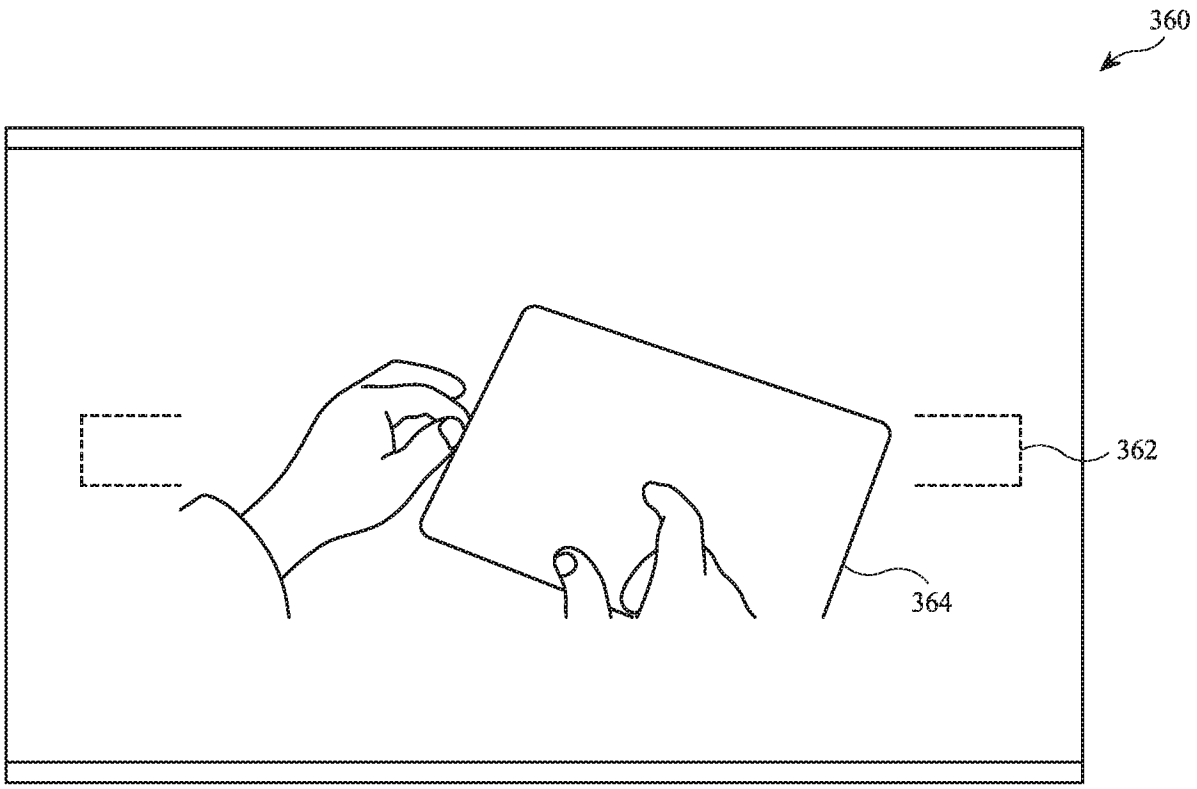
FIG. 32 shows a modular display unit according to some embodiments.

Graphic light box units 360, shown, for example, in FIG. 32, may be used for display elements 400 that include, for example, marketing material or other graphics. According to some embodiments, graphic light box units 360 include a light source 362. Graphic light box units 360 are configured to receive graphic displays 364, which may be, for example, fabric with graphics disposed thereon, for example, by printing (e.g., screen printing). Light source 362 is disposed behind graphic fabric display 364 to illuminate the display 364. Graphic fabric displays 364 may provide marketing material. For example, graphic fabric display 364 may be associated with a particular marketing campaign. In some embodiments, graphic light box units 360 do not include a visible frame. In some embodiments, graphic light box units 360 are expandable and retractable (in a length direction along display structure 200). In this way, one or more graphic light box units 360 can be used to take up space not occupied by other modular display units 300, so that there is no empty space between modular display units 300 within display structure 200.

Figure 33:
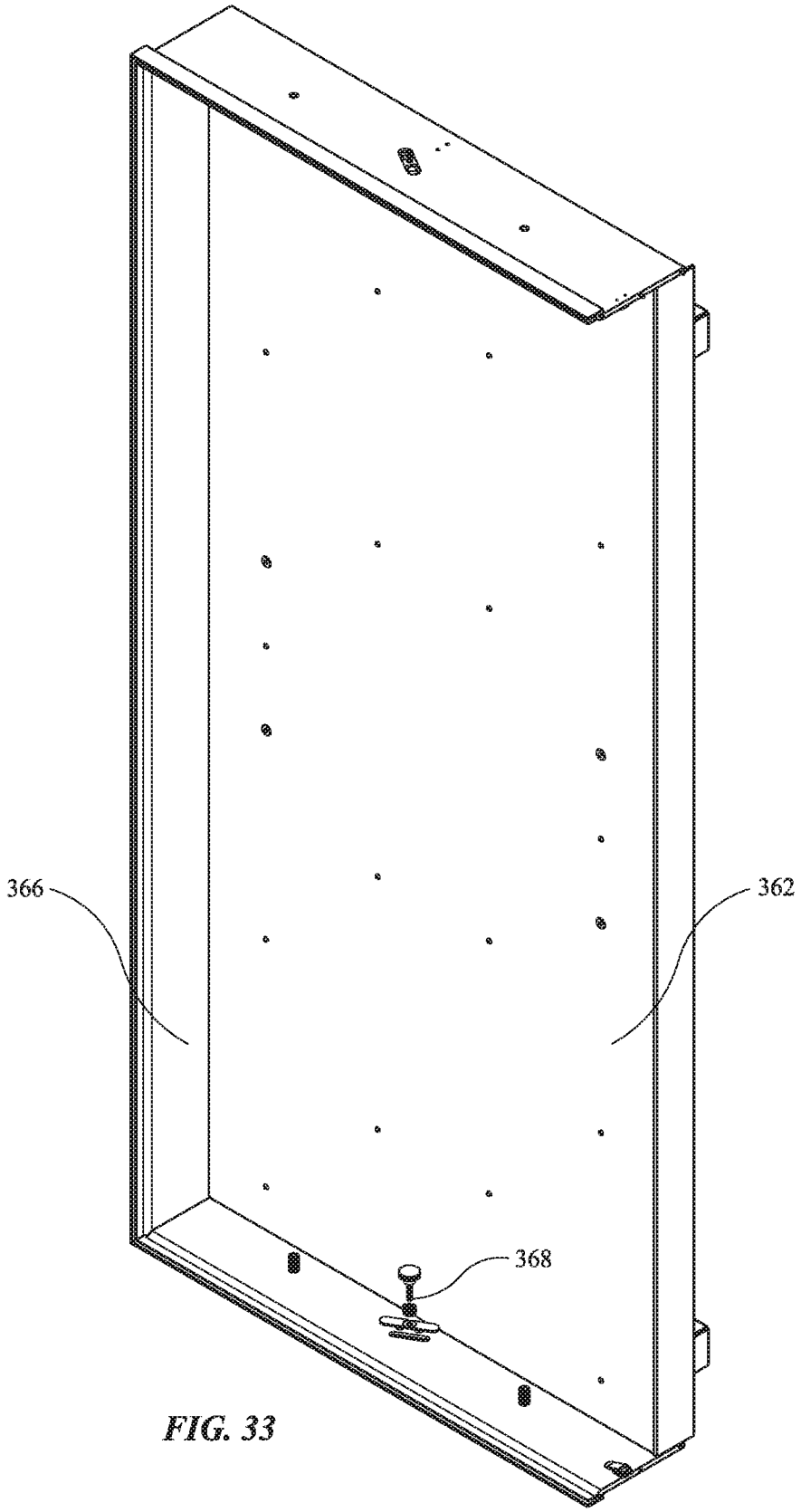
FIG. 33 shows a portion of a modular display unit according to some embodiments.

In some embodiments, graphic fabric display 364 of graphic light box unit 360 is attached to and disposed over a frame 366, such as is shown in FIG. 33. In some embodiments, frame 366 is made of multiple pieces. For example, as shown in FIG. 33, a piece of frame 366 may include a left edge of frame 366. Other pieces may include a right edge of frame 366, while yet other pieces may only include a top edge and a bottom edge of frame 366. In some embodiments, a piece of frame 366 may have a length of 1, 2.5, or 5 feet. Any number of pieces may be combined to create graphic light box unit 360. Light source 362 may be disposed within frame 366. In some embodiments, light source 362 is an LED board (e.g., an array of LED lights arranged in a pattern in at least two dimensions).

Figure 34:
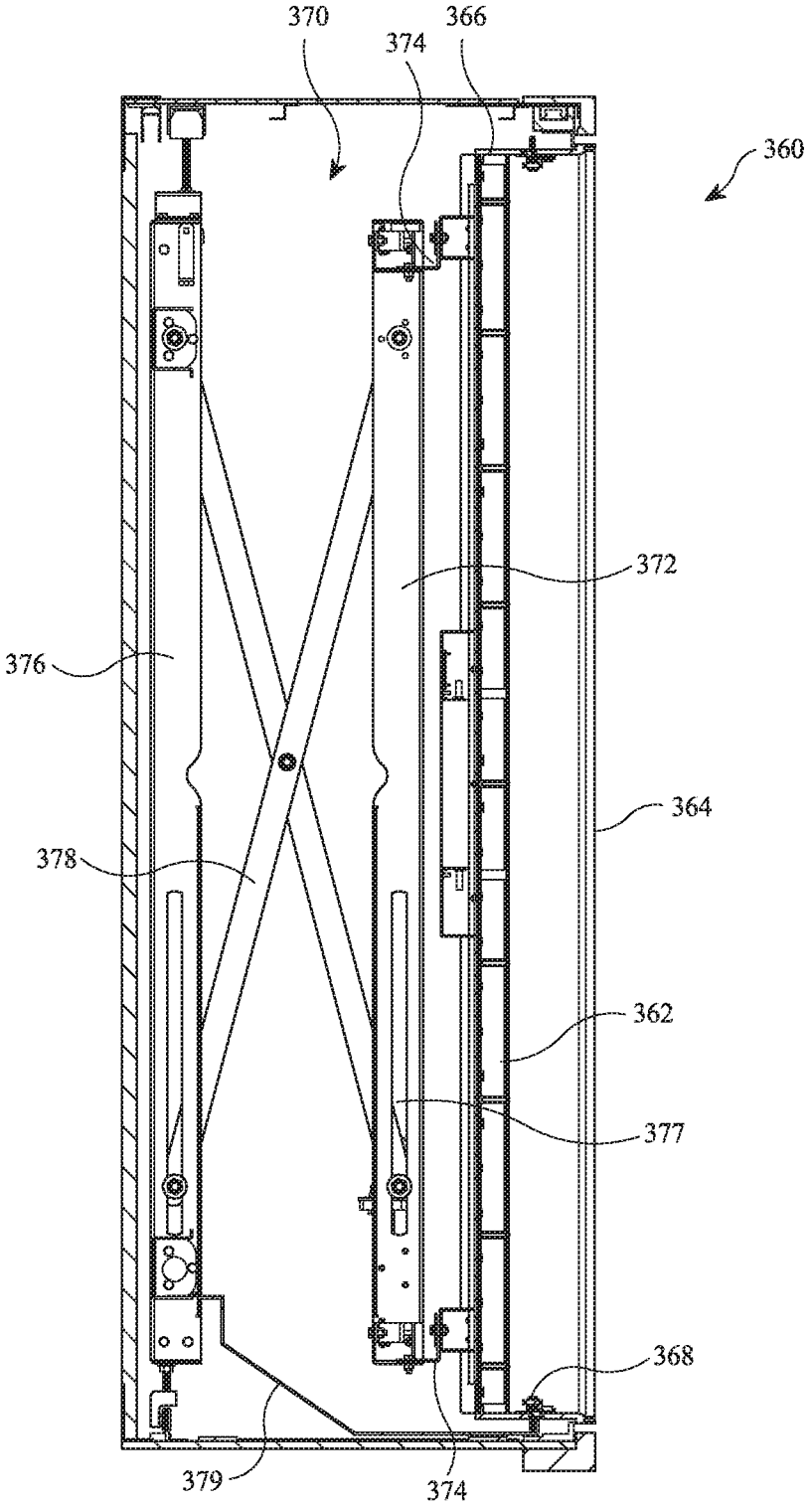
FIG. 34 shows a side cross-section view of a modular display unit according to some embodiments.
Figure 35:
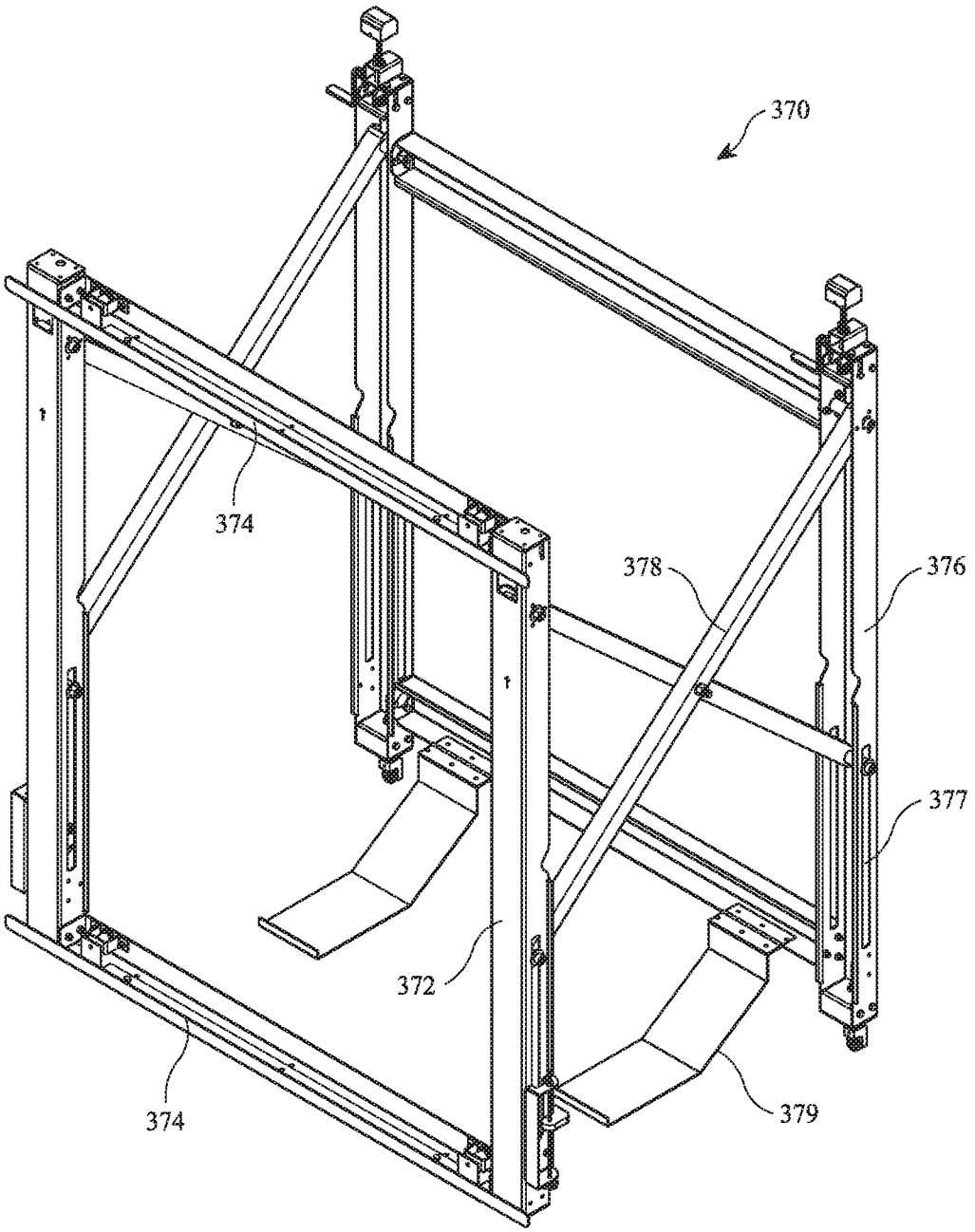
FIG. 35 shows a portion of a modular display unit according to some embodiments.
Figure 36:
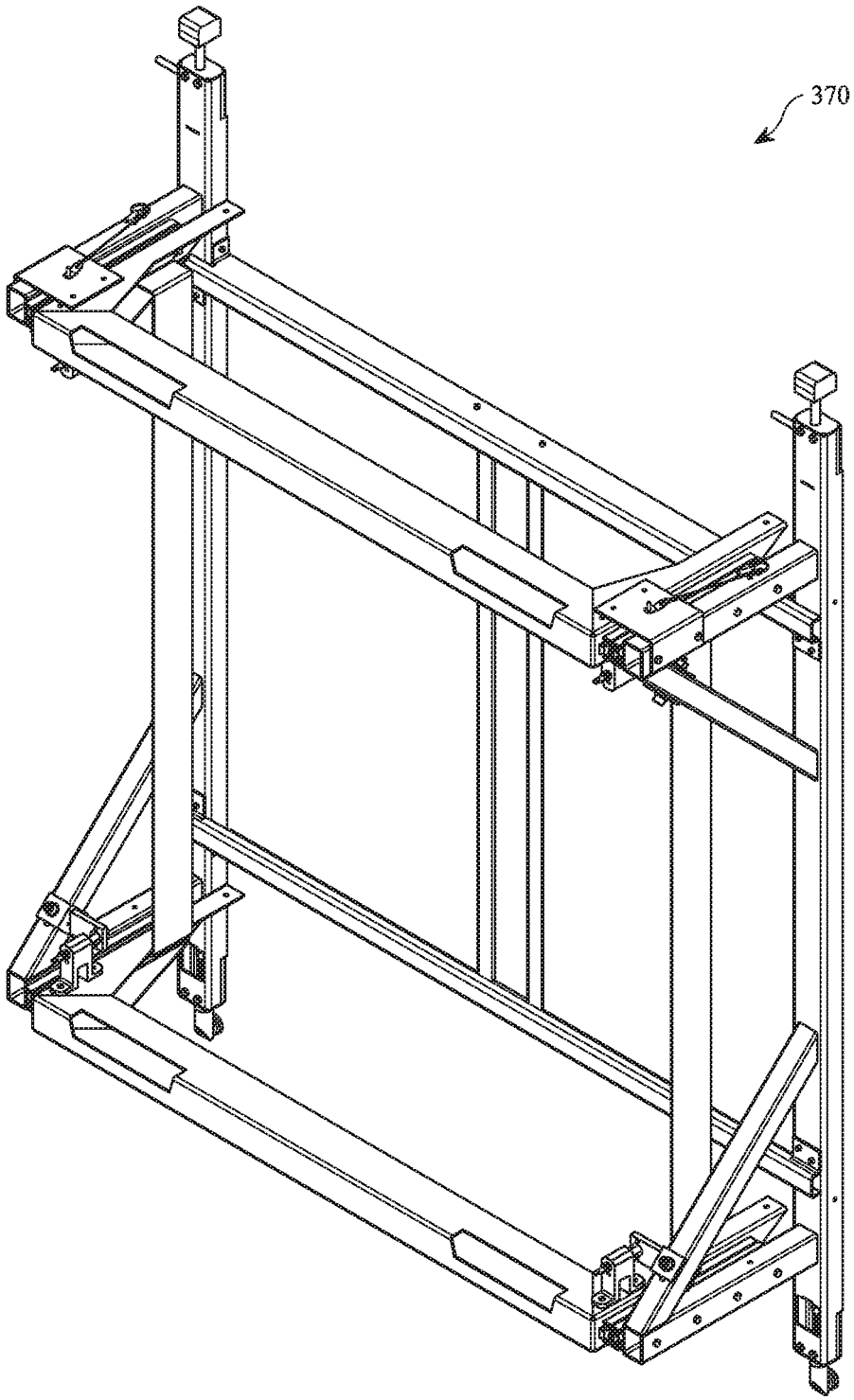
FIG. 36 shows a portion of a modular display unit according to some embodiments.

According to some embodiments, as shown in FIGS. 34-36, for example, graphic light box units 360 may include a carriage 370. FIG. 34 shows a side-cross-sectional view of display structure 200 taken so that rear portions of graphic light box unit 360, including its carriage 370, is visible as installed. FIG. 35 shows carriage 370 in isolation. FIG. 36 shows an alternative carriage 370. In some embodiments, carriage 370 supports graphic light box unit 360 within display structure 200. In some embodiments, carriage 370 supports graphic light box unit 360 through attachment to frame 366. For example, carriage 370 may have an outer structure 372 and an inner structure 376. Frame 366 of graphic light box unit 360 may attach to outer structure 372. In some embodiments, graphic light box unit 360 attaches to outer structure via cleats into a mounting portion 374. In some embodiments, inner structure 376 is disposed at a rear portion of display structure 200. In some embodiments, inner structure 376 comprises wheels to allow carriage 370 to move along the length of display structure 200.

In some embodiments, as shown in FIGS. 34 and 35, the depth of carriage 370 is adjustable. In some embodiments, the adjustability facilitates attachment of the graphic light box unit 360 to carriage 370 in an open position. In some embodiments, carriage 370 in the open position has a depth that is greater than the depth of display structure 200. In some embodiments, carriage 370 is in a closed position for presentation. In some embodiments, carriage 370 in the closed position has a depth that is less than the depth of display structure 200 so that an outer front surface of graphic light box unit 360 is aligned with an outer edge of frame 240 (e.g., front surface 249). In some embodiments, carriage 370 includes crossbars 378. According to some embodiments, crossbars 378 may facilitate the adjustability of carriage 370. For example, in some embodiments, the lower end of crossbars 378 may slide within slot 377 to adjust the depth of carriage 370 in the manner of a scissor mechanism. In some embodiments, carriage 370 includes one or more lock clasps 379. For example, as shown in FIG. 35, carriage 370 may include two lock clasps 379. In some embodiments, lock clasps 379 may hold carriage 370 in a certain position. For example, as shown in FIG. 34, lock clasp 379 may hold carriage 370 in a closed position by interfacing with a fastener 368. In some embodiments, as shown in FIG. 36, carriage 370 may not be adjustable in depth.

Figure 37:
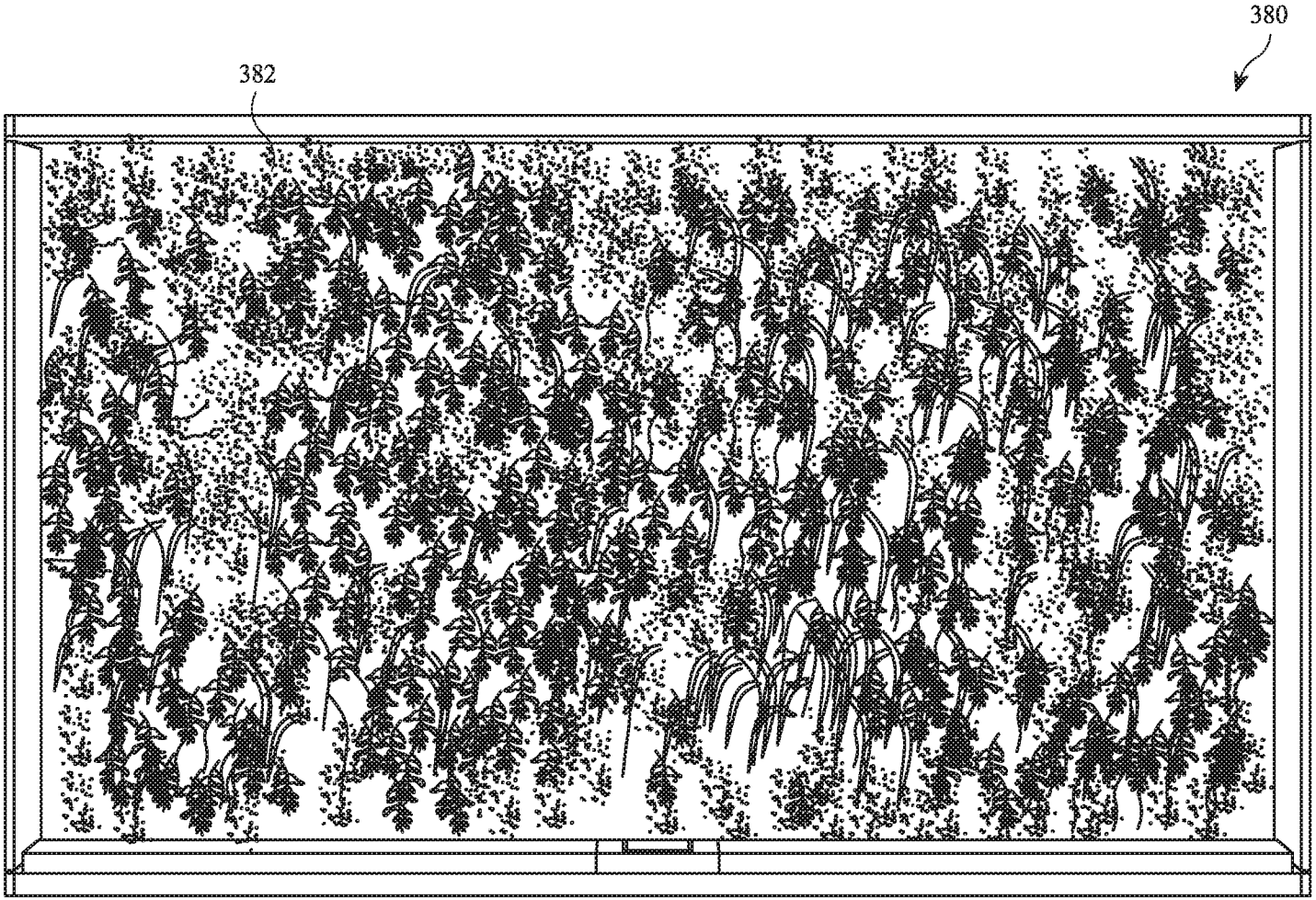
FIG. 37 shows a modular display unit according to some embodiments.
Figure 38:
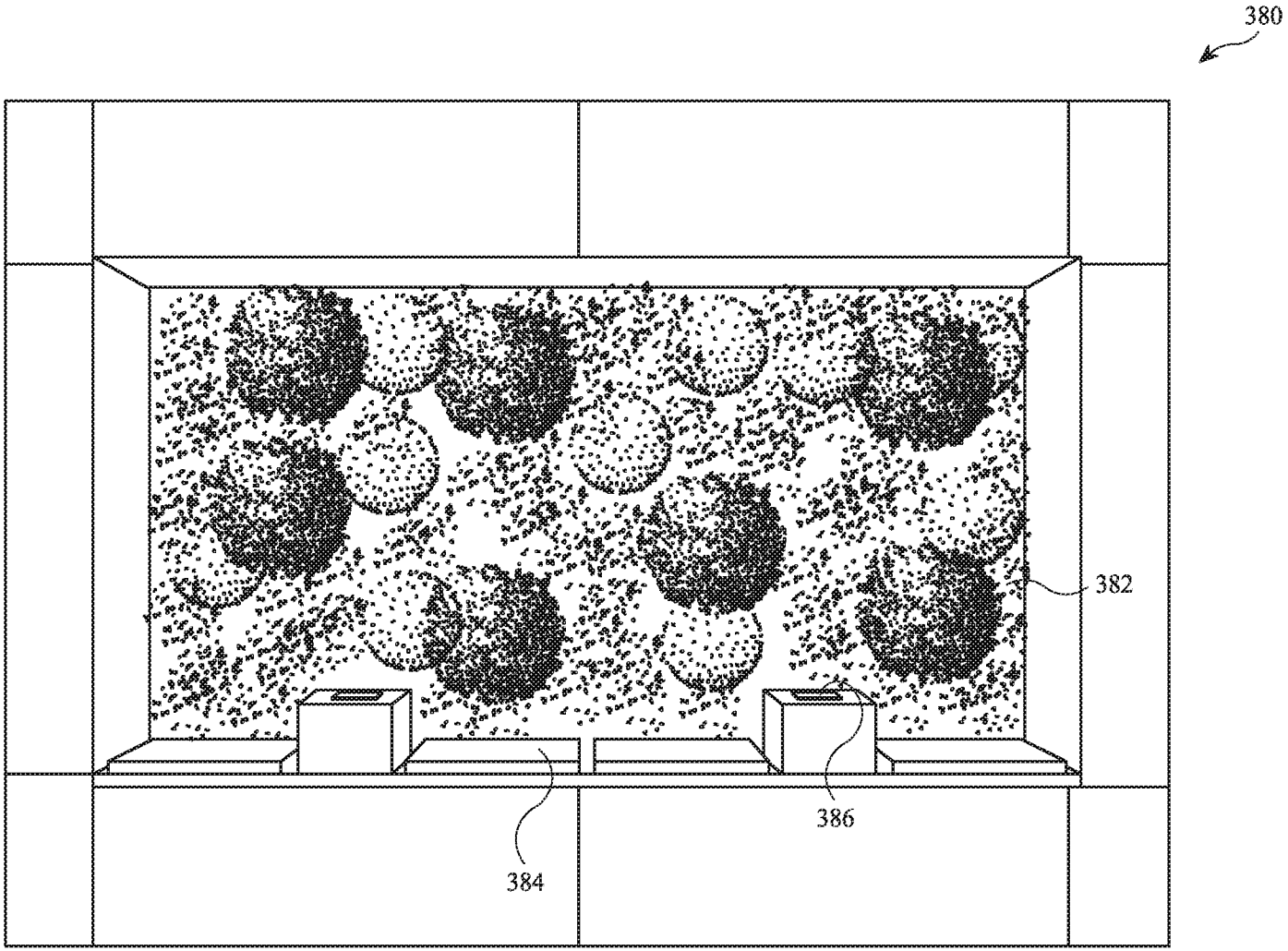
FIG. 38 shows a modular display unit according to some embodiments.

Living wall units 380, shown in FIGS. 37-38, may be planter modules used for display elements 400 that provide an area of natural feel, including elements of nature, such as living plants 382. Such living wall units 380 can provide an area of respite for customers. Living wall units 380 may include one or more living plants 382 disposed within them. In some embodiments, living plants 382 are disposed over the entirety of rear wall 338 of living wall unit 380. In some embodiments, plants 382 are artificial, nonliving plants. According to some embodiments, living wall units 380 provide a bench 384 or other type of sitting area. In some embodiments, living wall units 380 provide a table. In some embodiments, living wall units 380 provide a charging station 386 for customers' electronic devices. In some embodiments, living wall units 380 are expandable and retractable.

According to some embodiments, living wall units 380 receive each living plant 382 within an individual pocket. In some embodiments, living wall units 380 may include a reservoir of water and a drip system. Thus, living wall units 380 may automatically provide water to living plants 382. Some examples of display elements 400 have already been given above. Display elements 400 may include structure used to provide a particular environment or informational display, or to display or showcase marketing material or products for sale 500. For example, display elements 400 may include shelves 410, product stands 420, display cases 430, racks, hooks, display stands or mounts 440, 460, baskets, lights 450, seats or display screens, plants, or décor, and may be reconfigurable within display units 300. Display elements 400 may include graphic fabric displays 364, display screens 346, object displays, and so on. Example display elements are illustrated in FIGS. 39-45. In some embodiments, display element 400 is integral with modular display unit 300. According to some embodiments, display element 400 is not integral with modular display unit 300 and thus, display element 400 may be reconfigured within modular display unit 300.

Figure 39:
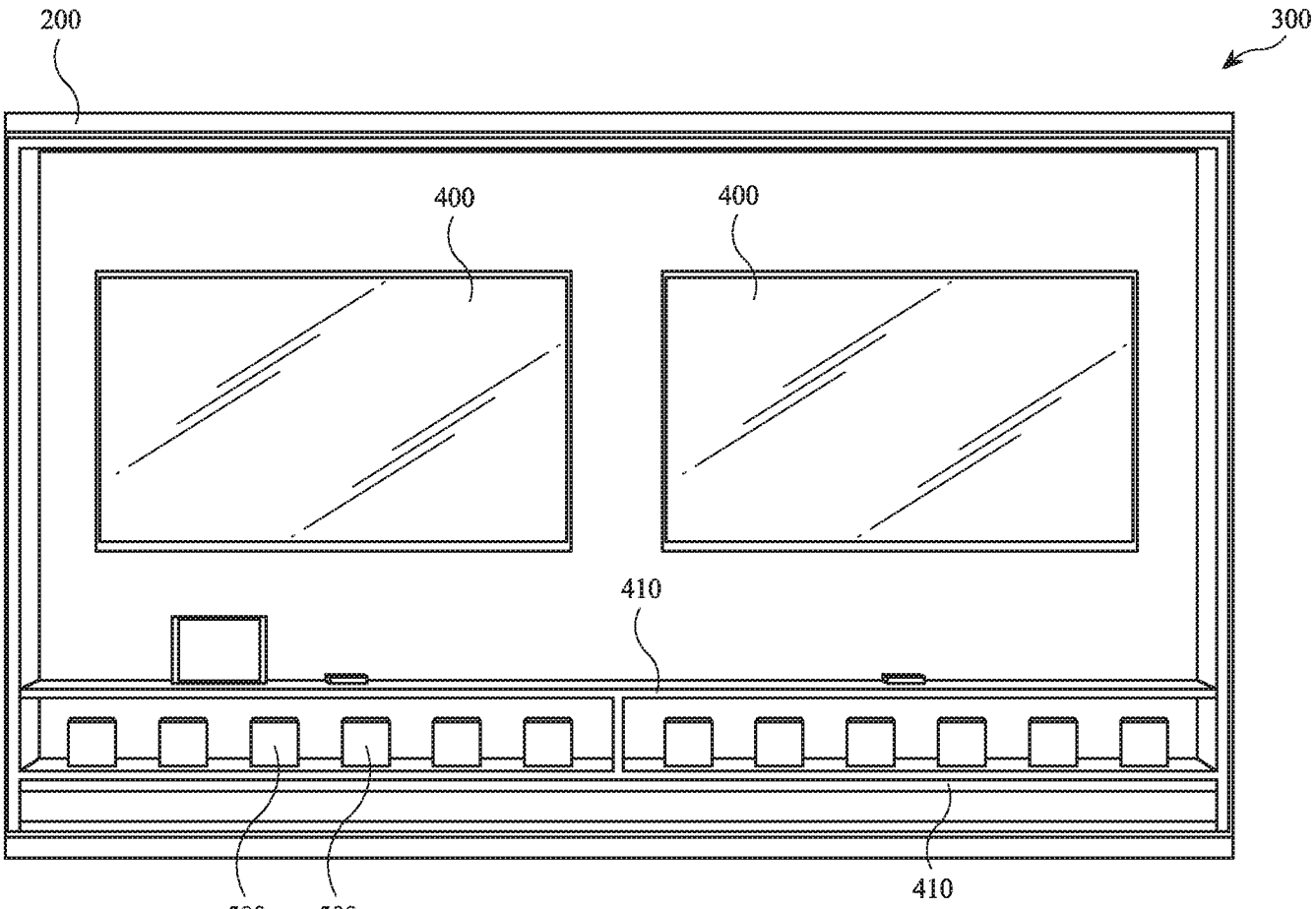
FIG. 39 shows a modular display unit with display elements according to some embodiments.
Figure 40:
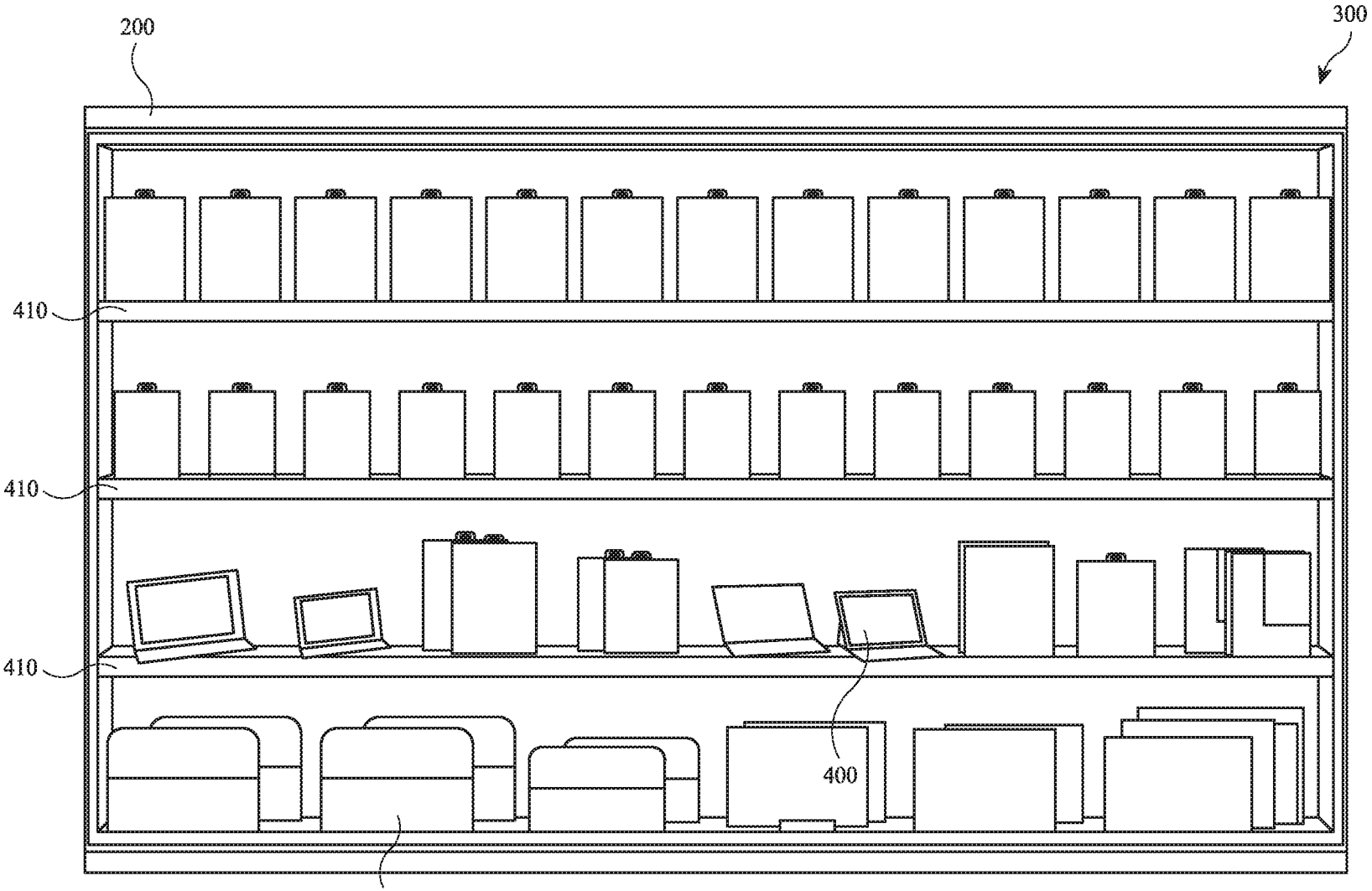
FIG. 40 shows a modular display unit with display elements according to some embodiments.
Figure 41:
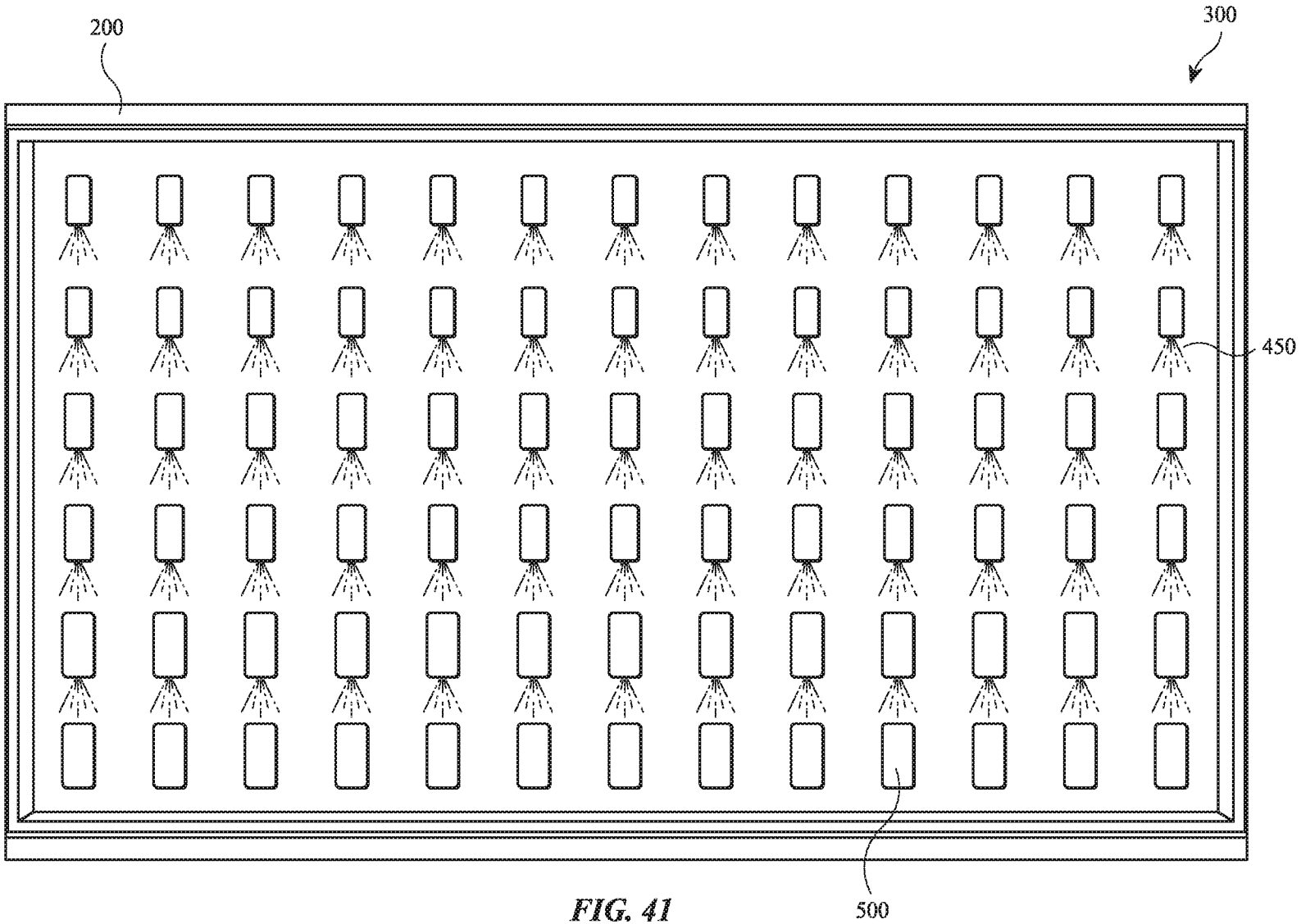
FIG. 41 shows a modular display unit with display elements according to some embodiments.
Figure 42:
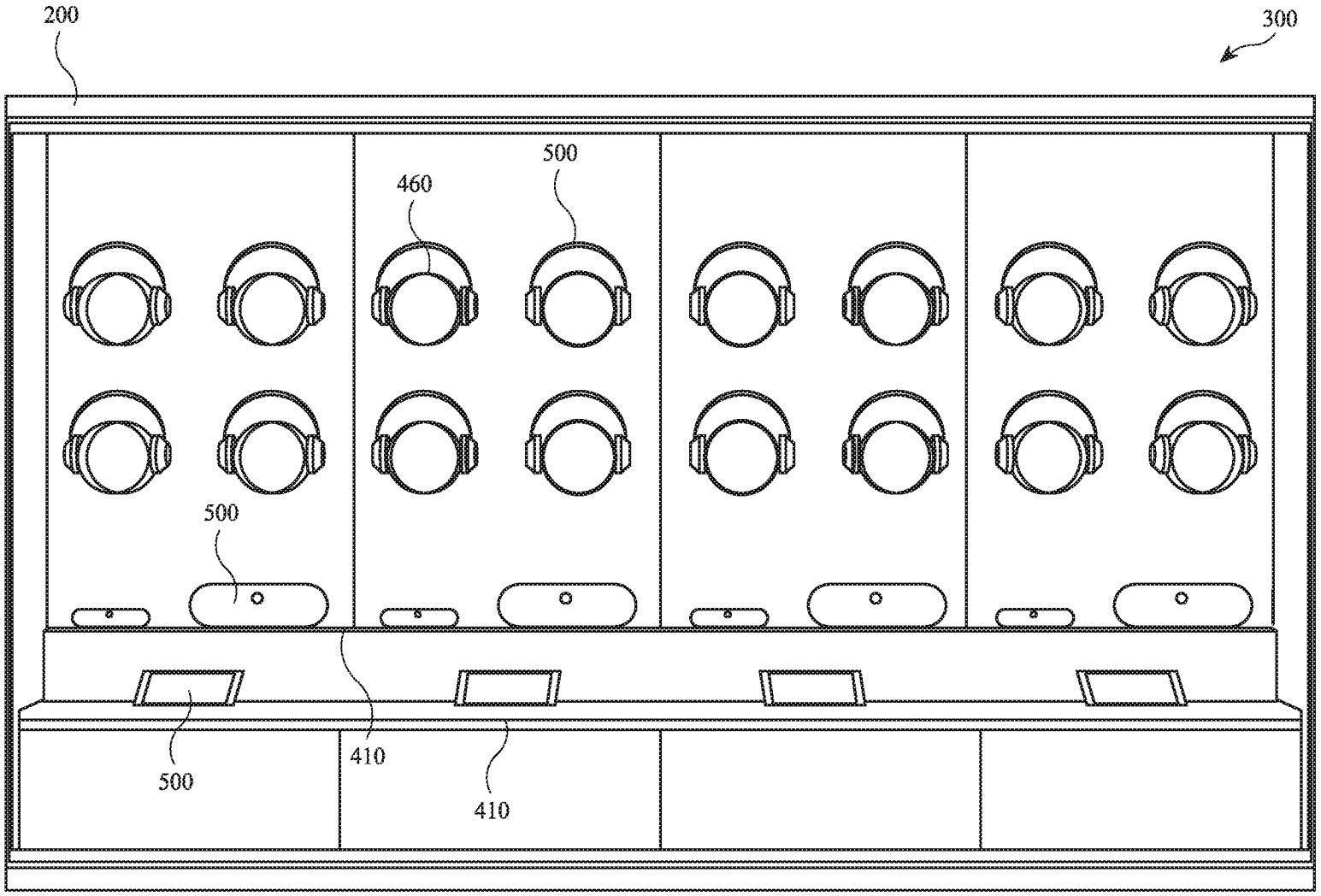
FIG. 42 shows a modular display unit with display elements according to some embodiments.
Figure 43:
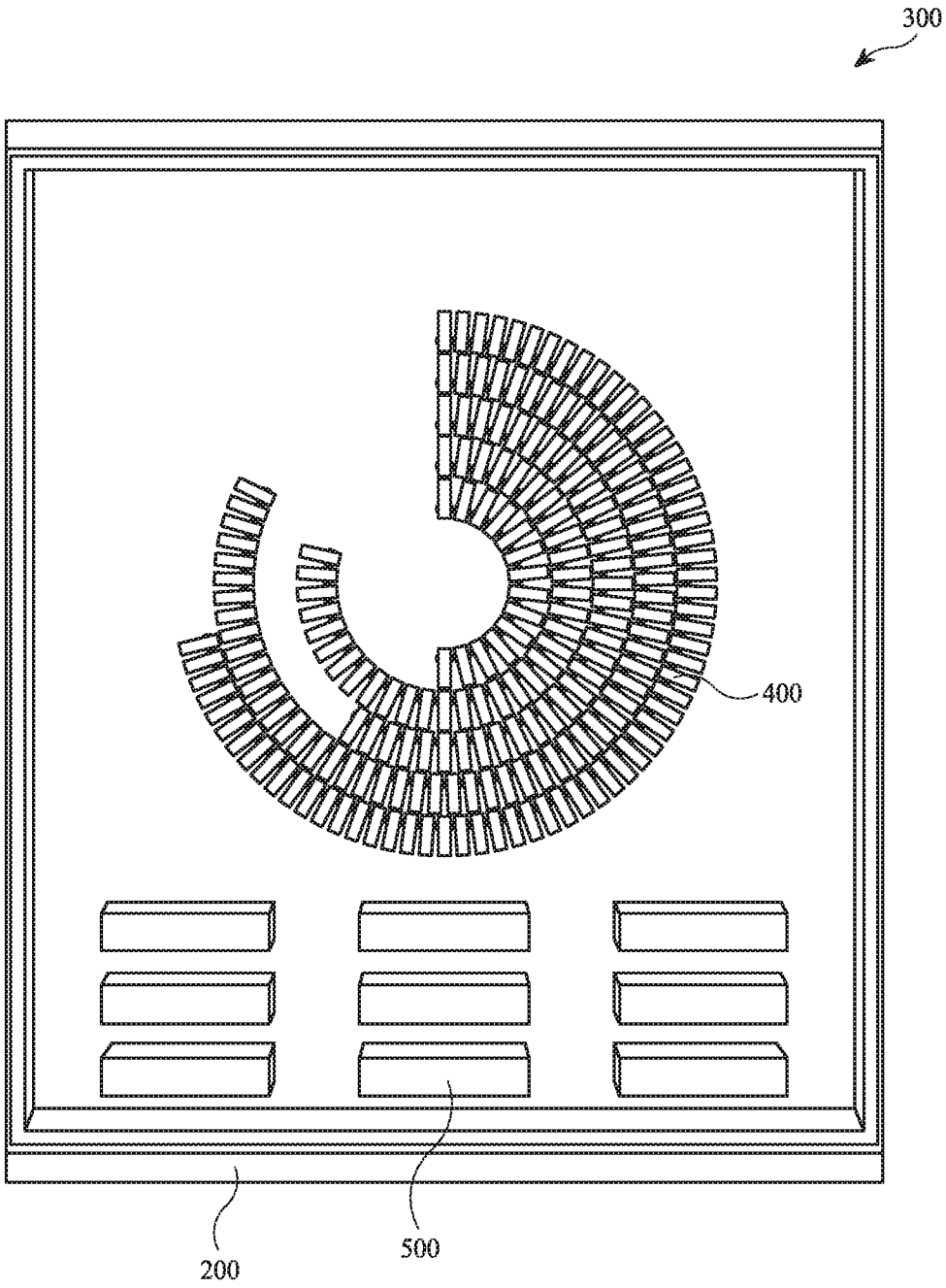
FIG. 43 shows a modular display unit with display elements according to some embodiments.
Figure 44:
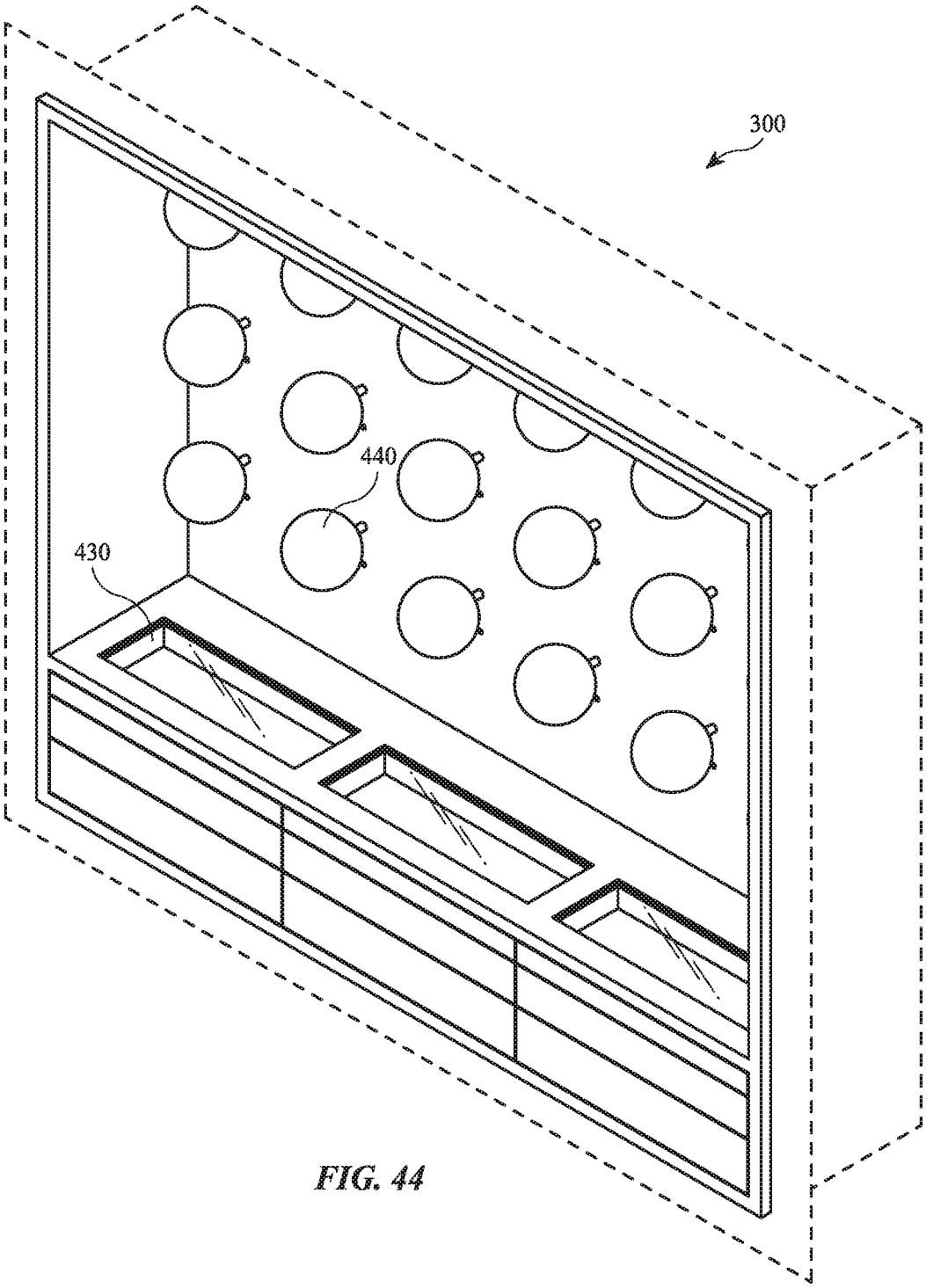
FIG. 44 shows a modular display unit with display elements according to some embodiments.
Figure 45:
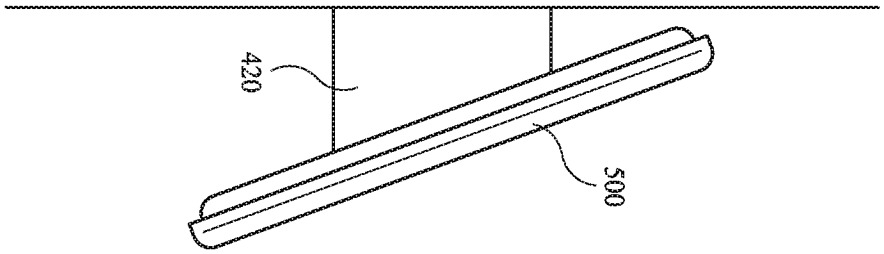
FIG. 45 shows a display element with a product according to some embodiments.
Figure 46:
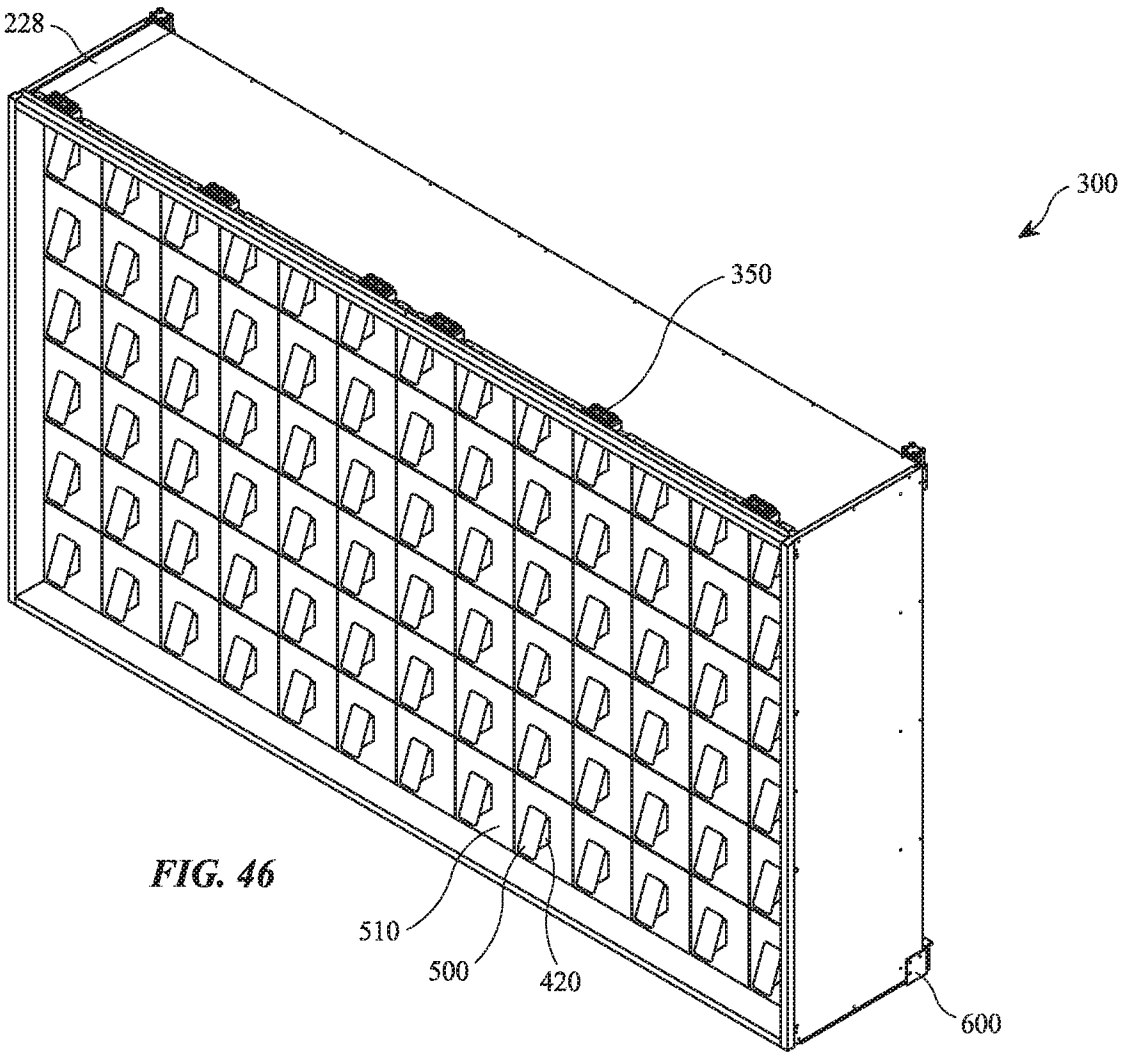
FIG. 46 shows a modular display unit with display elements according to some embodiments.

Display elements 400 disposed within modular display units 300 create differing display modules. For example, as shown in FIG. 39, a TV (television) display module can be created with sample television products exhibited as display elements 400. Two shelves 410 may be used to place products 500 available for sale. Some display modules may only use shelves 410 to showcase sample products as display elements 400 and products for sale 500, as shown in the case display module in FIG. 40. FIG. 41 demonstrates the use of lights 450 in a display module. The example audio module in FIG. 42 utilizes shelves 410 and mounts 460. While some modules simply display products 500 and display elements 400 on shelves 410, others display products 500 and display elements 400 in a manner more directed to a marketing scheme, as shown in FIG. 43. FIG. 44 shows a module that utilizes display cases 430 and spherical display stands 440 (e.g., for headphones). And FIG. 45 shows a product 500 displayed on a product stand 420.

Reconfigurations within modular display units 300 may include changes to any of display elements 400 or products 500. An example modular display unit 300 is shown in FIGS. 46-51. Modular display unit 300 may be moved along display structure 200 by use of roller system 350 and tray 600, as discussed above. In some embodiments, cable 228 may be disposed along the top of modular display unit 300 to provide power and/or data to various display elements 400 or other portions of modular display unit 300. Modular display unit 300 may include a plurality of product stands 420 with products 500 disposed thereon, as shown, for example, in FIG. 46. Product 500 may be, for example, a case for an electronic device. In some embodiments, product stand 420 is disposed on a front face of a display element 400 such as, for example, drawer 510 in which additional products 500 are stored for a customer to access.

Figure 47:
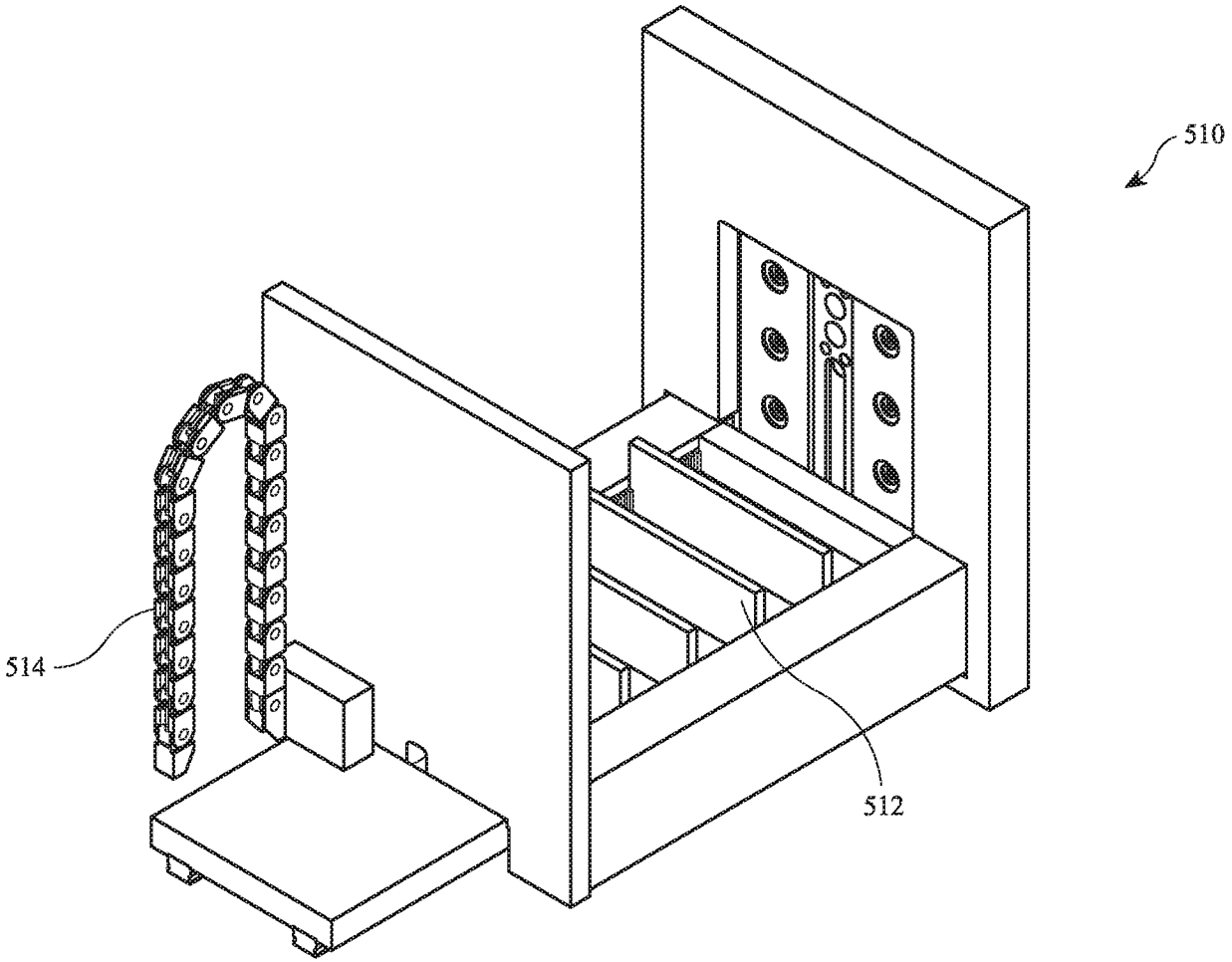
FIG. 47 shows an interior portion of a modular display unit according to some embodiments.
Figure 48:
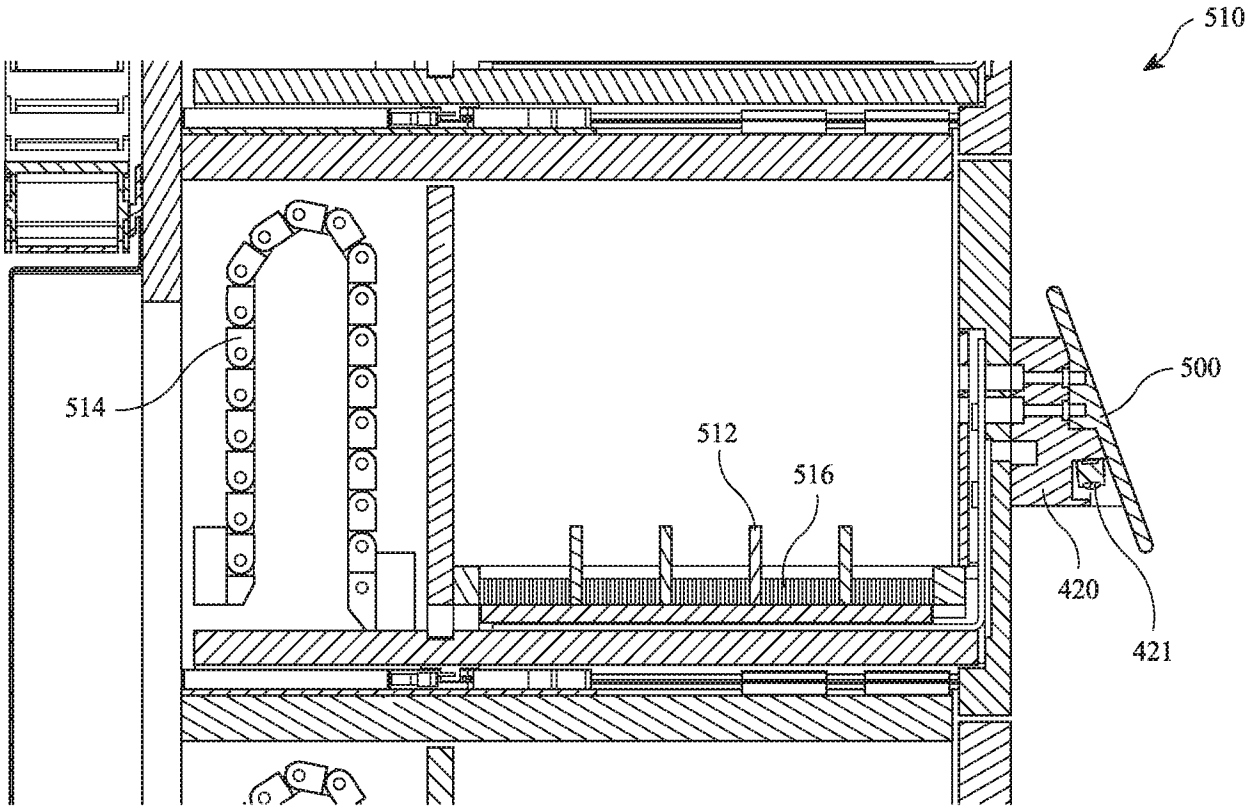
FIG. 48 is a partial cross-section view of a modular display unit according to some embodiments.
Figure 49:
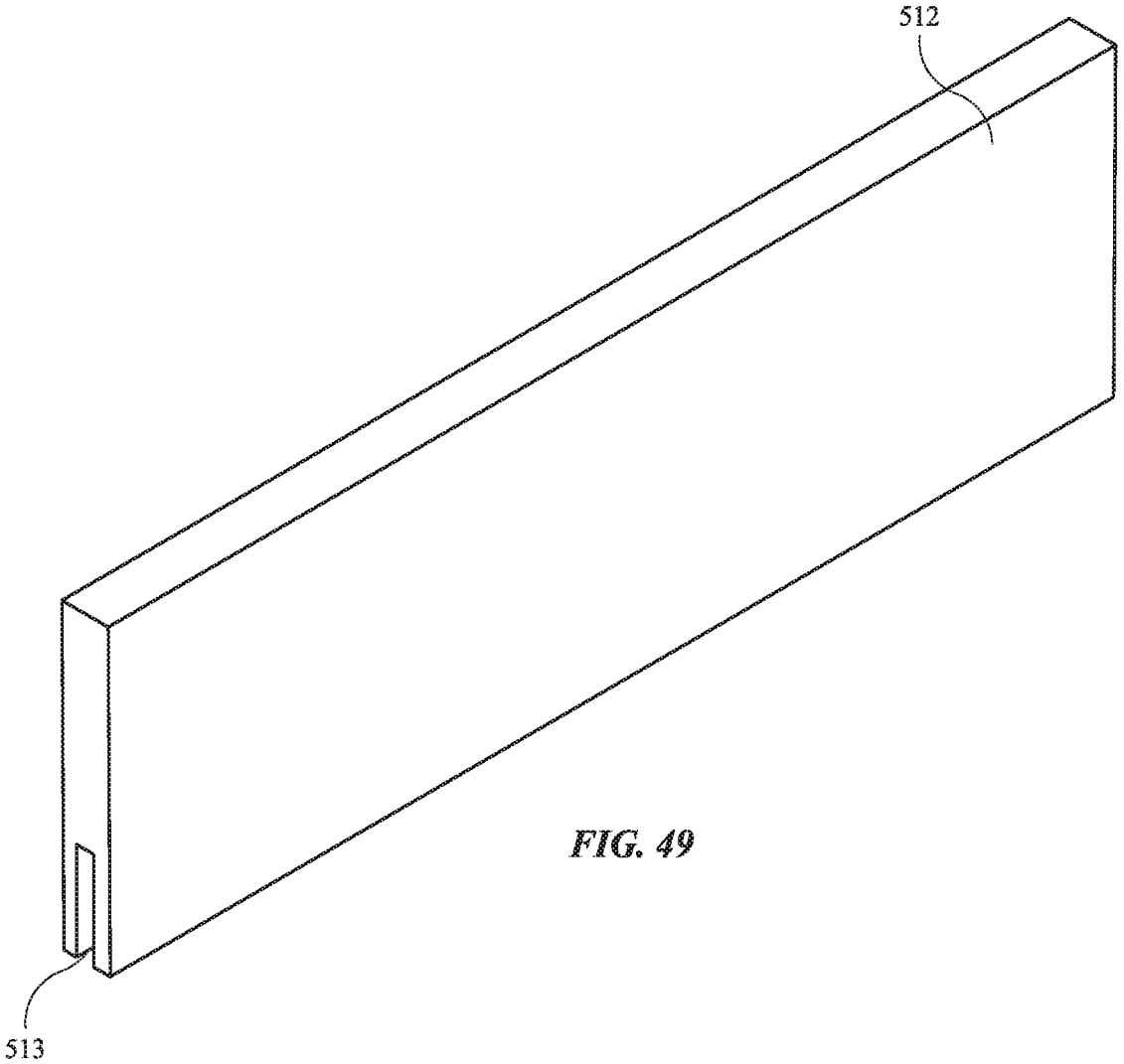
FIG. 49 shows a perspective view of a divider according to some embodiments.
Figure 50:
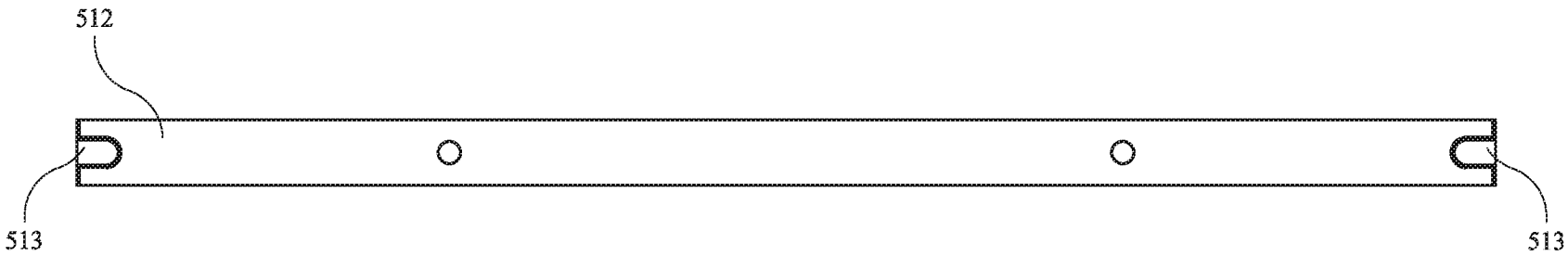
FIG. 50 shows bottom view of a divider according to some embodiments.

In some embodiments, drawer 510 provides further reconfigurability. In some embodiments, drawer 510 includes dividers 512, as shown in FIGS. 47 and 48, to separate multiple products 500. In some embodiments, multiple projections 516 are disposed within drawer 510 to accommodate dividers 512. For example dividers 512, as shown in FIGS. 49 and 50, may include a slot 513 on each side to receive projections 516 on each side of the drawer. In some embodiments, dividers 512 are made of metal, such as aluminum. Slots 513, in some embodiments, are machined grooves disposed at the bottom side edges of dividers 512. In some embodiments, dividers 512 may be moved to be received by different projections to adjust for different sizes of products 500 for sale to fit within drawer 510.

In some embodiments, drawer 510 may include cable 514. In some embodiments, cable 514 is disposed behind a portion of drawer 510 designed to hold products. In some embodiments, cable 514 provides power and/or data to display elements (e.g., display stands 420, see FIG. 45, which may include a light 421 for illuminating a product 500 positioned below) and/or products 500. In some embodiments, cable 514 is configured to allow drawer 510 to open and close without losing a connection by including a sheath formed of a series of linkages to control position of cable 514 throughout opening and closing of drawer 510.

Figure 51:
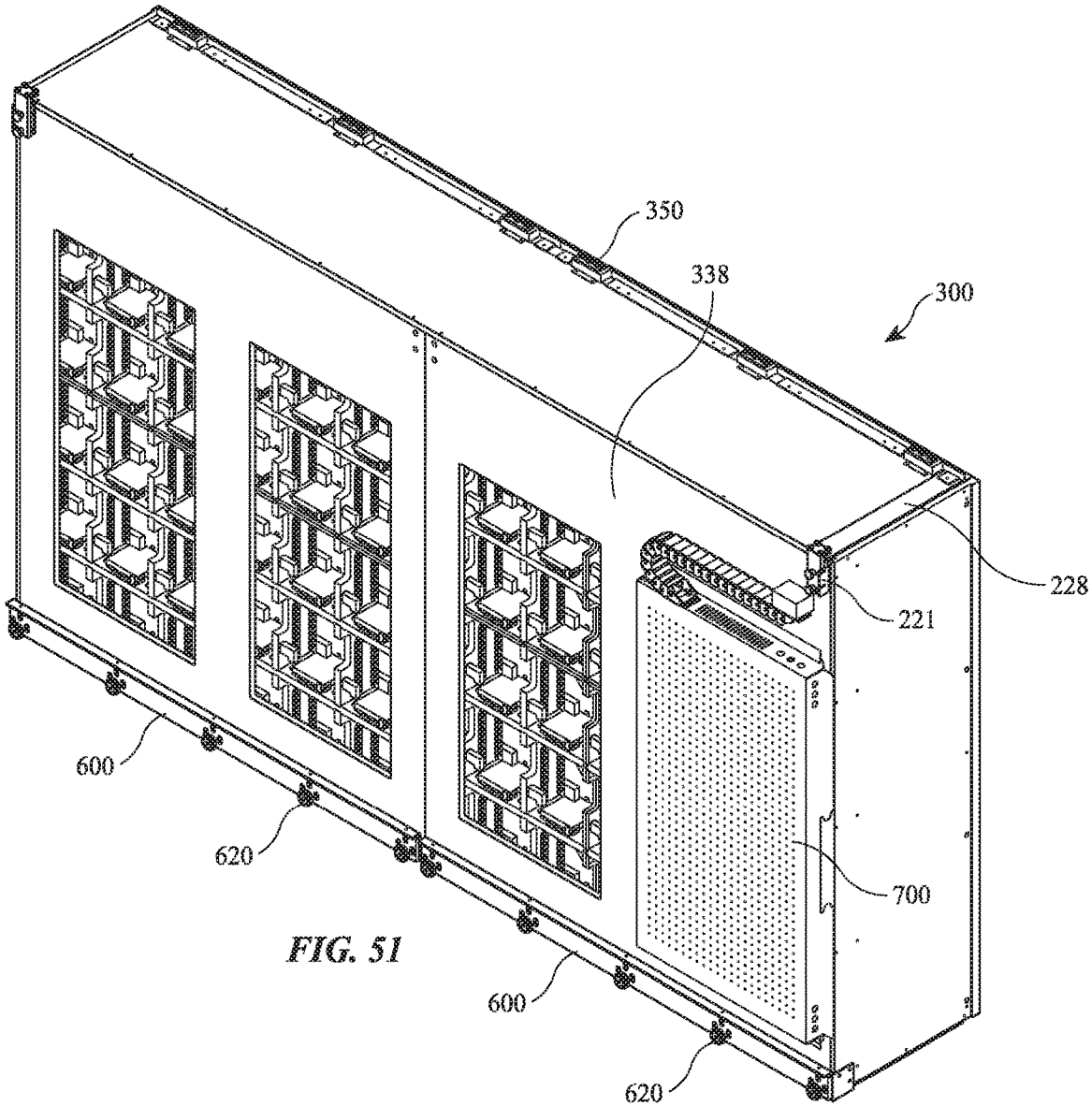
FIG. 51 is a rear perspective view of a modular display unit according to some embodiments.

In some embodiments, modular display unit 300 includes a connector 221 to receive power, data, and/or controls from data box 220, as shown in FIG. 51. Connector 221 may interface with both lighting control port 222 and network control port 224. In some embodiments, connector 221 is disposed on an outside of rear wall 338. In some embodiments, an electronics panel 700 is disposed on an outside of rear wall 338. In some embodiments, electronics panel 700 may hold electronics modules, such as power or control modules. In some embodiments, electronics panel 700 may slide relative to modular display unit 300. In some embodiments, electronics panel 700 is disposed at an edge of rear wall 338. Electronics panel 700 may be slid out from behind modular display unit 300 to provide access to electronics modules within electronics panel 700. In some embodiments, this allows the modules to be replaced or modified from the front side of modular wall system 100 (e.g., to account for different display elements 400 and/or products 500) and without removing modular display unit 300 or accessing it from its rear.

In some embodiments, modular display units 300 may be reconfigured to feature a product 500 or marketing scheme. In some embodiments, for example, as shown in FIGS. 21 and 22, modular display unit 300 may include additional infrastructure to allow for increased reconfigurability. In some embodiments, such infrastructure may include an outer frame 324, vertical rails 326, and horizontal rails 328.

Outer frame 324, in some embodiments, provides support structure for vertical rails 326 and/or horizontal rails 328. In some embodiments, outer frame 324 includes support structure on an outer perimeter of the additional infrastructure. In some embodiments, outer frame 324 includes support structure within the outer perimeter, such as horizontal crossbars or a central vertical cross bar.

Vertical rails 326, in some embodiments, attach to outer frame 324. For example, vertical rails 326 may be attached with fasteners to the outer perimeter and the horizontal crossbars of outer frame 324. In some embodiments, vertical rails 326 may be repositioned along outer frame 324. For example, in some embodiments, vertical rails 326 may be slidable along outer frame 324 for repositioning. In some embodiments, vertical rails 326 may include hooks that accept horizontal rails 328 in different locations. Thus, both vertical rails 326 and horizontal rails 328 may be adjusted to provide for different configurations within modular display unit 300.

In some embodiments, horizontal rails 328 are configured to receive shelves 410. In some embodiments, vertical rails 326 and/or horizontal rails 328 provide electricity to and/or data transmission to and/or from lighting in shelves 410. The adjustability of vertical rails 326 and horizontal rails 328 allows a modular display unit 300 to provide a different presentation to a consumer. For example, the open-face display unit 320 on the left in FIG. 52 may be reconfigured to provide the different presentation shown in the open-face display unit 320 of FIG. 53.

Figure 52:
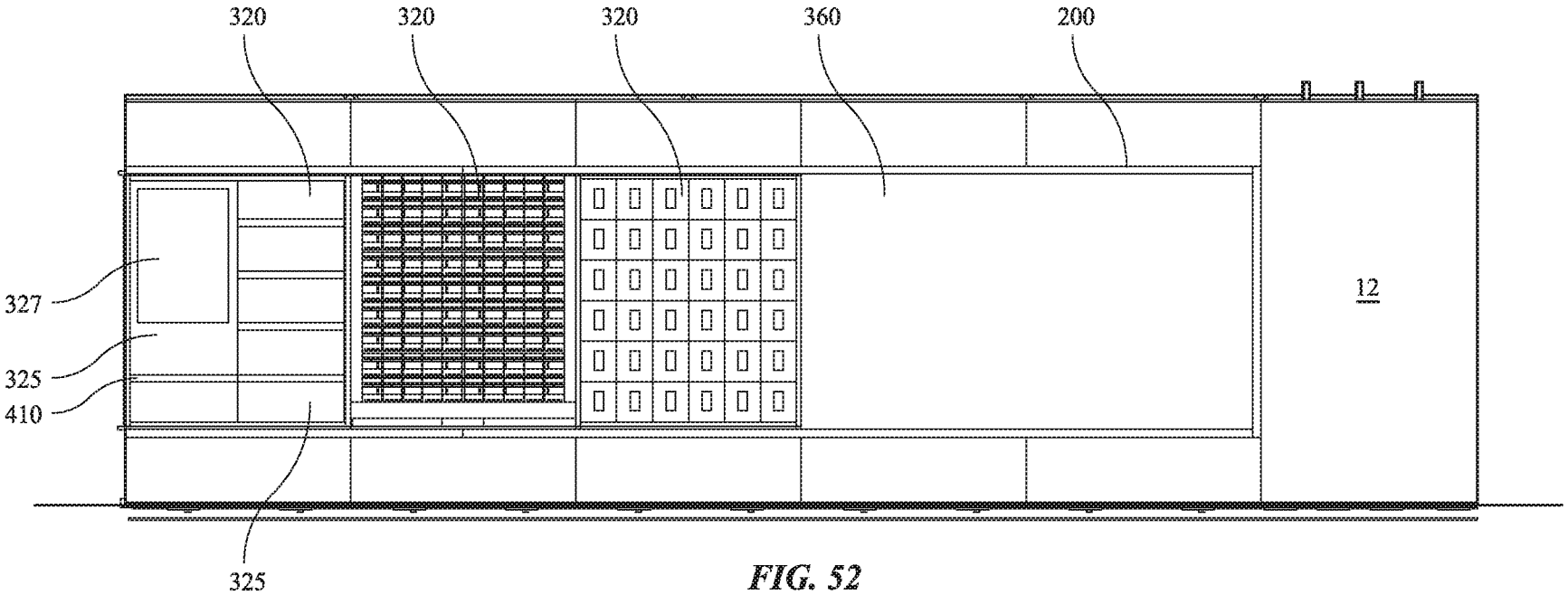
FIG. 52 shows a configuration of a modular wall system according to some embodiments.
Figure 53:
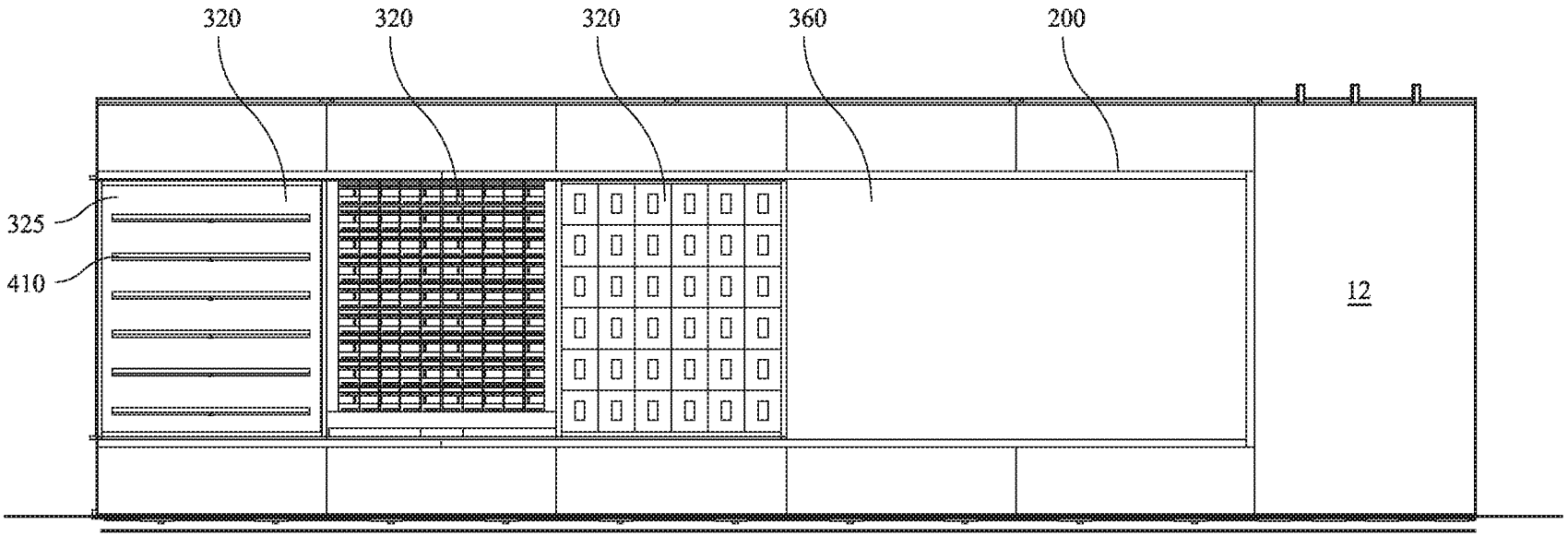
FIG. 53 shows a configuration of a modular wall system according to some embodiments.

In some embodiments, horizontal rails 328 and/or vertical rails 326 are configured to receive backdrop panels 325, as shown, for example, in FIGS. 52 and 53. Backdrop panels 325 may be of various sizes to correspond to a desired presentation. In some embodiments, backdrop panels 325 may be inserted between shelves 410. In some embodiments, backdrop panels 325 may include holes through which supports for other elements may extend, such as, for example, graphic fabric displays 327 or shelves 410.

In some embodiments, backdrop panels 325 hide the additional infrastructure (outer frame 324, vertical rails 326, and horizontal rails 328) from an observer's view. In some embodiments, backdrop panels 325 may be made of or have the appearance of wood to match the appearance of trimming or nosing 251. In some embodiments, backdrop panels 325 may be made of or have the appearance of a textile fabric to provide a soft, diffuse appearance. In some embodiments, backdrop panels 325 may have other characteristics that contribute to the presentation of a featured product 500 or marketing scheme (e.g., color or pattern). Thus, while modular display unit 300 may be fully reconfigurable, backdrop panels 325 hides the infrastructure that facilitates the reconfigurability, giving the impression that modular display unit 300 is not reconfigurable.

According to the configurations described herein, modular wall system 100 may be reconfigured to accommodate the needs and desires for retail environment 10. These reconfigurations may include moving modular display units 300 within display structure 200, changing the size of modular display units 300, and changing display elements 400 within modular display units 300.

Figure 54:
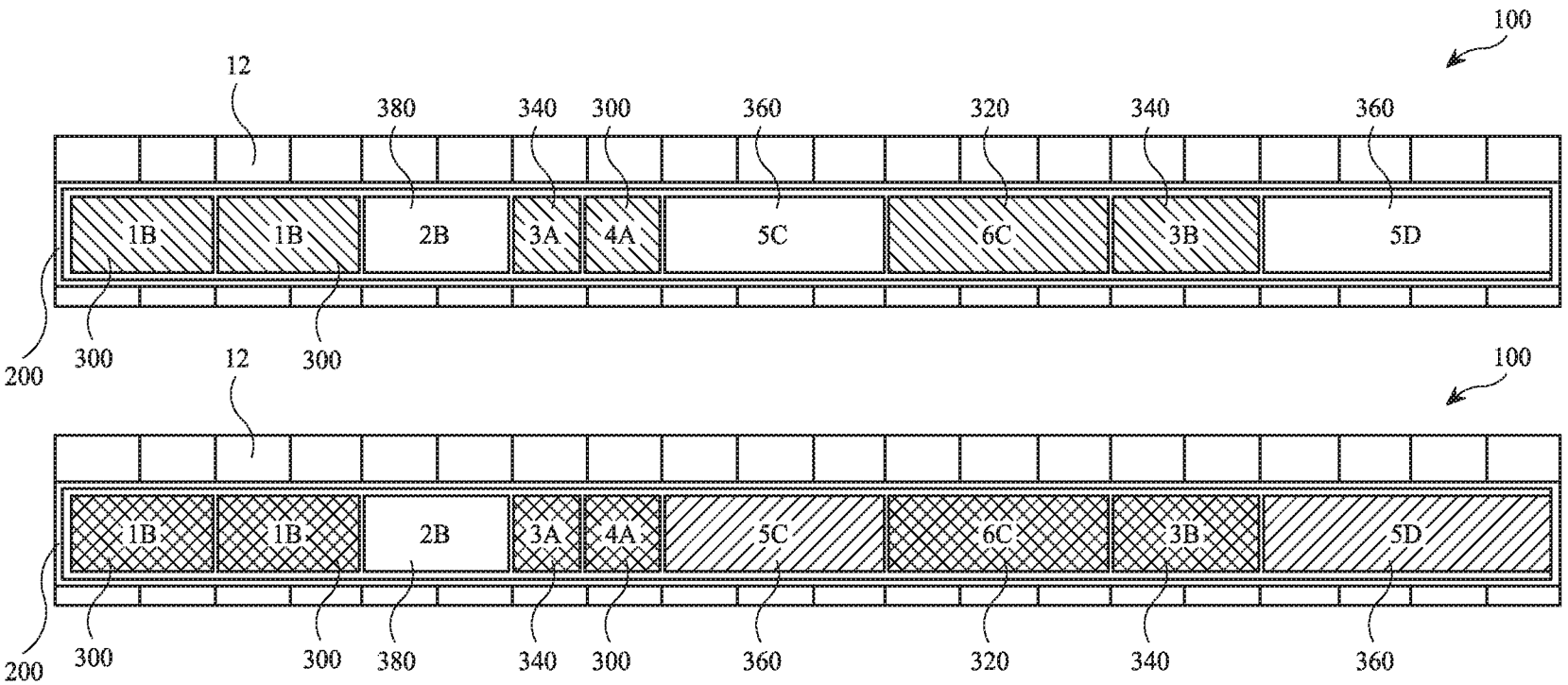
FIG. 54 shows a configuration and a reconfiguration of a modular wall system according to some embodiments.
Figure 55:
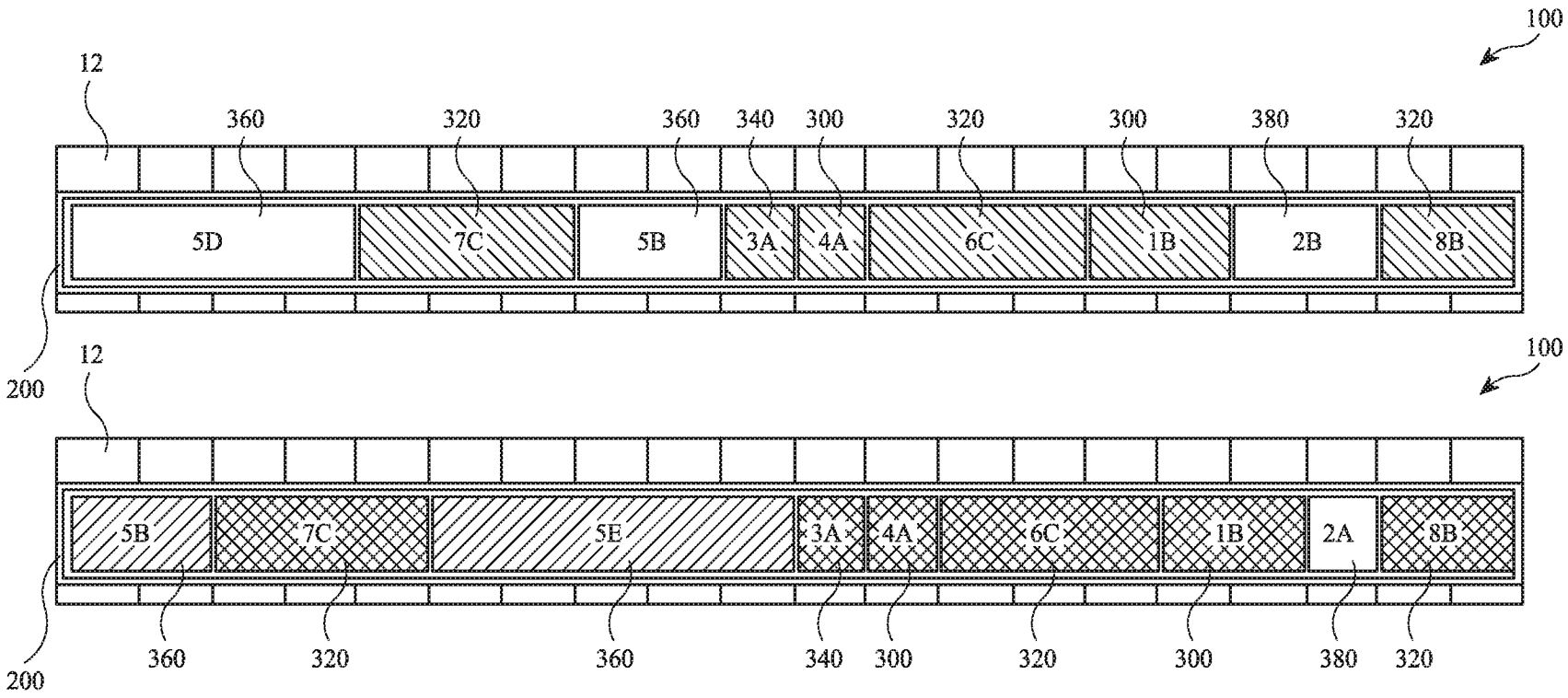
FIG. 55 shows a configuration and a reconfiguration of a modular wall system according to some embodiments.
Figure 56:
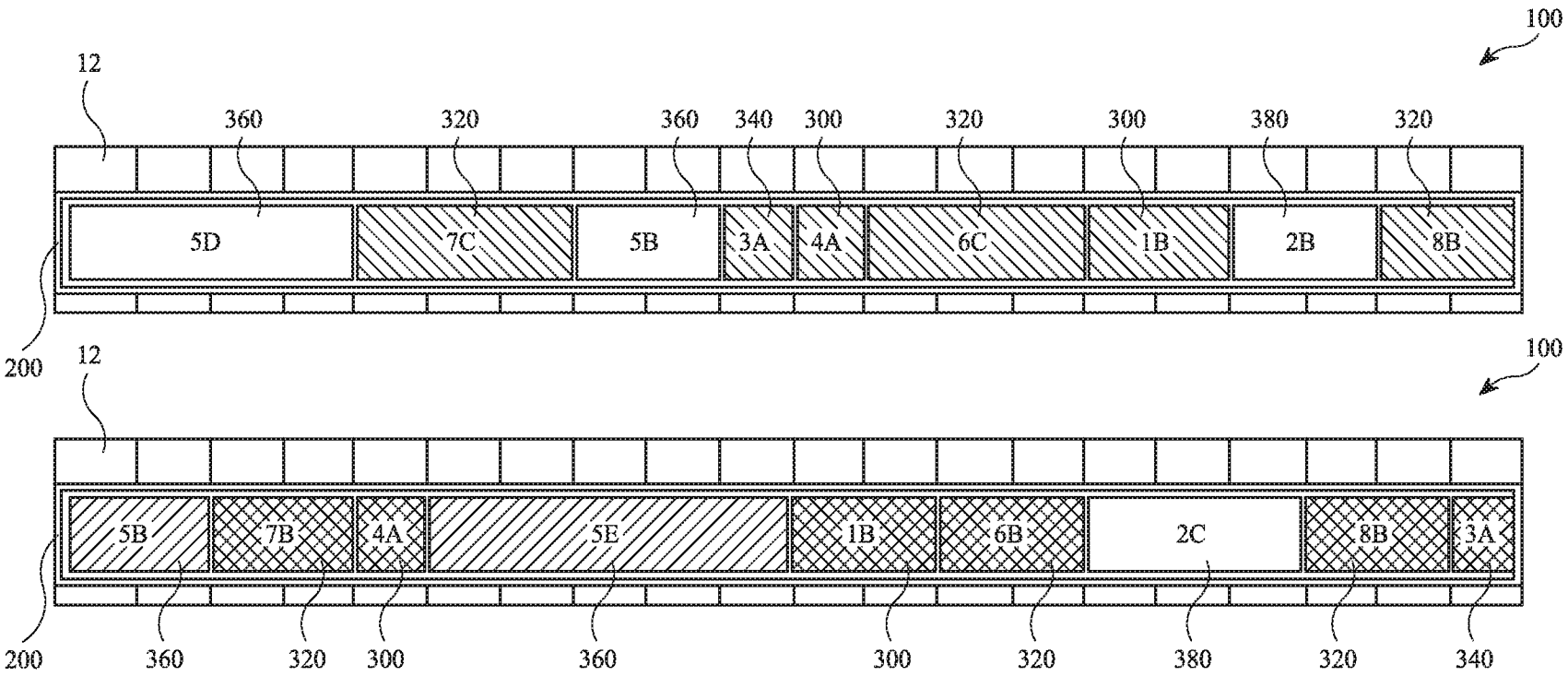
FIG. 56 shows a configuration and a reconfiguration of a modular wall system according to some embodiments.

Example reconfigurations are illustrated in FIGS. 54-56 with the original display on the top and the reconfigured display on the bottom. Reconfigurations may be driven by one or more factors. For example, reconfigurations may be driven by merchandising and/or marketing. Some reconfigurations may be done at a very simple level, while other reconfigurations require greater effort. In FIGS. 54-56, the numerals represent various module types and the letters represent various sizes, as follows: shelves 1, living wall 2, vitrine 3, vignette 4, graphic light box 5, audio products 6, television products 7, and other products 8. The letter A represents five feet, B represents ten feet, C represents fifteen feet, D represents twenty feet, and E represents twenty-five feet. Modules without left leaning diagonal lines (e.g., 2B in FIG. 54) are expandable and modules with left leaning diagonal lines (e.g., 1B in FIG. 54) are slidable or rollable. Modules in the reconfigured display with right leaning diagonal lines (e.g., 5C in FIG. 54) have refreshed content or display elements 400. Thus, modules in the reconfigured display with both right leaning and left leaning diagonal lines (e.g., 3A in FIG. 54) are slidable or rollable and have refreshed content.

In FIG. 54, none of the modular display units 300 were moved, but the content or display elements 400 were refreshed. In FIG. 55, the graphic light box 5D was reduced in size to 5B, the display of television products 7C was slid to the left by ten feet, the graphic light box 5B was expanded to 5E, the next four modular display units 300 (vitrine 3A, vignette 4A, display of audio products 6C, and shelves 1B) were slid to the right by five feet, the living wall 2B was reduced to 2A, and the display of other products 8B was not moved, but its content was refreshed. While FIGS. 54 and 55 were done at a low and moderate complexity level, FIG. 56 illustrates a more complex reconfiguration. Graphic light box 5D was reduced to 5B, display of television products 7C was removed and replaced with 7B, graphic light box 5B was expanded to 5E, vitrine 3A was repositioned to the right by 50 feet, vignette 4A was repositioned to the left by thirty feet, display of audio products 6C was removed and replaced with 6B, shelves 1B were repositioned to the left by twenty feet, living wall 2B was expanded to 2C and repositioned to the left by five feet, and the display of other products 8B was slid to the left by five feet. These reconfigurations merely provide examples of the types of changes that can be made within modular wall system 100.

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein.

The detailed description section is intended to be used to interpret the claims. The summary and abstract sections may set forth one or more but not all exemplary embodiments of the present invention as contemplated by the inventor(s), and thus, are not intended to limit the present invention and the claims.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The phraseology or terminology used herein is for the purpose of description and not limitation, such that the terminology or phraseology of the present specification is to be interpreted by the skilled artisan.

The breadth and scope of the present invention should not be limited by any of the above-described exemplary embodiments, but should be defined in accordance with the claims and their equivalents.

What is claimed is:

1. A retail environment having a side wall extending from a floor to a ceiling, the retail environment comprising:

a display structure built into and extending along the side wall, the display structure having a frame and a cavity open to a front side of the wall, the frame defining the outer periphery of the cavity, the cavity being recessed within the frame, the cavity having a total cavity length N, the total cavity length N being configured in increments of n; and at least two modular display units disposed within the cavity, the modular display units having a unit length of n, 2n, 3n, or 4n, the total length of all the modular display units being equal to the total cavity length N, at least two of the modular display units having different display characteristics formed at least in part by products presented for sale in different configurations, wherein the modular display units are reconfigurable within the cavity, wherein at least a first one of the modular display units has a length of n, and wherein at least a second one of the modular display units has a length of 2n.

2. The retail environment of claim 1, wherein the at least two modular display units comprises nine modular display units.

3. The retail environment of claim 1, wherein n is five feet.

4. The retail environment of claim 1, wherein N is at least fifty feet.

5. The retail environment of claim 1, wherein the side wall further comprises electrical infrastructure that provides power to the modular display units.

6. The retail environment of claim 5, wherein at least one of the modular display units comprises a graphic light box that comprises a fabric graphic panel and a light source disposed behind the fabric graphic panel.

7. The retail environment of claim 1, wherein the frame comprises a bottom panel defining a bottom of the cavity, wherein the retail environment further comprises a plurality of trays disposed on the bottom panel, wherein the plurality of trays are movable along the bottom panel, and wherein the at least two modular display units are disposed on the plurality of trays.

8. The retail environment of claim 1, wherein the frame comprises a bottom panel defining a bottom of the cavity, and wherein the retail environment further comprises:

tracks disposed on an inner surface of the bottom panel; and a rolling system disposed on an outer surface of a bottom of each modular display unit, wherein the rolling system interfaces with the tracks to allow the display units to slide along the bottom panel.

9. The retail environment of claim 8, wherein the frame comprises a top panel defining a top of the cavity, and wherein the retail environment further comprises:

tracks disposed on an inner surface of the top panel; and a rolling system disposed on outer surface of a top of each modular display unit, wherein the rolling system interfaces with the tracks to allow the display units to slide along the top panel.

10. The retail environment of claim 1, further comprising a rear panel, wherein at least one of the modular display units is mounted to the rear panel.

11. The retail environment of claim 1, wherein each of the modular display units comprises a frame defining the outer periphery of the modular display unit.

12. The retail environment of claim 11, wherein frame of each of the modular display units extends between a top wall and a bottom wall of the display structure frame such that a top wall of each modular display unit frame is adjacent to the top wall of the display unit frame and a bottom wall of each modular display unit frame is adjacent to the bottom wall of the display structure frame.

13. The retail environment of claim 1, wherein a height of the display structure is between 50% and 75% of a height of the side wall, and wherein a distance from a bottom of the side wall and a bottom of the display structure is at least 1 foot.

14. The retail environment of claim 1, wherein the modular display units comprise display stands.

15. The retail environment of claim 1, wherein at least a third one of the modular display units has a length of 4n.

16. The retail environment of claim 1, wherein at least one of the modular display units comprises a television, and wherein at least one of the modular display units comprises products presented for sale.

17. The retail environment of claim 1, wherein the modular display units are positioned side-by-side adjacent to each other.

18. The retail environment of claim 1, wherein each of the modular display units is not disposed above or below another display unit, and wherein a portion of the side wall is disposed above and below the modular display units.

* * * * *